US007942731B2

(12) United States Patent
Walker et al.

(10) Patent No.: US 7,942,731 B2
(45) **Date of Patent: *May 17, 2011**

(54) METHOD AND APPARATUS FOR FACILITATING GAME PLAY WITH A MORTGAGING OPTION

(75) Inventors: Jay S. Walker, Ridgefield, CT (US); James A. Jorasch, New York, NY (US); Peter Kim, New York, NY (US); Geoffrey M. Gelman, Boston, MA (US); Peter J. Vogel, Hartland, WI (US); Michael D. Downs, Stamford, CT (US)

(73) Assignee: IGT, Reno, NV (US)

( * ) Notice: Subject to any disclaimer, the term of this patent is extended or adjusted under 35 U.S.C. 154(b) by 868 days.

This patent is subject to a terminal disclaimer.

(21) Appl. No.: 11/243,398

(22) Filed: Oct. 4, 2005

(65) Prior Publication Data

US 2006/0108736 A1 May 25, 2006

Related U.S. Application Data

(63) Continuation-in-part of application No. 10/341,450, filed on Jan. 10, 2003, now Pat. No. 7,111,845, which is a continuation-in-part of application No. 09/609,720, filed on Jun. 30, 2000, now Pat. No. 6,523,829.

(60) Provisional application No. 60/201,863, filed on May 4, 2000.

(51) Int. Cl.
*A63F 1/00* (2006.01)
*G07F 17/34* (2006.01)

(52) U.S. Cl. ..... 463/12; 463/13; 463/20; 273/143 R; 273/292; 273/138.2

(58) Field of Classification Search ..... 273/143 R, 273/138.2, 138.1, 274, 292; 463/12, 13, 463/16–20, 25–27, 39, 40, 42
See application file for complete search history.

(56) References Cited

U.S. PATENT DOCUMENTS

| | | | | |
|---|---|---|---|---|
| 3,810,627 | A | 5/1974 | Levy | 463/42 |
| 4,339,798 | A | 7/1982 | Hedges et al. | 364/412 |
| 4,669,731 | A | 6/1987 | Clarke | 273/143 R |
| 4,743,022 | A | 5/1988 | Wood | 273/85 CP |

(Continued)

FOREIGN PATENT DOCUMENTS

AU B-81957/87 3/1996

(Continued)

OTHER PUBLICATIONS

"Hot Slots & Reel Deals, Atlantic City Insider—Revealing the Casinos Best-Kept Secrets", Oct. 1996, vol. 1, No. 2.

(Continued)

*Primary Examiner* — Benjamin H Layno
(74) *Attorney, Agent, or Firm* — K&L Gates LLP

(57) ABSTRACT

In some embodiments, methods and apparatus allow for a plurality of options to be displayed to a player for playing at least one round of a game in accordance with at least one advantage and/or disadvantage. The player may accept an option. For example, a player may accept an option to play at least one future round of play in accordance with a rule that is different from a rule used in a current round of play.

21 Claims, 21 Drawing Sheets

U.S. PATENT DOCUMENTS

| | | | | |
|---|---|---|---|---|
| 4,991,848 | A | 2/1991 | Greenwood et al. | 273/143 R |
| 5,022,653 | A | 6/1991 | Suttle et al. | 273/999 |
| 5,033,744 | A | 7/1991 | Bridgeman et al. | 463/13 |
| 5,118,109 | A | 6/1992 | Gumina | 273/139 |
| 5,123,649 | A | 6/1992 | Tiberio | 273/143 R |
| 5,178,390 | A | 1/1993 | Okada | 273/143 R |
| 5,294,120 | A | 3/1994 | Schultz | 273/85 CP |
| 5,322,295 | A | 6/1994 | Cabot et al. | 273/292 |
| 5,370,399 | A | 12/1994 | Liverance | 273/434 |
| 5,374,061 | A | 12/1994 | Albrecht | 273/149 R |
| 5,377,973 | A | 1/1995 | Jones et al. | 273/85 CP |
| 5,401,023 | A | 3/1995 | Wood | 273/85 CP |
| 5,407,199 | A | 4/1995 | Gumina | 273/139 |
| 5,407,209 | A | 4/1995 | Prerost | 273/292 |
| 5,411,257 | A | 5/1995 | Fulton | 273/85 CP |
| 5,415,404 | A | 5/1995 | Joshi et al. | 273/138 |
| 5,454,570 | A | 10/1995 | Karal | 273/292 |
| 5,511,781 | A | 4/1996 | Wood et al. | 273/85 CP |
| 5,531,441 | A | 7/1996 | Dabrowski et al. | 463/12 |
| 5,542,669 | A | 8/1996 | Charron et al. | 463/13 |
| 5,544,892 | A * | 8/1996 | Breeding | 273/292 |
| 5,570,885 | A * | 11/1996 | Ornstein | 463/27 |
| 5,586,936 | A | 12/1996 | Bennett et al. | 463/25 |
| 5,626,341 | A | 5/1997 | Jones et al. | 273/292 |
| 5,630,753 | A | 5/1997 | Fuchs | 463/9 |
| 5,632,485 | A | 5/1997 | Woodland et al. | 273/292 |
| 5,645,281 | A | 7/1997 | Hesse et al. | 273/292 |
| 5,649,705 | A | 7/1997 | String | 273/292 |
| 5,660,391 | A | 8/1997 | Klasee | 273/292 |
| 5,669,606 | A | 9/1997 | Brown | 273/292 |
| 5,718,431 | A | 2/1998 | Ornstein | 273/292 |
| 5,770,533 | A | 6/1998 | Franchi | 463/42 |
| 5,775,992 | A | 7/1998 | Wood et al. | 463/13 |
| 5,791,989 | A | 8/1998 | Slinkman | 463/12 |
| 5,799,946 | A | 9/1998 | Groussman | 273/292 |
| 5,816,575 | A | 10/1998 | Keller | 273/292 |
| 5,823,873 | A | 10/1998 | Moody | 463/13 |
| 5,836,586 | A | 11/1998 | Marks et al. | 273/292 |
| 5,851,011 | A | 12/1998 | Lott | 273/292 |
| 5,851,147 | A | 12/1998 | Stupak et al. | 463/13 |
| 5,855,514 | A | 1/1999 | Kamille | 463/17 |
| 5,868,619 | A | 2/1999 | Wood et al. | 463/13 |
| 5,951,012 | A | 9/1999 | Feola | 273/292 |
| 5,967,893 | A | 10/1999 | Lawrence et al. | 463/10 |
| 5,999,808 | A | 12/1999 | LaDue | 455/412.2 |
| 6,001,016 | A | 12/1999 | Walker et al. | 463/42 |
| 6,024,642 | A | 2/2000 | Stupak | 463/20 |
| 6,045,129 | A | 4/2000 | Cooper et al. | 273/292 |
| 6,050,568 | A | 4/2000 | Hachquet | 273/292 |
| 6,068,552 | A | 5/2000 | Walker et al. | 463/21 |
| 6,120,378 | A | 9/2000 | Moody et al. | 463/20 |
| 6,126,541 | A | 10/2000 | Fuchs | 463/13 |
| 6,135,883 | A | 10/2000 | Hachquet | 463/13 |
| 6,159,097 | A | 12/2000 | Gura | 463/20 |
| 6,227,969 | B1 | 5/2001 | Yoseloff | 463/13 |
| 6,270,405 | B1 | 8/2001 | Ferguson | 463/13 |
| 6,270,409 | B1 | 8/2001 | Shuster | 463/20 |
| 6,270,412 | B1 | 8/2001 | Crawford et al. | 463/20 |
| 6,334,613 | B1 | 1/2002 | Yoseloff | 273/292 |
| 6,343,989 | B1 | 2/2002 | Wood et al. | 463/23 |
| 6,390,473 | B1 | 5/2002 | Vancura et al. | 273/292 |
| 6,474,645 | B2 | 11/2002 | Tarantino | 273/274 |
| 6,517,074 | B1 | 2/2003 | Moody et al. | 273/292 |
| 6,533,273 | B2 | 3/2003 | Cole et al. | 273/138.1 |
| 6,568,680 | B1 | 5/2003 | Moody et al. | 273/292 |
| 6,708,975 | B1 | 3/2004 | Fox et al. | 273/292 |
| 6,712,693 | B1 | 3/2004 | Hettinger | |
| 7,111,845 | B2 * | 9/2006 | Walker et al. | 273/292 |
| 2002/0193099 | A1 | 12/2002 | Paulsen | 455/414 |
| 2003/0069068 | A1 | 4/2003 | Kaminkow | 463/25 |
| 2003/0100357 | A1 | 5/2003 | Walker et al. | |
| 2003/0164590 | A1 | 9/2003 | Moody | 273/292 |
| 2003/0207713 | A1 | 11/2003 | Taylor | |
| 2004/0198334 | A1 * | 10/2004 | Chmaytelli et al. | 455/419 |
| 2006/0046816 | A1 | 3/2006 | Walker et al. | |
| 2006/0052157 | A1 | 3/2006 | Walker et al. | |

FOREIGN PATENT DOCUMENTS

| | | |
|---|---|---|
| EP | 0 167 713 A | 8/1994 |
| WO | WO 96/08295 | 3/1996 |
| WO | WO 99/00164 | 1/1999 |
| WO | WO 03/009913 A1 | 2/2003 |

OTHER PUBLICATIONS

Kim, Jae-Ha, Grochowski, John, "Groupie? Girl Fans Not Always After Band. How to Keep from Being Worst Blackjack Player", Chicago Sun-Times, Dec. 6, 1996, WKPWKP; Backbeatgaming Section at p. 521.

Grochowski, John, "Double Exposure Gives Game New Look", Chicago Sun-Times, Jun. 22, 1997, SHO; Casinos Section at p. 17.

"ZDNet Software Library—Ultimate Blackjack", (http://hotfiles.zdnet.com/cgi-bin/texis/swlib/hotfiles/info.html?), download date: Jul. 2, 1998.

"Blackjack at the Grand Taj Casino", (http://www.tajgambling.com/blackjack-21.htm), download date: Feb. 13, 2000.

"The Wizard of Odds", (http://www.thewizardofodds.com/game/spanish21.htm), download date: Feb. 14, 2000.

"Roulette is an easy to play, no-skill game for novice gamblers", Chicago Daily Herald, Sep. 8, 2000, Section: Time Out! Riverboat Gambling, p. 15.

Grochowski, John, "Casinos aren't offering early surrender option", Chicago Sun-Times, May 4, 2001, Section: Weekend Plan; Gaming, p. 23.

Website: "Money Time at Casino Windsor", (http www casinowindsor com/casino/slots/moneytime htm), download date: Jul. 25, 2001.

Fine, Adam, "Players Network Gaming Guide Article—Big River", (http www playersnetwork com/travel/articles/big-river 001,005 html), download date: Jul. 25, 2001.

Website: "Blackjacks Online Casino—Paigow Poker", (http //www blackjacksonlinecasino com/paigow html), download date: Sep. 7, 2001.

Website: "Hustler How-To For Lowball", (http //www hustlergaming com/lowNoFlash html), download date: Oct. 4, 2001.

Website: "Wireplay Poker", (http www wireplay com au/scripts/Games asp?GameID2=56&I=2), download date: Oct. 4, 2001.

Website: "Pick'em Video Poker", Video Poker 1, (http //www videopoker1 com), copyright 2002.

Grochowski, John, "Time is the newest name of the game", Chicago Sun-Times, Nov. 30, 2001, Section: Weekend Plus, News, Gaming, p. 21.

Website: "Blackjack—Odds and Strategy—The Wizard of Odds", (http //www thewizardofodds com/game/bj html), download date: Jul. 23, 2002.

Malmuth, Mason et al., Website: "Fundamentals of Video Poker Excerpt", Two Plus Two Publishing, (http www twoplustwo com/fvp html), download date: Jul. 23, 2002.

Website: "How to Play Video Poker—game rules, gambling tips, and strategies", (http //www casinobeat com/poker shtml), download date: Jul. 23, 2002.

"Frequently Asked Questions", Vermont State Lottery Commission, download date: Jul. 24, 2002.

Smolen, Don, "CPOKER", (http //conjelco com/software html), download date: Feb. 14, 2003.

Website: "Rules of the Game—3.4 Splitting Pairs", (http //www blackjackinfo com/bjrules htm), download date: Feb. 14, 2003.

Website: "Rules of the Game—3.1 Surrender", (http //www blackjackinfo com/bjrules htm), download date: Feb. 14, 2003.

Doocey, Paul, "The Case for Legal Sports Betting", International Gaming & Wagering Business Apr. 1996, (IGWB), vol. 17, No. 4, p. 2 and 36, 3pp.

Brochure: "$mart Gambler Software PC Information Systems", ZDNet Software Library—$mart Gambler, (wysiwyg //4/http//hotfiles zdnet....bin/texis/swlib/hotfiles/info htm) download date: Jun. 29, 1998, 1pg.

Brochure: "SimJack Software Keith Marting", ZDNet Software Library—SimJack, (wysiwyg //12/http //hotfiles zdnet....bin/texis/swlib/hotfiles/info htm) download date: Jun. 29,1998, 1pg.

Brochure: "Blackjack Plus for Windows Musicode Software", ZDNet Software Library—Blackjack for Windows, (wysiwyg //13/ http //hotfiles zdnet....bin/texis/swlib/hotfiles/info htm) download date: Jun. 29, 1998, 1pg.
Brochure: "Ne Plus Ultra Blackjack Practicum Ne Plus Ultra Software, Inc.", ZDNet Software Library—Ne Plus Ultra Blackjack Practicum, (wysiwyg //14/http //hotfiles zdnet....bin/texis/swlib/ hotfiles/info htm) download date: Jun. 29, 1998, 1pg.
Brochure: "Blackjack Simulation Software DiamondSoft", ZDNet Software Library—Blackjack Simulation, (wysiwyg //10/http //hotfiles zdnet....bin/texis/swlib/hotfiles/info htm) download date: Jun. 29, 1998, 1pg.
Brochure: "Ultimate Blackjack Accidental Software", ZDNet Software Library—Ultimate Blackjack, (http // hotfiles zdent com/ cgi-bin/texis/swlib/hotfiles/info html?fcode+0000T5) download date: Jul. 2, 1998, 1pg.
Hemenway, Jim, "Bustproof Blackjack™", Gaming Analytics Casino Game Development and Analysis, Received Via Facsimile from the USPTO on Oct. 31, 2002, undated, 3pp.
Letter: "State of Nevada Gaming Control Board—Re: Correspondence #96-0140, 'Bustproof Blackjack'", Gaming Control Board, May 22, 1996, 1pg.
Office Action for U.S. Appl. No. 10/341,450 dated Jun. 1, 2004, 6pp.
Interview Summary for U.S. Appl. No. 10/341,450 dated Jun. 18, 2004, 4pp.
Office Action for U.S. Appl. No. 10/341,450 dated Nov. 10, 2004, 6pp.
Interview Summary for U.S. Appl. No. 10/341,450 dated Dec. 6, 2004, 4pp.
Notice of Allowability for U.S. Appl. No. 10/341,450 dated Feb. 6, 2005.
Supplemental Notice of Allowability for U.S. Appl. No. 10/341,450 dated May 5, 2005, 2pp.
Office Action for U.S. Appl. No. 09/609,720 dated Sep. 25, 2001, 4pp.
Office Action for U.S. Appl. No. 09/609,720 dated Feb. 28, 2002, 5pp.
Notice of Allowability for U.S. Appl. No. 09/609,720 dated Aug. 26, 2002, 3pp.
Office Action for U.S. Appl. No. 09/610,120 dated Sep. 25, 2001, 4pp.
Office Action for U.S. Appl. No. 09/610,120 dated Feb. 28, 2002, 6pp.
Interview Summary for U.S. Appl. No. 09/610,120 dated Jul. 18, 2002, 2pp.
Notice of Allowability for U.S. Appl. No. 09/610,120 dated Nov. 4, 2002, 3pp.
Notice of Allowability for U.S. Appl. No. 10/361,904 dated Sep. 8, 2003, 3pp.
Notification of Transmittal of the International Search Report or Declaration for Application No. PCT/US98/08020 dated Aug. 11, 1998, 4pp.
Written Opinion for Application No. PCT/US98/08020 dated Apr. 20, 1999, 5pp.
Notification of Transmittal of International Preliminary Examination Report for Application No. PCT/US02/23688 dated Mar. 28, 2003, 5pp.
International Search Report for Application No. PCT/US02/23688 dated Dec. 12, 2002, 6pp.
Office Action for U.S. Appl. No. 11/428,645 dated Oct. 27, 2008, 12 pp.
Office Action for U.S. Appl. No. 11/248,655 dated Oct. 28, 2008, 11 pp.
Office Action for U.S. Appl. No. 11/428,863 dated Dec. 29, 2008, 12 pp.
Brochure: "Double Play Black Jack", PDS Gaming, undated, 2pp.
Bjornson, Harrill, "Casino Expanding As Lummi Indian Band Beats the Economic Odds", The Vancouver Sun, Feb. 7, 1992, Features Section at p. D1, 3pp.
Waldman, Hilary, "Cornering jackpot: impossible feat?; Cornering jackpot almost impossible, official says", The Hartford Courant, Feb. 29, 1992, Section: Connecticut, p. C1, 2pp.
"'I'll take 4,000 tickets please' 'No I'm not from Australia'", Business Wire, Mar. 17, 1993, 2pp.
"Hot Slots & Reel Deals, Atlantic City Insider—Revealing the Casinos Best-Kept Secrets", Oct. 1996, vol. 1, No. 2, 5pp.
Kim, Jae-Ha, Grochowski, John, "Groupie? Girl Fans Not Always After Band. How to Keep from Being Worst Blackjack Player", Chicago Sun-Times, Dec. 6, 1996, WKPWKP; Backbeatgaming Section at p. 521, 3pp.
Grochowski, John, "Double Exposure Gives Game New Look", Chicago Sun-Times, Jun. 22, 1997, SHO; Casinos Section at p. 17, 3pp.
"ZDNet Software Library—Ultimate Blackjack", (http://hotfiles.zdnet.com/cgi-bin/texis/swlib/hotfiles/info.html?), Apr. 29, 1997, 1pg.
"Blackjack at The Grand Taj Casino", (http://www.tajgambling.com/blackjack-21.htm), download date: Feb. 13, 2000, 2pp.
"The Wizard of Odds", (http://www.thewizardofodds.com/game/spanish21.htm), Copyright 2000, 2pp.
"Roulette is an easy to play, no-skill game for novice gamblers", Chicago Daily Herald, Sep. 8, 2000, Section: Time Out! Riverboat Gambling, p. 15, 2pp.
Grochowski, John, "Casinos aren't offering early surrender option", Chicago Sun-Times, May 4, 2001, Section: Weekend Plan; Gaming, p. 23, 2pp.
Website: "Money Time at Casino Windsor", (http www casinowindsor com/casino/slots/moneytime htm), download date: Jul. 25, 2001, 1pg.
Fine, Adam, "Players Network Gaming Guide Article—Big River", (http www playersnetwork com/travel/articles/big-river 001,005 html), download date: Jul. 25, 2001, 2pp.
Website: "Blackjacks Online Casino —Paigow Poker", (http //www blackjacksonlinecasino com/paigow html), download date: Sep. 7, 2001, 2pp.
Website: "Hustler How-To for Lowball", (http //www hustlergaming com/lowNoFlash html), download date: Oct. 4, 2001, 3pp.
Website: "Wireplay Poker", (http www wireplay com au/scripts/Games asp?GameID2=56&I=2), Feb. 3, 2001, 4pp.
Website: "Pick'em Video Poker", Video Poker 1, (http //www videopoker1 com), Copyright 2002, 2pp.
Grochowski, John, "Time is the newest name of the game", Chicago Sun-Times, Nov. 30, 2001, Section: Weekend Plus, News, Gaming, 2pp.
Website: "Blackjack—Odds and Strategy—The Wizard of Odds", (http //www thewizardofodds com/game/bj html), Copyright 2001, 8pp.
Malmuth, Mason et al., Website: "Fundamentals of Video Poker Excerpt", Two Plus Two Publishing, (http www twoplustwo com/fvp html), download date: Jul. 23, 2002, 2pp.
Website: "How to Play Video Poker—game rules, gambling tips, and strategies", (http //www casinobeat com/poker shtml), Copyright 1999-2000, 4pp.
"Frequently Asked Questions", Vermont State Lottery Commission, Copyright 2000-2001, 3pp.
Smolen, Don, "CPOKER", (http //conjelco com/software html), download date: Feb. 14, 2003, 1pp.
Website: "Rules of the Game—3.4 Splitting Pairs", (http //www blackjackinfo com/bjrules htm), download date: Feb. 14, 2003, 2pp.
Website: "Rules of the Game—3.1 Surrender", (http //www blackjackinfo com/bjrules htm), download date: Feb. 14, 2003, 1pp.
Grochowski, John, "WMS seems to be strongest slot survivor" Chicago Sun Times, Nov. 23, 2001, 2pp.
Rosenberg, Amy S., "Elvis is in the building, and ready to take your money: New slot machines give players more than a chance to win" Knight Ridder Newspapers, Mar. 21, 1999, 5pp.
Grochowslki, John, "Blackjack rules can be a big deal for players" Chicago Sun-Times, Oct. 8, 2000, 2pp.

* cited by examiner

80

| | TOTAL VALUE OF PLAYER'S HAND 82 | BUST INSURANCE PAYOUT (BASED ON A $10 BUST INSURANCE BET) 84 | MAXIMUM ALLOWABLE BUST INSURANCE BET (BASED ON A $10 INITIAL BET) 85 |
|---|---|---|---|
| 86A | 11 OR LESS | NOT ELIGIBLE | N/A |
| 86B | 12 | $30 | $10 |
| 86C | 13 | $25 ($30 WITH TOKEN) | $10 |
| 86D | 14 | $20 | $20 |
| 86E | 15 | $15 | UNLIMITED |
| 86F | 16 | $15 | $10 |
| 86G | 17 | NOT ELIGIBLE | N/A |
| 86H | 18 | NOT ELIGIBLE | N/A |
| 86I | 19 | NOT ELIGIBLE | N/A |
| 86J | 20 | NOT ELIGIBLE | N/A |
| 86K | 21 | NOT ELIGIBLE | N/A |

FIG. 3

120

| POSITION IDENTIFIER 130 | TABLE IDENTIFIER 132 | PLAYING HISTORY (HAND VALUE (WON/LOSS)) 134 | PLAYER IDENTIFIER 136 | WIN/LOSS PAYOUT HISTORY 138 | DEALER UPCARD 140 | PLAYER HAND TOTAL 142 |
|---|---|---|---|---|---|---|
| POS-01 | TAB-15 | 20(W), 15(L), 16(W), 12(L), 21(W), 13(L), 17(L), 20(W), 19(W), 19(L) | P-1222333 | LOSES $30 PER HALF HOUR | ACE | 15 |
| POS-05 | TAB-3 | 17(L), BUST, 16(L), BUST, BUST, 15(L), 20(L), 18(L), BUST, 18(L) | P-2777898 | LOST $200 | 7 | 18 |

144A

144B

FIG. 7

122

| | ELIGIBILITY IDENTIFIER 146 | ELIGIBILITY DESCRIPTION 147 |
|---|---|---|
| 148A | E-1012-1 | PLAYER LOST 10 HANDS IN A ROW |
| 148B | E-1234-2 | PLAYER LOSES $15/HOUR |
| 148C | E-1505-3 | PLAYER IS A FIRST TIME BLACKJACK PLAYER |
| 148D | E-2001-4 | PLAYER MAY USE BUST INSURANCE 2/HOUR |
| 148E | E-3553-5 | PLAYER LOST WITH A 20 IN BLACKJACK |
| 148F | E-4112-6 | DEALER SHOWS ACE, PLAYER HAND TOTAL OF 15 |
| 148G | E-4343-7 | DEALER SHOWS 7, PLAYER HAND TOTAL OF 18 |
| 148H | E-5005-8 | DEALER SHOWS FACE CARD, PLAYER HAND TOTAL OF 12 |
| 148I | E-5010-9 | DEALER SHOWS 9, PLAYER HAND TOTAL OF 16 |
| 148J | E-6530-10 | DEALER SHOWS 4 |

FIG. 8

METHOD AND APPARATUS FOR FACILITATING GAME PLAY WITH A MORTGAGING OPTION

The present application is a continuation-in-part of U.S. patent application Ser. No. 10/341,450, entitled "System and Method for Playing a Game Including a Mortgage Option", filed on Jan. 10, 2003, now U.S. Pat. No. 7,111,845; which is a continuation-in-part of U.S. patent application Ser. No. 09/609,720, entitled "Method and Apparatus for Playing a Card Game Including a Mortgage Option", filed on Jun. 30, 2000, which issued as U.S. Pat. No. 6,523,829 B1 on Feb. 23, 2003; which claims the benefit of priority of provisional U.S. Patent Application No. 60/201,863, entitled "Blackjack Bust Insurance", filed on May 4, 2000. The contents of each of the above-specified applications is incorporated herein by reference.

CROSS-REFERENCES TO RELATED APPLICATIONS

The present application is related to the following co-pending and commonly-owned applications:

(i) U.S. patent application Ser. No. 08/885,345, entitled "A Gaming Device for Operating in a Reverse Payout Mode and a Method of Operating Same", filed on Jun. 30, 1997;

(ii) U.S. patent application Ser. No. 09/109,839, entitled "Video Poker Device and Method of Operation Thereof", filed on Jul. 2, 1998;

(iii) U.S. patent application Ser. No. 09/610,120, entitled "Method and Apparatus for Playing a Card Game Including a Bust Insurance Option", filed on Jun. 30, 2000;

(iv) U.S. patent application Ser. No. 10/205,305, entitled "Method and Apparatus for Offering a Guaranteed Win", filed on Jul. 24, 2002; and (v) U.S. patent application Ser. No. 10/298,621, entitled "Method and Apparatus for Facilitating Play of a Gaming Device", filed on Nov. 15, 2002.

The contents of each of these related applications is incorporated herein by reference.

FIELD OF THE INVENTION

The invention generally relates to methods, apparatus and program products for playing games.

BACKGROUND OF THE INVENTION

Game playing may be based on skill and/or based on chance. In some games based at least in part on chance, a player may place a wager on one or more rounds of play and may receive a payout based on an outcome of a round and/or the wager. Games may be played through various devices, or may be conducted without a device. Examples of devices for games include, without limitation, personal computers, video poker machines, pachinko machines, video blackjack machines, video keno machines, video lottery machines, video bingo machines, and reeled slot machines (e.g., mechanical and/or video reeled slot machines).

Blackjack, which is also known as Twenty-one, is a popular card game often played in physical casinos, online or "virtual" casinos, and other gaming venues. In Blackjack, a dealer representing the casino or "house" is pitted against one or more players, with the dealer playing separately against each player. While a popular version of Blackjack is described herein, other versions with slightly different rules are also played. In each round of play, each player makes an initial bet before any cards are dealt. The dealer then deals a starting hand consisting of two cards to each player and to himself. The two cards dealt to each player are typically turned face up, but only one of the two cards dealt to the dealer is turned face up (i.e., the "dealer upcard"). Each numbered card (i.e., each card numbered "2"-"10") has a value equal to the card number, each face card (i.e., each jack, queen and king) has a value of ten, and each ace has a value of one or eleven, depending on which value is more beneficial to the player. The suit of each card does not affect its value. The value of the starting hand for each player, and for the dealer, is determined by totaling the value of the two cards. For example, a starting hand consisting of a five of spades ("5♠") and a ten of clubs ("T♣") has a total value of 15.

Note that, in the remainder of the present specification, each card is referred to by a two-digit code, with the first digit representing the card's rank (i.e., 2-9, T for "ten", J for "jack", Q for "queen", K for "king", and A for "ace"), and the second digit representing the card's suit (i.e., ♠for "club", ♦ for "diamond", ♥ for "heart", and ♣for "spade"). As noted above with respect to most variations of Blackjack, however, the suit of each card does not affect its value (although the suit may affect a card's value in other types of games).

The party (i.e., each player or the dealer) that accumulates cards with the highest numerical total, without exceeding 21, wins the round of play. To increase the total value of his starting hand, each player is allowed to take as many additional cards or "hits" as desired until that player chooses to "stand" with a final hand having a total value of less than or equal to 21, or until that player "busts" with a final hand having a total value exceeding 21. If the player busts, he loses his initial bet. If not, once each of the remaining players has finished his turn, the dealer turns over the card that he dealt face down to himself. If the dealer's hand has a total value of 17 or greater, he is typically required to stand. However, if the dealers hand has a total value of less than 17, he is typically required to draw one or more additional cards until he obtains a hand with a total value of 17 or greater, at which point he must stand. Thus, the dealer has no discretion about taking cards. If the dealer's final hand is greater than 21, each player who did not bust wins. If the dealer's final hand has a total value of between 17 and 21, inclusively, any player who did not bust and has a final hand having a total value greater than the total value of the dealer's final hand wins, while any player who did not bust but has a final hand having a total value less than the total value of the dealer's final hand loses. Each winning player is typically paid based upon his initial bet using a 1:1 ratio (e.g., so that a $10 bet results in a $20 payout), while each losing player loses his initial bet. (In this application, the amount of a "payout" includes the return of the underlying bet plus any net winnings.) If a player's final hand has the same total value as the dealer's final hand, the result of the round of play is declared to be a "push", and the player's initial bet is returned to him.

Blackjack is typically played in accordance with a number of other conventional rules. For example, if a player's starting hand consists of an ace and a second card having a value of ten (e.g., a ten or a face card), for a total value of 21, the player is deemed to have a winning hand referred to as a "Blackjack". A player who has a Blackjack is typically paid based upon his initial bet using a 1.5:1 ratio (e.g., such that a $10 bet results in a $25 payout), unless the dealer was also dealt a Blackjack, in which case the round of play may be declared to be a push. A Blackjack is different, and has a different payout, than a final hand having more than two cards and which has a total value of 21. A Blackjack will beat such a final hand having a total value of 21.

The card game of Blackjack also includes a number of other conventional rules that provide a player with additional options for playing the game. For example, Blackjack includes rules for conventional "insurance" (hereinafter referred to as "Blackjack insurance" or "21 insurance"), "surrender", "doubling down", and "splitting pairs". Each of these rules is now described in the following paragraphs.

"Blackjack insurance" provides each player with the option of making a side bet if that player believes, based upon the dealer upcard, that the dealer may have a Blackjack. Blackjack insurance is a side bet since it is distinct from the player's initial bet. A player is allowed to make a Blackjack insurance side bet only if the dealer upcard is an ace. A player is typically allowed to wager, for this side bet, up to one-half of his initial bet. A player wins this side bet if the card that was initially dealt face down to the dealer completes a Blackjack for the dealer, and otherwise loses this side bet. A player who wins this side bet will typically be paid based upon his side bet using a 2:1 ratio (e.g., such that a $5 side bet results in a $15 payout), while a player who loses will lose his side bet. Since a player who wins this side bet is likely to have lost the initial bet (since the dealer's hand turned out to be a Blackjack), the player's winnings on this side bet will typically cancel out the player's loss on his initial bet, hence the name "Blackjack insurance" for this side bet. Thus, with Blackjack insurance, each player is allowed to place a side bet that will win if the dealer's hand turns out to be a Blackjack.

"Surrender" provides each player with the option of terminating a round of play after the starting hands have been dealt, for use in situations where that player has been dealt a "bad" starting hand that is likely to bust (if an additional card is drawn) or to lose to the dealer's hand (if an additional card is not drawn). If, for example, a player's starting hand consists of a 5♠ and a 10♣ and the dealer's upcard is a J♦, only an additional card of 6 or below will not "bust" the player, while "standing" with only 15 points is likely to lose to the dealer. In this situation, the player is likely to bust or lose. Surrender is typically practiced by the player taking back one-half of his initial bet and "surrendering" the other one-half of his initial bet to the dealer while terminating the round of play. For example, if a player who made a $10 initial bet surrenders, he takes back $5 of his initial bet, surrenders the other $5 to the dealer, and terminates the round of play. The surrender option has not proven to be popular among Blackjack players.

"Doubling down" provides each player with the option of doubling his initial bet while agreeing to take one and only one additional card, for use in situations where the player believes that one and only one additional card is likely to improve his starting hand to a winning hand without "busting". If the player "busts" with the one additional card, or does not "bust" but still loses to the dealer, the player loses both his initial bet and doubling down bet. However, if the player's three-card hand beats the dealer, the player wins an amount based upon the total of his initial bet and doubling down bet using a 1:1 ratio (e.g., such that a $10 initial bet and a $10 double down bet results in a $40 payout). Thus, with "doubling down", a player is allowed to increase the size of his bet in situations where the player believes that his hand is likely to win.

"Splitting pairs" provides each player who is dealt a starting hand consisting of two cards of the same rank (e.g., a pair of aces) with the option of "splitting" the two cards into separate hands. If the player elects to split his starting hand, he must apply his initial bet to one of the hands while placing a second bet of the same amount to the other hand. The player then plays each of the hands normally, except that an ace and a card having a 10 value comprise a 21 instead of a "Blackjack".

When playing Blackjack, a player is likely to be dealt one or more "bad" starting hands, each of which is likely to bust (if an additional card is drawn) or to lose to the dealer's hand (if an additional card is not drawn). An exemplary "bad" starting hand consists of a 5♠ and a 10♣ against a dealer upcard of an A♦. Under the conventional rules of Blackjack, a player who is dealt such a "bad" starting hand has limited options. If the player takes an additional card, he is likely to bust. If the player stands, he is likely to lose to the dealer's hand. If the player makes a Blackjack insurance side bet, he is likely to lose since the dealer's face-down card is unlikely to have a value of ten. In other situations, as where the dealer's upcard is a 9♥, the Blackjack insurance side bet option is not even available to the player since the dealer cannot have a Blackjack. The "doubling down" option is unattractive since the player does not have a good starting hand that is likely to win. The "splitting pairs" option is unavailable since the player was not dealt a pair. Although the "surrender" option may be available, this option has proven to be unpopular among Blackjack players. Thus, under the conventional rules of Blackjack, the player is left in a position of not wanting to play his starting hand despite having already committed an initial bet on that hand. If the player has already lost a number of hands and believes that he is undergoing an "unlucky" streak, he may become frustrated or discouraged, and may stop playing and/or leave the gaming venue (e.g., by leaving the casino, or logging off the online gaming site). When a player stops playing, the casino or the gaming site will earn no additional revenue from the player.

Thus, it would be desirable to provide at least one additional option to a Blackjack player who is dealt an unfavorable starting hand. It would also be desirable to provide a Blackjack player who made an initial bet and is dealt an unfavorable starting hand with at least one additional option. Preferably, the additional option will help prevent the player from being discouraged from playing further, and could be profitably provided by a physical, on-line or "virtual" casino, or other gaming operator.

Besides various versions of Blackjack, many other types of games of chance and/or skill will be known to those having ordinary skill in the art. Such games may include, without limitation, casino games, slot machine games, card games (e.g., poker), sports games, video games, and board games.

BRIEF DESCRIPTION OF THE DRAWINGS

The present invention will become more fully understood from the following detailed description, taken in conjunction with the accompanying drawings, wherein like reference numerals refer to like parts, in which:

FIG. 3 is an exemplary bust insurance payout table for determining the payout on a bust insurance bet, populated with sample values for illustration only;

FIG. 7 is a table representing an exemplary embodiment of the position database shown in FIG. 6 for storing information about each of the player positions in FIG. 5, including specific information for the player at each of those player positions, in which the position database is populated by sample values for illustration only;

FIG. 8 is a table representing an exemplary embodiment of the eligibility database shown in FIG. 6 for storing eligibility requirements for the bust insurance bet option, wherein this database is populated by sample values for illustration only;

DETAILED DESCRIPTION

Figure 1A:
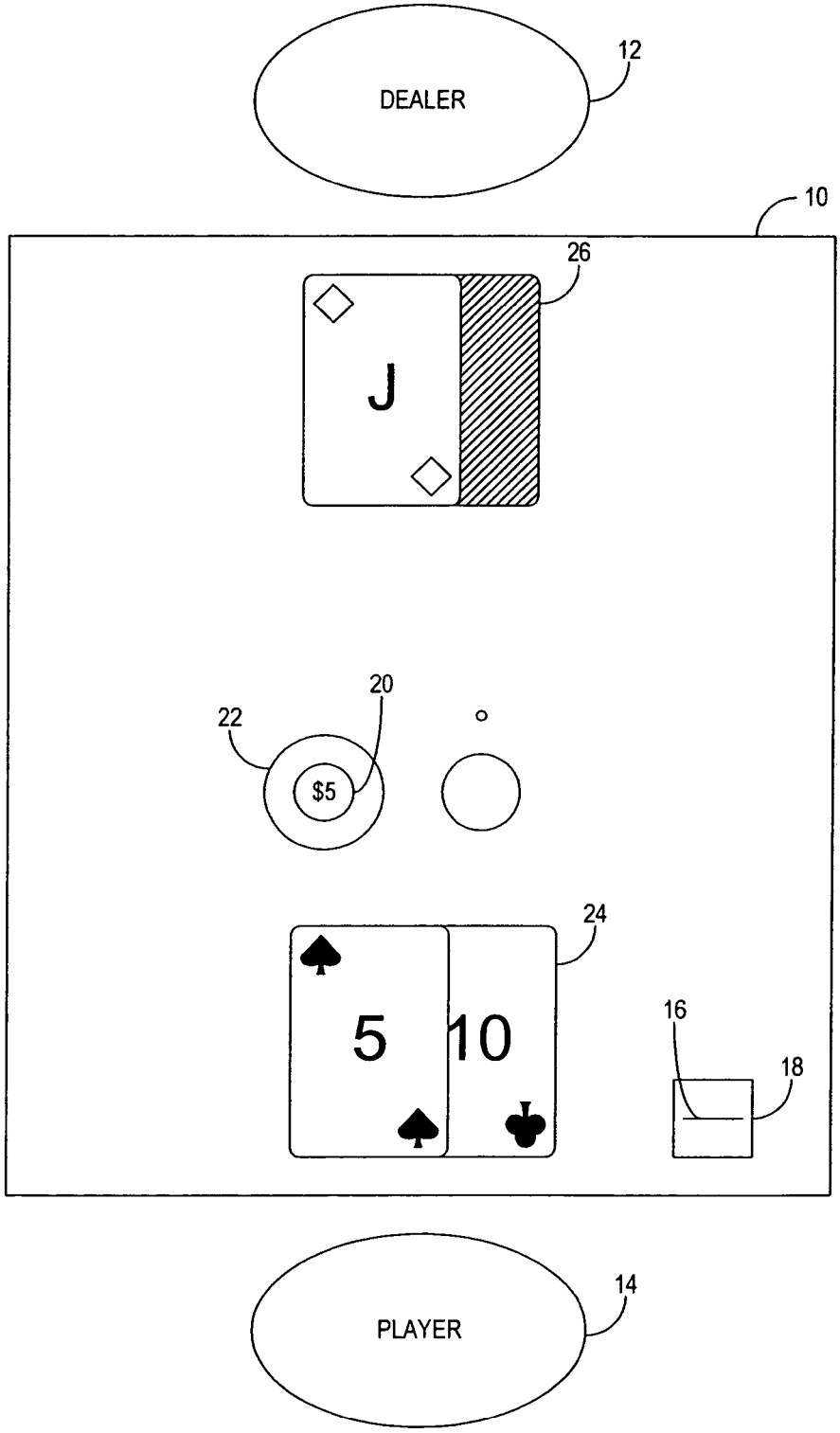
FIGS. 1A-1D illustrate an exemplary round of play of Blackjack, in accordance with a bust insurance embodiment of the invention, in which a player who has made an initial bet is dealt an unfavorable starting hand (FIG. 1A), makes a bust insurance bet (FIG. 1B), is then dealt an additional card causing his final hand to "bust" (FIG. 1C), and loses on the initial bet but wins on the bust insurance bet (FIG. 1D)

Applicants have recognized that many different types of players would find it appealing to be offered at least one option for mortgaging a round of play of a game of chance and/or skill. For example, some players would find it appealing to be able to agree to play at least one future round of play and/or the current round of play in accordance with at least one disadvantage to the player (e.g., penalty; revised rule that is unfavorable to the player), in exchange for being able to play in accordance with at least one advantage (e.g., benefit; revised rule that is favorable to the player) during the current round of play. In another example, some players would find it appealing to be able to play in accordance with at least one advantage during at least one future round of play and/or the current round of play, in exchange for agreeing to play the current round of play in accordance with at least one disadvantage to the player.

Some of the disclosed methods and systems of playing a game of chance (e.g., poker; Blackjack; slot machine game) provide a player who made an initial bet and received an unfavorable result or set of game indicia (e.g., a hand of one or more cards; a set of one or more reel symbols) with at least one additional option for mortgaging a current round of play and/or at least one future round of play.

With respect to playing a card game, such as, without limitation, Blackjack or poker, some of the disclosed methods and systems provide a player who made an initial bet and is dealt an unfavorable starting hand with at least one additional option beyond those provided under the conventional rules of the card game. The additional option(s) include making a bust insurance bet and/or mortgaging either a current round of play or at least one future round of play.

The disclosed methods and systems provide benefits for both players and gaming operators. The additional options may be more exciting and entertaining for players who make an initial bet and receive an unfavorable result or set of game indicia (e.g., are dealt an unfavorable starting hand) than the conventional options available to such players, and may help such players avoid becoming frustrated or discouraged. The additional options also benefit players by providing the opportunity to place one or more additional bets during a single round of play, and consequently providing one or more additional opportunities to win during each round of play, thus providing the players with additional "action". The additional options may also benefit players who perceive that they are undergoing an "unlucky" streak by providing such players with the opportunity to win on final hands that would otherwise be considered "unlucky" final hands (e.g., another "bust" in Blackjack).

By providing a more exciting and entertaining experience for players, and by helping to prevent players from getting frustrated or discouraged, the additional options can benefit casinos or other gaming operators by helping to attract players, and/or by helping to retain players who are already playing. By increasing the number of players, casinos and other gaming operators can generate additional revenues and profits. The additional options also provide casinos and gaming operators with the possibility of receiving additional bets during a single round of play, or of "capturing" players for future rounds of play by entering into agreements with those players to play at least one additional round of play. The additional options can also be selectively offered by a dealer, casino or other gaming operator to particular players, such as first-time players, "high-rollers" (e.g., players who tend to bet relatively large sums of money), players likely to be frustrated or discouraged based upon their past playing history, players who tend to play games which provide the house with a relatively large edge, etc., in order to entice such players to play at the casino, or to retain such players.

While the additional options for playing a game will typically be provided such that the casino or other gaming operator enjoys a statistical edge over the player, there may be limited situations where a gaming operator may allow the player to have the benefit of the statistical edge. By reversing the statistical edge, the gaming operator can use the additional options as a marketing tool to attract players, or as a retention tool to retain players. A player having such a statistical edge will typically be allowed to retain that edge for only a limited number of rounds of play such that providing the additional options remains financially feasible for the gaming operator.

One or more embodiments of the present invention provide for a method and system of playing a game of chance, such as a slot machine game or a card game (e.g., a poker game; a Blackjack game), wherein a player who made an initial bet and received a result, such as a set of one or more game indicia, is provided with at least one option for mortgaging a round of play.

One or more embodiments of the present invention provide for a method and system of playing a card game such as Blackjack or poker, wherein a player who made an initial bet and was dealt an unfavorable starting hand has at least one additional option for continued play going beyond the options provided by the conventional rules of the game. One additional option allows a player to place a bust insurance side bet, which the player will win if his hand "busts" upon drawing a predetermined number of additional cards in an attempt to improve his starting hand. Another additional option allows a player to mortgage a round of play. The mortgage includes an agreement to play at least one future round of play and/or the current round of play in accordance with at least one revised rule which is unfavorable to the player in exchange for receiving an advantage (e.g., a revised rule which is favorable to the player) during the current round of play.

One embodiment of the invention provides a method of playing a card game. This method includes dealing at least one card to a player to form a starting hand, receiving a request from the player to take an additional card, dealing the additional card to the player to form a current hand in response to the request, and determining a total value of the current hand. If the total value exceeds a predetermined value, the method further includes providing a benefit (e.g., a payout) to the player.

Some embodiments of the present invention provide a method of playing a card game that includes receiving an initial bet from a player, dealing first and second cards to the player to form a starting hand, receiving a bust insurance bet from the player after dealing the starting hand, receiving a request from the player to take an additional card, dealing the additional card to the player to form a current hand in response to the request, and determining a total value of the current hand. If the total value does not exceed a predetermined value, the method also includes determining a payout to the player on the initial bet based upon a comparison between the player's current hand and a dealer's final hand. If the total value exceeds the predetermined value, however, the method further includes providing a payout to the player on the bust insurance bet.

One or more embodiments of the present invention provide a method of playing a card game having a plurality of rules. The method includes receiving an initial bet from a player for a current round of play, dealing at least one card to the player to form a starting hand and, after dealing the starting hand but before determining an outcome of the current round of play, entering into an agreement with the player to bet (e.g., at least a portion of the initial bet) on at least one future round of play to be played in accordance with a revised rule. The agreement may further include terminating the current round of play.

Some embodiments of the present invention provide a method of playing a card game having a plurality of rules that includes receiving an initial bet from a player for a current round of play, dealing at least one card to the player to form a starting hand and, after dealing the starting hand but before determining an outcome of the current round of play, entering into an agreement with the player to revise at least a first rule of the card game in a manner which is favorable for the player in exchange for revising at least a second rule of the card game in a manner which is unfavorable for the player.

In various embodiments, an apparatus for playing a card game includes means for dealing at least one card to a player to form a starting hand, means for receiving a request from the player to take an additional card, means for dealing the additional card to the player to form a current hand in response to the request, means for determining a total value of the current hand, and means for providing a benefit (e.g., a payout) to the player if the total value exceeds a predetermined value.

In one or more embodiments, an apparatus for playing a card game includes means for receiving an initial bet from a player, means for dealing first and second cards to the player to form a starting hand, means for receiving a bust insurance bet from the player after dealing the starting hand, means for receiving a request from the player to take an additional card, means for dealing the additional card to the player to form a current hand in response to the request, and means for determining a total value of the current hand. The apparatus also includes means for determining a payout to the player on the initial bet based upon a comparison between the player's current hand and a dealer's final hand if the total value does not exceed a predetermined value, and means for providing a payout to the player on the bust insurance bet if the total value exceeds the predetermined value.

In some embodiments, an apparatus for playing a card game having a plurality of rules includes means for receiving an initial bet from a player for a current round of play, means for dealing at least one card to the player to form a starting hand, and means for entering into an agreement with the player to bet (e.g., at least a portion of the initial bet) on at least one future round of play to be played according to a revised rule after dealing the starting hand but before determining an outcome of the current round of play. The agreement may include terminating the current round of play.

In one or more embodiments, an apparatus for playing a card game having a plurality of rules includes means for receiving an initial bet from a player for a current round of play, means for dealing at least one card to the player to form a starting hand, and means for entering into an agreement with the player to revise at least a first rule of the card game in a manner which is favorable for the player in exchange for revising at least a second rule of the card game in a manner unfavorable for the player after dealing the starting hand but before determining an outcome of the current round of play.

As used herein, a "card" is one of the playing cards in a deck of cards. A "physical card" is used for a card game played at a physical gaming table, while a "virtual card" is displayed by a card game played online or on a video gaming machine. An "additional card" refers to each card that may be added to a starting or current hand.

A "starting hand" consists of physical or virtual cards initially dealt by a dealer (e.g., a virtual dealer; a video poker machine) at the start of a round of play of a card game. In Blackjack, for example, the starting hand of each player and the dealer typically consists of two cards. A "player starting hand" thus refers to the two cards dealt to a player (typically both dealt face-up, or both dealt face down), and a "dealer starting hand" refers to the two cards dealt to the dealer (typically with one card dealt face-up and the other card dealt face-down). The card that is dealt face-up to the dealer in Blackjack is the "dealer upcard". In Blackjack, a card dealt "face-up" is exposed to each player and to the dealer participating in a round of play. In some popular versions of video poker, the starting hand of each player typically consists of five cards, and there is no dealer hand. Other types of hands related to various card games and other games will be known to those of ordinary skill in the art.

A "current hand" consists of all of the cards currently held by a player (or the dealer, if the dealer has a hand). In Blackjack, a player who exercises the "splitting pairs" option may have two or more current hands. At the start of a round of play, the current hand of a player or dealer is the same as the player or dealer's starting hand. In some card games, however, the current hand of a player or dealer will also include each additional card dealt to the player or dealer. In a poker example, a current hand may include cards used to replace discarded cards. A "final hand" consists of all of the cards held by a player or dealer that make up the current hand of that player or dealer at the end of a round of play. A "future hand" consists of the cards that make up a hand held by a player or dealer during a future round of play.

In many variations of Blackjack, the "value" of a card depends on the card's rank, with each numbered card (i.e., each card numbered 2-10) having a value equal to the card number, each face card (i.e., each jack, queen and king) having a value of ten, and each ace having a value of one or eleven, depending on which value is more beneficial to the player. The suit of each card does not affect its value. The "total value" of a hand refers to the sum or total of the values of each of the cards that is held within that hand. A player or dealer typically "busts" in Blackjack when that player's or dealer's hand has a total value of greater than 21.

An "initial bet" is an amount of money wagered by a player before the player receives a starting hand, or before a player has had an opportunity to review a starting hand already received. A "side bet" is another amount of money that may be wagered by a player in addition to, or instead of, the initial bet. The payout that a player may receive on a side bet is determined according to a different set of rules than the set of rules that determines the payout that may be received on an initial bet.

A "rule" is a regulation that governs a particular aspect of a game (e.g., a card game). A "conventional rule" is a rule by which the game is conventionally played. A "revised rule" is a change in the conventional rules by which the game is played, that both a player and another party (e.g., the dealer) have agreed to for the duration of at least one round of play. Note that different players may thus be playing the game in accordance with different sets of rules. "Rule" is thus defined broadly to include regulations that govern (1) the manner in which the game is played, (2) the winner or loser of the game, (3) the payout that is due to a player based upon a particular outcome of the game; (4) the range or amount of a bet that a player is allowed to make; etc.

A "mortgage", for the purpose of this application, is a disadvantage or penalty, such as a revised rule that is unfavorable for a player, that the player may agree to abide by during the current round of play and/or during at least one future round of play. The revised rule is a rule that is revised in comparison to the conventional rules of the game (or to default rules by which the game will be played in the absence of the player taking out the mortgage).

A bet made by a player, or a payout won by a player, is "imprisoned" by requiring the player to wager all or a portion of that bet or payout on one or more future rounds of play. "Imprisoning" thus differs from "mortgaging" since, if a bet or payout is "imprisoned", a player need not agree to abide by a revised rule unfavorable to the player during the future round(s) of play (although the player may agree to such a rule).

1. Bust Insurance Embodiments

Referring to FIGS. 1A-1D, an exemplary round of play of Blackjack in accordance with a bust insurance embodiment of the invention is illustrated. It is to be understood that this exemplary round of play represents one use of the bust insurance option, and that this option may be used with other specific hands of cards. It is also to be understood that, while the description below assumes that this round of play occurs using a physical Blackjack table in a physical casino, this round of play may also occur using a virtual Blackjack table in a virtual or online casino, or virtual gaming machine.

Referring to FIG. 1A, the exemplary round of play is being played on a Blackjack table 10 by a dealer 12 and a player 14. Although only one player is shown, any number of other players may also be present. Each player may identify himself, if desired, by inserting a player tracking card 16 into a slot of a card interface 18 mounted to table 10. Alternatively, table 10 does not provide a card interface 18, and player tracking card 16 is not used. In one embodiment, there may be a central card interface 18 for a casino pit area with floor personnel inserting player tracking card 16. Before any cards were dealt, player 14 made an initial bet or ante 20 by placing one or more coins or tokens (e.g., a $5 token) on a first betting area 22 of table 10. Dealer 12 then dealt a starting hand consisting of two cards to both player 14 and himself. In particular, dealer 12 dealt a player starting hand 24, consisting in this example of a face-up T♣ and a 5♠ for a total value of 15, to player 14, and a dealer starting hand 26, consisting in this example of a face-up J♦ and a face-down card, to himself. Player 14 has thus been dealt an unfavorable or "bad" starting hand that is likely to bust if an additional card is drawn (since only an additional card of 6 or less will not bust the player), and is likely to lose to the dealer if an additional card is not drawn (since the dealer will win if the dealer's face-down card is 7 or higher, or if the total of the dealer's face-down card plus any additional cards is between 7 and 11).

Figure 1B:
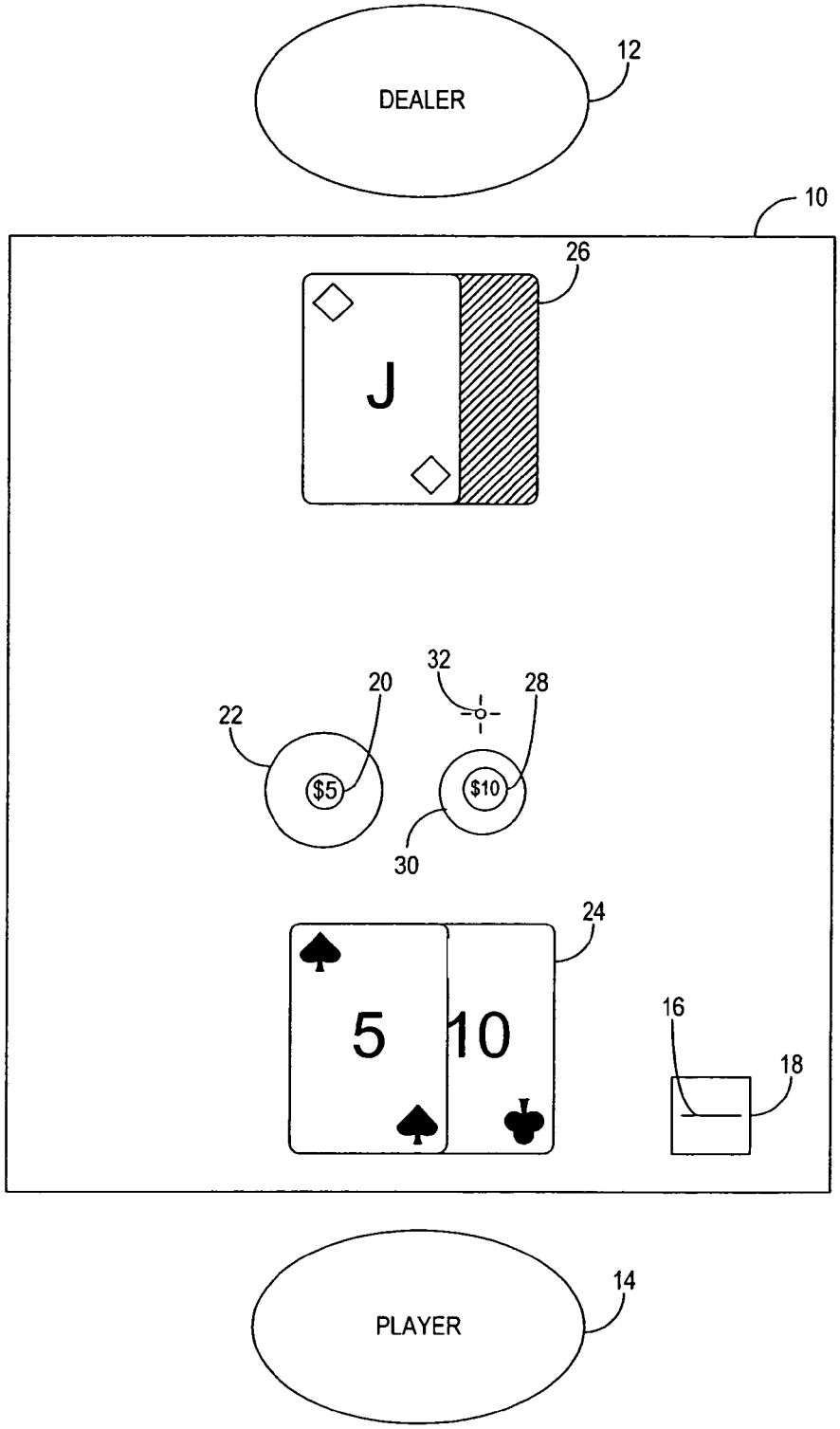

Referring to FIG. 1B, in response to being dealt an unfavorable starting hand and before either "hitting" or "standing" (and assuming that player 14 was eligible to make a bust insurance side bet), player 14 made a bust insurance bet 28 by placing one or more coins or tokens (e.g., a $10 token) on a second betting area 30 of table 10. The amount of bust insurance bet 28 that player 14 is allowed to wager may or may not depend on the amount of initial bet 20, or on other factors such as the starting hands. At this point, player 14 has two distinct bets outstanding: initial bet 20 and bust insurance bet 28. Player 14 thus has two distinct possibilities of winning (and losing) on the current round of play. First, player 14 can win on initial bet 20 based upon the underlying game of Blackjack, which will be played according to the conventional rules of the game. Second, player 14 can win on bust insurance bet 28 in the event that his hand busts (e.g., has a total value of greater than 21) after drawing an additional card. Bust insurance bet 28 is thus a side bet in addition to initial bet 20. After making bust insurance bet 28, player 14 then requests or "takes" an additional card from dealer 12.

In one embodiment, table 10 also provides a bust insurance eligibility indicator 32 for indicating whether player 14 is eligible to make a bust insurance bet. For example, eligibility indicator 32 may include a light bulb or LED which is lit (as in FIG. 1B) whenever player 14 is eligible to make a bust insurance bet, and is otherwise dimmed. If player 14 attempts to make a bust insurance bet when he is not eligible to do so, dealer 12 may reject the bet. Eligibility indicator 32 may be controlled by dealer 12 or by a table control system (as is described below). The criteria for determining whether player 14 is eligible to make a bust insurance bet may depend on the player's starting and/or current hand. For example, dealer 12 may cause indicator 32 to be lit after determining that player starting hand 24 had a total value making it eligible for bust insurance. The criteria for determining whether player 14 is eligible to make a bust insurance bet may also depend on data read from player tracking card 16 and/or downloaded from a casino computer (e.g., a casino server) via a communications network based upon the identity of player 14 as determined by player tracking card 16. In other embodiments, player 14 could identify himself by keying in a Personal Identification Number (PIN) using a keypad at table 10 or by telling dealer 12. In other embodiments, bust insurance eligibility indicator 32 is not present and/or is not used.

Figure 1C:
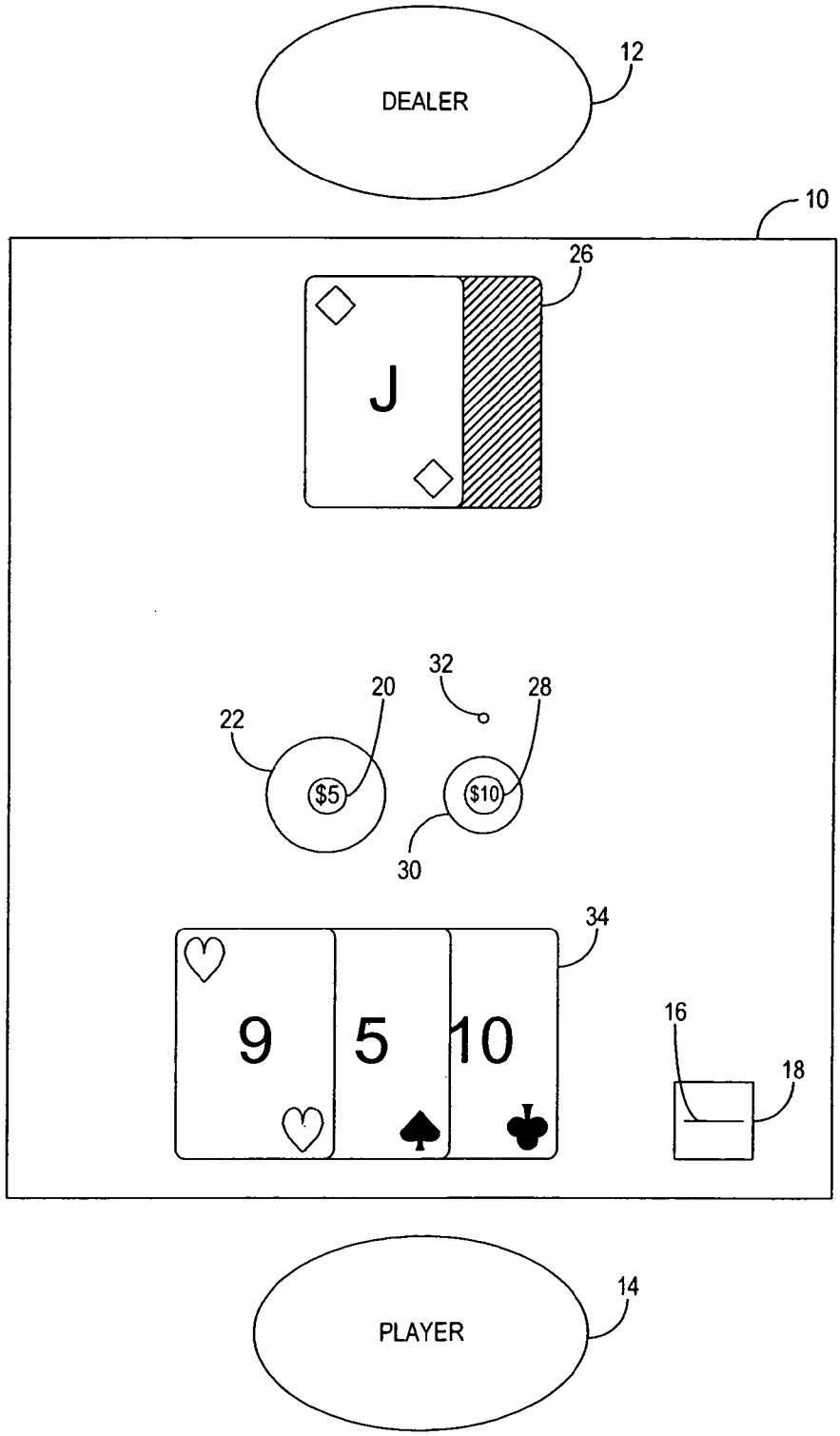

Referring to FIG. 1C, player 14 has drawn an additional card (e.g., a 9♥) from dealer 12 to form a player final hand 34 consisting of a T♣, a 5♠ and 9♥. Since the total value of player final hand 34 is 24 (which is greater than 21), player 14 has "busted". Thus, player 14 has lost on initial bet 20 since player 14 busted, but has won on bust insurance bet 28 for the same reason. Dealer starting hand 26 is still unknown since the dealer has not yet turned up his down-card. Bust insurance eligibility indicator 32 (if provided) is dimmed since, by busting, player 14 is no longer eligible to make a bust insurance bet. At this point, any remaining player takes his or her turn.

Figure 1D:
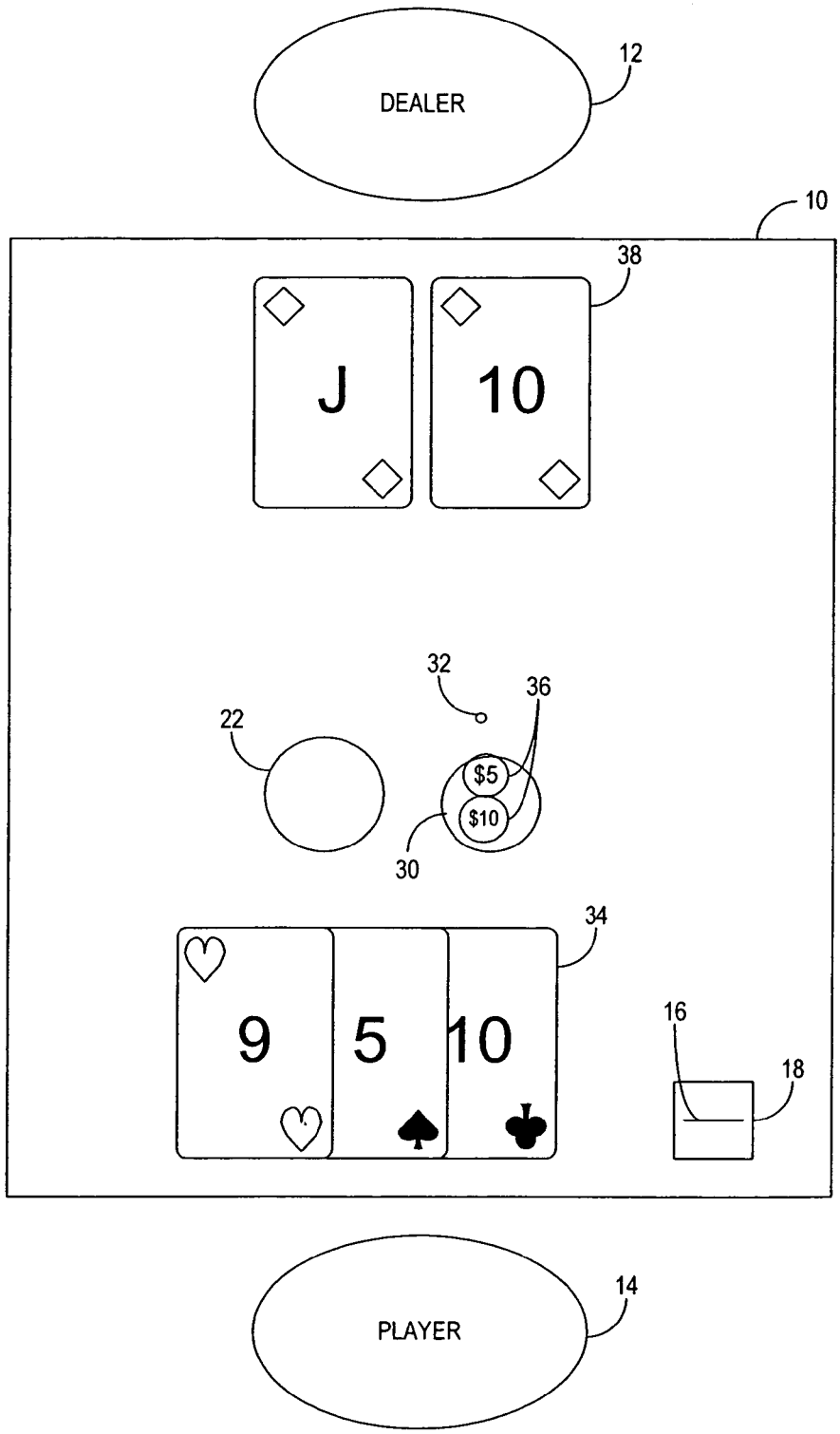

Referring to FIG. 1D, after player 14 busted, initial bet 20 was taken away by dealer 12 since player 14 lost the underlying round of play. However, since player 14 won on bust insurance bet 28, dealer 12 provided player 14 with a payout 36. In this case, player 14 was paid based on his bust insurance bet using a 0.5:1 ratio (e.g., so that the $10 bust insurance bet resulted in a $15 payout). In other cases, as described below, player 14 may be provided with other payouts. Dealer 12 has also exposed his face-down card (e.g., a T♦), giving the dealer a final hand 38 having a total value of 20. Thus, by placing bust insurance bet 28, player 14 was able to "win" on the exemplary round of play, despite having busted. In this example, player 14's net winnings on bust insurance bet 28 cancel out player 14's loss on initial bet 20 (e.g., player 14 lost $5 on initial bet 20, but netted $5 on bust insurance bet 28), hence the name "bust insurance". Note, however, that a player's winnings on a bust insurance bet may or may not cancel out the player's loss on an initial bet, and the player may come out ahead or behind, depending on the relative amounts of the two bets and the payout. The result of the current round of play may be stored on player tracking card 16, or may be uploaded for storage on a casino computer (e.g., a casino server) for later use (as described below).

Figure 2A:
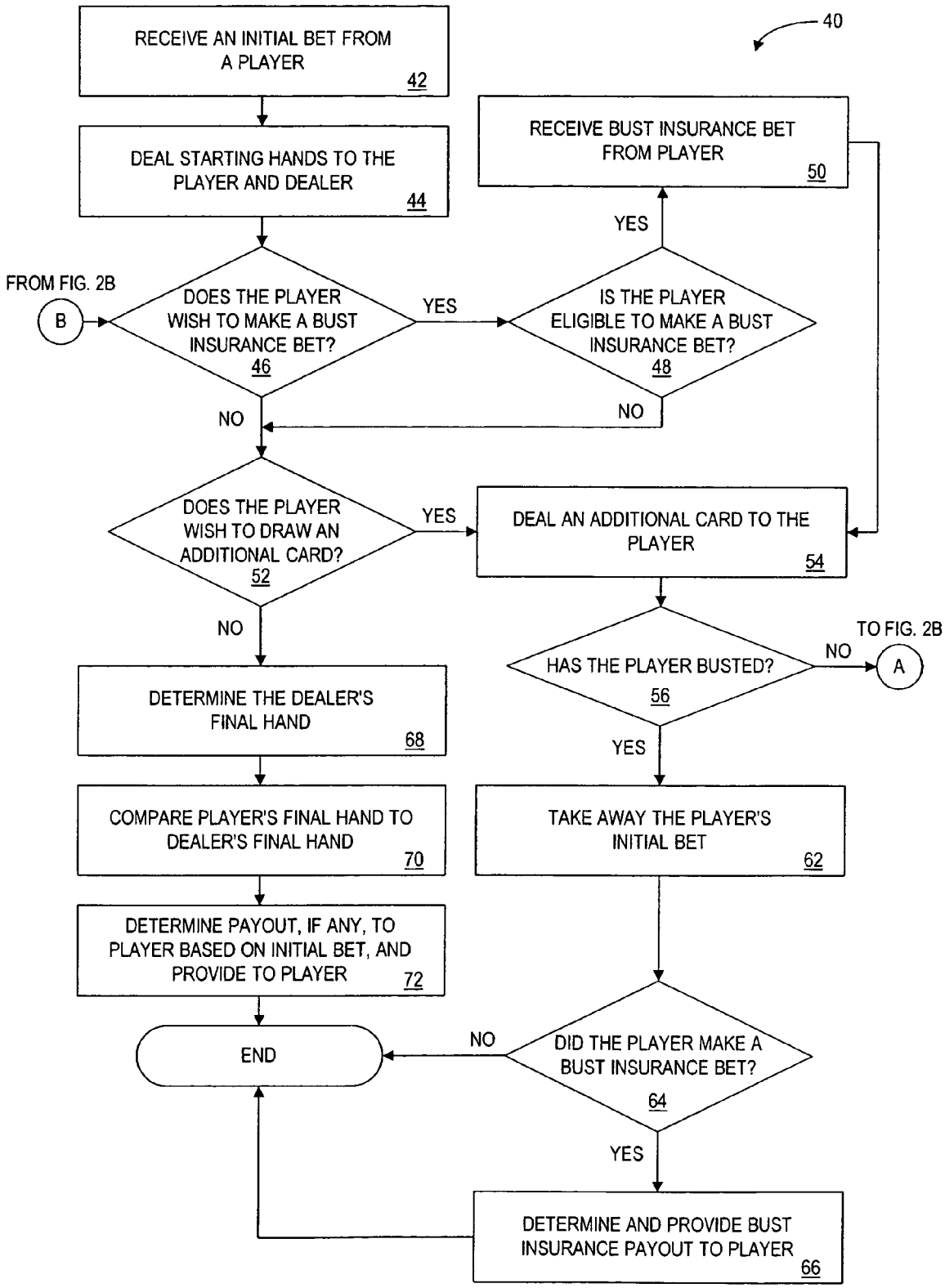
FIGS. 2A-2B show a flow chart of an embodiment of a method of playing a card game that provides a player who has made an initial bet and was then dealt an unfavorable starting hand with an option for making a bust insurance bet.
Figure 2B:
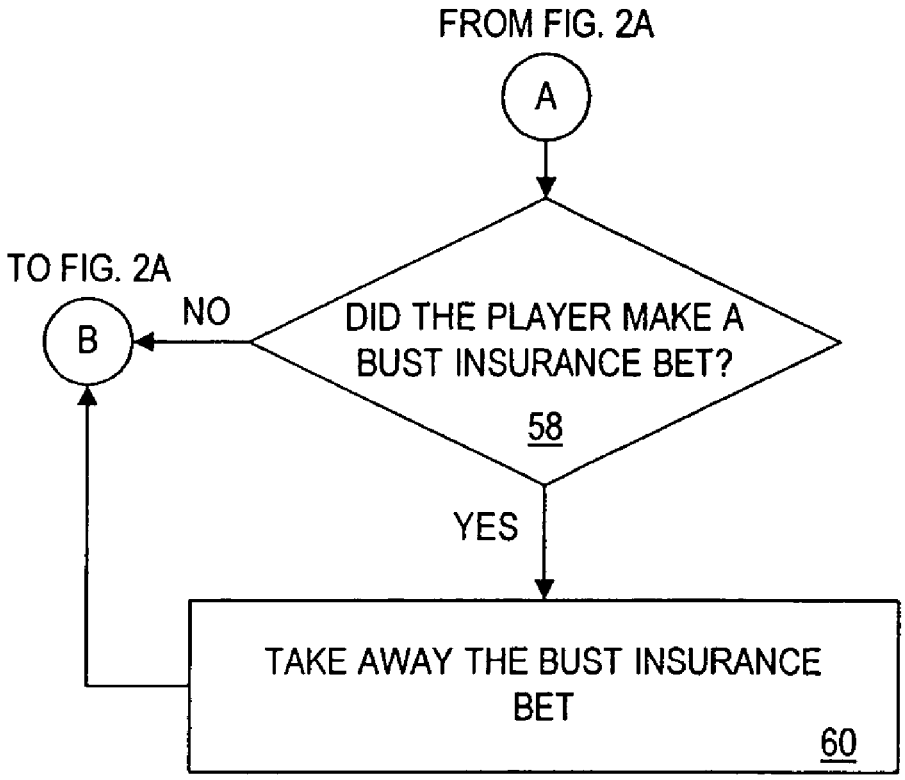

Referring to FIGS. 2A-2B, a method 40 of playing a card game in accordance with a bust insurance embodiment of the invention is shown. Method 40 is repeated for each round of play. While method 40 refers to play by a single player, method 40 may be applied to each of a plurality of players involved in a round of play. If desired (and if the table is equipped to accept player tracking cards), each player may identify himself using his player tracking card 16 before the start of the round of play.

At step 42, method 40 includes receiving an initial bet or ante from a player (and from any other player also playing). For example, the initial bet may be received when a player places one or more coins or tokens (e.g., a $5 token) on first betting area 22 of table 10 (FIG. 1A). At step 44, method 40 includes dealing starting hands to both the player and dealer. For example, the dealer may deal a player starting hand consisting of two face-up cards to the player, and a dealer starting hand consisting of one face-up card and one face-down card to himself. At this point, the player will typically review both cards of the player starting hand and the upcard of the dealer starting hand to determine a strategy for playing the current round of play. The strategy may include, in accordance with the conventional rules of Blackjack, selecting the "Blackjack insurance", "surrender", "doubling down" and/or "splitting pairs" options described in the Background of the Invention section (and not shown in method 40).

Alternatively, instead of receiving an initial bet from the player at step 42 before dealing a starting hand face-up to the player at step 44, the player is dealt his starting hand face-down and is required to place his initial bet at any time before he reviews his starting hand. For example, the player places his initial bet after his starting hand is dealt face-down but before he has flipped over the cards. Thus, the player may place his initial bet at any time before he has an opportunity to review his starting hand.

At step 46, method 40 includes determining whether the player wishes to make a bust insurance bet. For example, the player may indicate his wish to make a bust insurance bet to the dealer by placing one or more coins or tokens (e.g., a $10 token) on second betting area 30 of table 10 (FIG. 1B). Alternatively, the player may communicate (e.g., orally or otherwise) his wish to make a bust insurance bet to the dealer. At step 48, method 40 includes determining whether the player is eligible to make a bust insurance bet. For example, the player may be eligible to make such a side bet whenever busting upon drawing an additional card is possible (e.g., whenever his starting hand has a total value of 12 or greater). In other embodiments, whether the player is eligible to make a bust insurance bet depends on different criteria, including criteria depending on data read from player tracking card 16 and/or downloaded from a casino computer. In another embodiment, the player can always decide to make a bust insurance bet. In this latter embodiment, step 48 is unnecessary and can be eliminated.

Alternatively, steps 46 and 48 may be performed in the opposite order, by determining whether the player is eligible to make a bust insurance bet before determining whether the player wishes to make such a bet. In this case, if determined that the player is not eligible to make a bust insurance bet, there will be no need to determine whether the player wishes to make such a bet, and that step may be omitted.

In one embodiment, if it is determined that the player is eligible to make a bust insurance bet at step 48, method 40 may also include the step of providing an indication to the player that he is eligible to make a bust insurance bet. For example, the dealer may tell the player about the player's eligibility, or the player's eligibility may be indicated to the player via an output device such as bust insurance eligibility indicator 32 mounted on table 10 in view of the player. In one embodiment, the eligibility for making a bust insurance bet is personal to each player, and the indication is provided independently to each player. In another embodiment, the eligibility for making a bust insurance bet applies to every player, and the indication is provided simultaneously to every player (e.g., via a lightbulb visible to every player, or an announcement on a public address system). For example, a casino could indicate that every player is eligible to make a bust insurance bet during a "bust insurance night" or a "bust insurance minute", during which the option is made available to every player.

At step 50, if the player selects the bust insurance bet option and is eligible to do so, method 40 includes receiving the bust insurance bet from the player. In one embodiment, the amount of the bust insurance bet is determined by the player, without restriction. For example, the amount of the bust insurance bet may be determined by whatever coins or tokens the player chooses to place on second betting area 30 of table 10. In this example, a player who wins on the bust insurance bet but loses on the initial bet may have net winnings, net losses, or may break even on the round of play. In other embodiments, the amount of the bust insurance bet that the player is allowed to make is restricted based upon one or more factors, such as the amount of the initial bet. For example, the player may only be allowed to wager a bust insurance bet in an amount that is a predetermined portion (e.g., 50%, 100%, 200%, etc.) of the initial bet. For another example, the player may only be allowed to wager a bust insurance bet in an amount set such that, in the event the player wins on the bust insurance bet (and loses on the initial bet), the player will break even on the round of play. In this last example, the amount of the bust insurance bet depends on both the amount of the initial bet and the payout ratio. For example, if the initial bet is $5 and the payout ratio for winning on the bust insurance bet is 0.5:1 (e.g., so that a $10 bust insurance bet will result in a $15 payout), the allowable bust insurance bet is $10 since, if the player nets $5 on the bust insurance bet and loses $5 on the initial bet, he breaks even. In this example, the bust insurance bet is used only to "insure" the initial bet.

Alternatively, the amount of the bust insurance bet which the player is allowed to make, or must make, may depend on different criteria. For example, the amount of a bust insurance bet may depend on the criteria used to determine the player's eligibility to make the bust insurance bet (e.g., a player who was made eligible to make one bust insurance bet as a promotion might be limited to wagering a maximum of $20 on that bust insurance bet), on the players starting and/or current hand, on the dealers upcard, and/or on one or more revised rules that the player agrees to for playing either the current round of play and/or at least one future round of play.

At step 52, which is performed if the player did not wish to make a bust insurance bet or was not eligible to do so, method 40 includes determining whether the player wishes to draw or "take" an additional card. The dealer may determine that a player wants to take an additional card when he receives a request from the player to take an additional card. For example, the dealer may hear the player say "hit me" (or other words with the same meaning), or watch the player make a "hit" motion. The dealer may determine that the player does not want to draw an additional card when he hears the player say "I'm standing" (or other words with the same meaning), or watches the player make a "stand" motion. In one example, a player's request to take an additional card is indicated by a bust insurance bet received from the player at step 50 since, by placing this bet, the player implicitly indicated that he wants to take an additional card. Alternatively, step 50 could also lead to step 52 to explicitly check whether the player wishes to draw an additional card even if a bust insurance bet was received from the player. In this case, the bust insurance bet may be returned to the player if he then decides not to draw an additional card. Note that, in this example, the "no" path of step 48 leads to step 52 to allow a player who originally intended to make a bust insurance bet (at step 46) but then found out that he was ineligible to make such a bet (at step 48) to change his mind about drawing an additional card. For example, if the player's starting hand had a total value of 16, the player may have originally decided to make a bust insurance bet and then draw an additional card in an attempt to improve his underlying hand but, on discovering that he was ineligible to make a bust insurance bet, the player may have changed his strategy and decided to stand on 16.

At step 54, if the player wishes to draw an additional card (as determined implicitly at step 50 and/or explicitly at step 52), method 40 includes dealing an additional card to the player. The additional card is dealt face-up, as shown in FIG. 1C.

An alternative method of playing a card game could include determining whether a player wishes to make a bust insurance bet (step 46) and/or whether the player is eligible to do so (step 48) after receiving a request from the player to take an additional card (step 52). For example, if a player who was dealt a starting hand having a total value of 16 indicates that he wishes to take an additional card, the dealer could then ask the player whether he would like to make a bust insurance bet before the additional card is dealt. If the player says "yes", a bust insurance bet may be received from the player (step 50) before the additional card is dealt (step 54). As another alternative, step 46 and/or step 48 could occur after the additional card is dealt to the player at step 54. For example, if a player who was dealt a starting hand having a total value of 16 indicates that he wishes to take an additional card, the dealer could deal that additional card face-down to the player, and could then ask the player whether he would like to make a bust insurance bet before the player reviews the additional card (e.g., by flipping the additional card over). If the player says "yes", then a bust insurance bet may be received from the player (step 50) after the additional card has been dealt to the player but before the additional card has been reviewed by the player.

At step 56, after the player has received the additional card, method 40 includes determining whether the player busted. To determine whether the player busted, the value of all of the cards in the players current hand is totaled (with an ace having a value of 1 instead of 11 if this prevents the player's hand from being busted), and the total is compared to a predetermined value (e.g., 21). In one example, if the total exceeds 21, the player has busted. If, however, the total does not exceed 21, the player has not busted.

At step 58, which is performed if the player has not busted, method 40 includes determining whether the player made a bust insurance bet (e.g., was a bust insurance bet received from the player at step 50?). If so, at step 60, method 40 includes collecting the bust insurance bet from second betting area 30 because the player made the bust insurance bet but did not bust upon taking the additional card at step 54. If the player did not make a bust insurance bet, or after taking away the bust insurance bet, method 40 returns to step 46. At step 46, the player can then, if desired, make another bust insurance bet (if eligible) and draw another card. Thus, a player may be able to make more than one bust insurance bet during a single round of play. For example, a player dealt a starting hand having a total value of 15 may make a first bust insurance bet, take a first additional card which turns out to be an ace such that his current hand has a total value of 16 (e.g., such that he loses the first bust insurance bet), make a second bust insurance bet, and then take a second additional card. In certain situations, the player may make still additional bust insurance bets during a single round of play. It is also possible for a player who declined to make a bust insurance bet before drawing an additional card during a round of play to later make a bust insurance bet before drawing a subsequent additional card during the same round of play. For example, a player dealt a starting hand having a total value of 14 may have declined to make a bust insurance bet before drawing a first additional card but, after having drawn a 2♥, may have made a bust insurance bet before drawing a second additional card. In one embodiment, however, a player is only allowed to make one bust insurance bet during a single round of play. This can be accomplished, for example, by making the player ineligible to make another bust insurance bet once such a bet has already been made. Alternatively, the path leading from the "no" branch of step 58, and from step 60, could return to step 52 instead of step 46, in which case the player could only make a bust insurance bet before drawing the first additional card after being dealt his starting hand.

At step 62, which is performed if it was determined at step 56 that the player busted, method 40 includes taking away the player's initial bet, since the player lost the underlying game of Blackjack by busting. Then, at step 64, method 40 includes determining whether the player made a bust insurance bet. If so, the player has won on the bust insurance bet, and method 40 includes determining and providing a bust insurance payout to the player at step 66. The amount of the payout may be determined in various ways, as described below. The payout may be provided by, for example, the dealer placing the proper amount and denomination of coins or tokens on second playing area 30 of table 10. Thus, the player can still "win" even if he loses the underlying game of Blackjack. If the player did not make a bust insurance bet, or after providing the bust insurance payout to the player, the current round of play is complete.

At step 68, which is performed if it was determined that the player did not wish to draw an additional card at step 52 (e.g., if the player chose to "stand" with a player final hand), method 40 includes determining the dealer's final hand. If the dealer's starting or current hand has a total value of less than 17, he is required to take one or more additional hits until he obtains a hand with a total value of 17 or greater, at which point he must stand. Thus, the dealer has no discretion at step 68. At this point, the player's final hand as well as the dealer's final hand have been determined.

At step 70, method 40 includes comparing the player's final hand to the dealer's final hand to determine the outcome of the underlying game of Blackjack. If the dealer busted (e.g., if the dealer's final hand is greater than 21), then the player won (since he did not bust). If, for example, the dealer's final hand has a value of between 17 and 21, inclusively, then the player won if the player's final hand has a total value greater than the total value of the dealer's final hand, the player lost if the player's final hand has a total value less than the total value of the dealer's final hand, and the player tied (i.e., a "push") if the player's final hand has the same total value as the dealer's final hand.

At step 72, method 40 includes determining the payout, if any, to the player based upon the player's initial bet, and providing any such payout to the player. If the player won, then he is paid based upon his initial bet using a 1:1 ratio (e.g., such that a $10 initial bet results in a $20 payout), unless he won with a Blackjack, in which case he is paid based upon his initial bet using a 1.5:1 ratio (e.g., such that a $10 initial bet results in a $25 payout). If the player lost, then the initial bet is taken from the player. If there was a "push", then the player's initial bet is returned to the player. If there is any payout, the payout may be provided by, for example, the dealer placing the proper amount and denomination of coins or tokens on first playing area 22 of table 10. The result of the round of play may, if desired, be stored on player tracking card 16, or may be uploaded for storage on a casino computer, for later use (as described below).

As described above, method 40 may include determining whether a player is eligible to make a bust insurance bet (e.g., step 48). There are a number of ways in which this determination may be made, and each of these ways may depend on one or more criteria. These criteria may also be combined in various combinations. The determination of the player's eligibility may be made manually by the dealer based upon the dealer's observations of the player's behavior, the player's playing history and/or player tracking data that is displayed to the dealer on an output device of a dealer terminal (not shown) after being read from player tracking card 16 and/or downloaded from a casino network after the player identified himself. The determination of the player's eligibility may also be made automatically based on such player tracking data. In any event, after being determined, the player's eligibility may be indicated to the player using bust insurance eligibility indicator 32 (if such an indicator 32 is provided).

In one embodiment, a player may be determined to be eligible to make a bust insurance bet based upon the player's starting hand and/or current hand. For example, as described above, a player may be eligible to make a bust insurance bet whenever busting upon drawing an additional card is possible (e.g., whenever the player's hand has a total value of 12 or greater). For another example, a player may be eligible to make a bust insurance bet whenever the total value of the players hand has a predetermined value (e.g., 15), or one of a plurality of predetermined values (e.g., 14, 15 or 16). While the predetermined value may indicate an unfavorable hand (e.g., to allow players with such hands to take out bust insurance to avoid becoming frustrated), the predetermined value may also be selected to indicate a favorable hand in an effort to encourage players who hold such hands to draw an additional card. For example, a player could be eligible to make a bust insurance bet whenever his hand has a total value of 18. The payout for the initial bet and/or bust insurance bet could be adjusted to encourage the player to make such a bust insurance bet and draw an additional card. For example, the payout ratio for the initial bet could be raised since it would be unlikely that the player will draw an additional card that does not cause him to bust. A player holding a favorable hand could also be paid to make a bust insurance bet. For example, a player with a hand having a total value of 18 who agrees to make a $5 bust insurance bet could be paid $1. A player may also be paid to make a bust insurance bet in other circumstances (e.g., pay a player $5 to try making his first bust insurance bet).

In another embodiment, a player may be determined to be eligible to make a bust insurance bet based on the number of cards the player has already drawn. For example, a player may only be eligible to make a bust insurance bet when he has not yet drawn any additional card during the round of play (i.e., when he holds his starting hand). In this example, the player's eligibility may also depend on his starting hand having a total value of 12 or greater. For another example, a player may only be eligible to make a bust insurance bet after having drawn one or more additional cards. A player could also be limited to making only a predetermined number (e.g., one) of bust insurance bets during a single round of play, or during multiple rounds of play, or during a particular period of time (e.g., only two during each eight hour time span). In this case, the dealer or house may keep track of the number of bust insurance bets a player has made using the player's tracking card 16, or using one or more lamars.

In another embodiment, a player may be determined to be eligible to make a bust insurance bet based at least in part upon the dealer upcard. Players often compare the player's starting or current hand with the dealer upcard to determine their chances of winning the current round of play, and to decide their playing strategy. For example, if the player's starting hand has a total value of 16, the player may select one strategy if the dealer's upcard is a 5♣ (e.g., the player may stand on 16) and a different strategy if the dealer's upcard is a 9♥ (e.g., the player may hit). The player's eligibility to make a bust insurance bet may depend on whether, based upon the player's starting hand and the dealer upcard, the player is likely or unlikely to draw an additional card. For example, the player could be eligible to make a bust insurance bet if he is likely to draw an additional card (e.g., to help prevent the player from becoming frustrated), or could be eligible to make a bust insurance bet if he is otherwise unlikely to draw an additional card (e.g., to help encourage the player to draw an additional card in situations in which he already has a favorable hand and is likely to beat the dealer).

In another embodiment, a player may be determined to be eligible to make a bust insurance bet based upon one or more previous behaviors of the player, or based upon the playing history of the player. For example, the player could be eligible to make a bust insurance bet whenever the player has lost a predetermined number of hands (e.g., ten) in a row, or has lost a predetermined number of hands during a session (e.g., ten losing hands since sitting down at table 10). A player could also be eligible to make a bust insurance bet when the player has lost a certain amount of money (e.g., has lost $200), or has lost a certain amount of money over time (e.g., has lost $100 in the last 30 minutes). A player's eligibility to make a bust insurance bet may also depend on the manner in which the player lost a previous hand. For example, a player may be eligible to make a bust insurance bet whenever the player busted to lose the previous hand, or lost the previous hand despite having a hand that normally has a good chance of winning (e.g., a hand having a total value of 20 which lost to the dealer's Blackjack).

In the last examples, the player's eligibility to make a bust insurance bet depends on a measurement of the player's previous behavior or playing history which acts as a predictor that the player is likely becoming frustrated, such that bust insurance is made available in an effort to prevent the player from quitting. In other examples, a player's eligibility to make a bust insurance bet depends on a measurement of the player's previous behavior or playing history that is not predictive of the player's frustration level. For example, a player may be eligible to make a bust insurance bet based upon the length of time the player has been playing (e.g., a player may be limited to making one bust insurance bet for each hour the player plays at the Blackjack table).

In another embodiment, a player may be determined to be eligible to make a bust insurance bet based upon a characteristic of the player. For example, a player having the characteristic of being a "high roller" may be offered the opportunity to make a bust insurance bet whenever he wants to make such a bet (e.g., as a perk). For another example, a player having the characteristic of being a first-time Blackjack player could be made eligible to make a bust insurance bet for a predetermined number of rounds of play in an effort to attract more players to learn how to play the card game.

In another embodiment, a player may be determined to be eligible to make a bust insurance bet as part of a promotional or marketing campaign. For example, a physical casino could attempt to attract new players by distributing coupons, vouchers or tokens that entitle its holders to make one bust insurance bet during their visits. For another example, an online casino operating via the Internet could credit the accounts of its registered users with the opportunity to make up to ten bust insurance bets, and could then inform its registered users about this opportunity via emails in an effort to entice those users to log back onto the site and play a few rounds of Blackjack. The account of each user could then be updated to reflect each bust insurance bet made.

In another embodiment, a player may be made eligible for bust insurance by paying a fee. For example, a player may pay $10 to be made eligible to make 10 bust insurance bets, or to make such bets during a particular time period (e.g., during August). For another example, a player may pay a subscription fee (e.g., $9.95/month) to be made eligible for bust insurance. The subscription fee may also entitle the player to receive other benefits (e.g., a monthly magazine, or membership in a players' club).

It is envisioned that still other criteria may be used to determine whether a player is eligible to make a bust insurance bet. In another embodiment, a player could make himself eligible to make a bust insurance bet in a current round of play by agreeing to make a bet in a future round of play. For example, the player could become eligible to make a bust insurance bet in a current round of play by agreeing to use any winnings as his initial bet on a subsequent round of play. The player's winnings, if any, would thus be "imprisoned", such that the player would be forced to play the next round of play to benefit from such winnings. For another example, a player may become eligible to make a bust insurance bet in a current round of play by agreeing to wager a minimum amount on a subsequent round of play. The minimum amount may be predetermined (e.g., $10), or may depend on a current bet made by the player (e.g., all or part of the player's current initial bet). In another embodiment, the player may be determined to be eligible to make a bust insurance bet based upon the amount of another bet made by the player (e.g., any player who makes an initial bet of at least $20 is eligible to make a bust insurance bet). As noted above, in another embodiment, the player is always eligible to make a bust insurance bet, and step 48 is not needed.

As described above, at step 66, method 40 includes determining and providing a bust insurance payout to the player in the event that the player made a bust insurance bet and then busted. Typically, the amount of the bust insurance payout is determined as a ratio of the bust insurance bet. For example, in the exemplary round of play described in relation to FIGS. 1A-1D, player 14 was paid on his bust insurance bet using a 0.5:1 ratio, such that the player's $10 bet resulted in a $15 payout (e.g., a $5 net). The amount of the bust insurance payout may be determined in a number of ways.

In one embodiment, the bust insurance payout is determined as a ratio of the bust insurance bet that depends on the total value of the player's starting or current hand at the time the player made that bet (i.e., before an additional card was dealt to the player). An exemplary bust insurance payout table 80 is shown in FIG. 3. Payout table 80 includes a first column 82 listing the total value of the player's hand at the time that the bust insurance bet was made, and a second column 84 listing a value indicative of the payout ratio for that bet. Payout table 80 includes rows 86A-86K listing data for the possible player hands. For example, rows 86A and 86G-86K indicate that a player holding a hand of 11 or less, or 17 or more, at the time of the bust insurance bet, is not eligible to make a bust insurance bet. Row 86B indicates that a player holding a hand of 12 at the time of the bust insurance bet will be paid based upon the bust insurance bet using a 2:1 ratio (e.g., so that a $10 bust insurance bet will result in a $30 payout). Similarly, rows 86C, 86D, 86E and 86F indicate that a player holding a hand of 13, 14, 15 and 16 at the time of the bust insurance bet will be paid based upon the bust insurance bet using a 1.5:1, 1:1, 0.5:1 and 0.5:1 ratio, respectively (e.g., such that a $10 bust insurance bet will result in a $25, $20, $15 and $15 winning payout, respectively).

Bust insurance payout table 80 may also include a third column 85 listing the maximum allowable bust insurance bet that a player is allowed to make for each player hand value. This third column may be especially useful in embodiments where the player is given an edge when making a bust insurance bet, by preventing the player from making a small initial bet followed by a large bust insurance bet.

In the example of FIG. 3, the value indicative of the payout ratio is listed in column 84 as the payout based on a $10 bust insurance bet. Alternatively, column 84 could list the payout ratio itself (e.g., 2:1, 1.5:1, 1:1, 0.5:1 and 0.5:1 for rows 86B, 86C, 86D, 86E and 86F, respectively). Payout table 80 may, for example, be printed on a chart that is placed within view of the player and the dealer for ready reference. In other embodiments (e.g., online casino or video gaming machine embodiments), payout table 80 may be implemented as a payout database including a plurality of records corresponding to rows 86A-86K, each record having a plurality of fields corresponding to columns 82-84. The payout database may then be used by a processor to calculate the player's payout upon winning on a bust insurance bet.

In payout table 80, a player hand having a total value of 11 or less (e.g., a starting hand consisting of a 4♦ and a 6♣) is defined as ineligible for bust insurance because such a hand cannot bust upon drawing one additional card. The payout ratio for player hands having a total value of 12, 13, 14, 15 and 16 are each defined such that the house will have a statistical edge over the player if the player makes a bust insurance bet. For example, if a player hand has a total value of 12, the player will bust upon receiving one additional card only if that additional card has a value of 10 (i.e., a ten, jack, queen or king), and will not bust if the additional card has a value of 9 or less (i.e., a 2-9 or an ace). Thus, the player's odds of winning the bust insurance bet are 4:9. Conversely, the house's odds of winning the bust insurance bet are 9:4 (i.e., 2.25:1). Thus, the house will have a statistical edge over the player by providing any payout ratio of less than 2.25:1, corresponding to any payout of less than $32.50 for a $10 bet. The $30 payout listed in column 84 of row 86B therefore allows the house to enjoy a statistical edge over the player. Similar calculations would show that the house would have a statistical edge by providing any payout ratio of less than 1.6:1, 1.167:1, 0.857:1 and 0.625:1 for player hands having a total value of 13, 14, 15 and 16, which would yield payouts of less than $26.00, $21.67, $18.57 and $16.25, respectively. Thus, the $25, $20, $15 and $15 payouts listed in column 84 of rows 86C, 86D, 86E and 86F allow the house to enjoy a statistical edge over the player. Based upon payout table 80, any player hand having a total value of between 17 and 21, inclusively, is not eligible for bust insurance. In this example, these hands were defined to be ineligible because the payout ratios that would be needed to allow the house to enjoy a statistical edge (i.e., 0.444:1, 0.3:1, 0.181:1, 0.083:1 and 0) were deemed to be too small to provide a meaningful payout to the player (deemed to be, in this example, less than 0.5:1). These specific values are merely exemplary, and payout table 80 could include other values.

Note that, in the preceding paragraph, the calculations of odds and payout ratios assumed that an infinite number of decks of cards are used. These calculations may also account for the affects of using a specific number of decks of cards (e.g., six), or of specific combinations of starting cards.

Payout table 80 may, in alternative embodiments, be modified in any of a number of different ways. In one embodiment, the player hands defined to be eligible for bust insurance are modified from those shown in FIG. 3. For example, player hands having a total value of 17, 18, 19 and/or 20 could be defined to be eligible for bust insurance, with payout ratios set to correspondingly smaller values to allow the house to maintain a statistical edge. Note that a player hand having a total value of 21 may still be defined as being ineligible for bust insurance since any additional card would necessarily bust the player. For another example, player hands having a total value of 12, 13, 14, 15 and/or 16 could be defined to be ineligible for bust insurance. For yet another example, player hands having a total value of 11 or less could be defined to be eligible for bust insurance, with the player allowed to take more than one additional card. For example, a player having a starting hand consisting of a 2♦ and a 3♠, for a total value of 5 points, may be allowed to make a bust insurance bet that will win if the player busts upon taking up to a predetermined maximum (e.g., two) additional cards. If this player then takes an 8♥ and a Q♠, the player will win on the bust insurance bet.

In another embodiment, the payout ratios corresponding to any or all of the player hands may be modified. For example, the payout ratios could be decreased from those indicated in FIG. 3, so that the house would enjoy a greater statistical edge. Any payout ratios that are eventually chosen will, however, need to satisfy any gaming laws or regulations that may apply (e.g., there may be minimum limits on the payout ratios to ensure that players statistically win a predetermined percentage of their bets). The payout ratios could also be increased from those indicated in FIG. 3, and could be increased such that the house enjoys less of a statistical edge over the player, merely breaks even statistically on the bust insurance bet, or even provides the player with a statistical edge. For example, column 84 of row 86C could be increased to $26, so that the house merely breaks even statistically, or increased to a value higher than $26 (e.g., $27) so that the player has a statistical edge. Especially in situations where the player has a statistical edge, there may be other eligibility criteria in addition to the total value of the player's hand, such as any of those described previously, which limit the player's ability to make bust insurance bets. For example, upon entering a casino, a player may receive a single token allowing him to make one bust insurance bet, such that the player could only once take advantage of any statistical edge that he may have over the house. For another example, the payout ratios may be modified to prevent card counters from gaining an undesired edge (e.g., by adjusting the ratios based upon cards that have already been played).

In yet another embodiment, the bust insurance payout ratio indicated in column 84 of payout table 80 for a particular player hand could be a dynamic ratio that varies based upon one or more criteria. For example, as indicated by row 86C, while a player may normally receive a $25 payout upon winning a bust insurance bet, that payout could be increased to $30 if the player was given a token on entering the casino. In this example, the casino's operator may have elected to provide the increased payout to players on a one-time basis as a marketing tool to attract players to visit the casino, while preventing the players from retaining an edge over the house over the long term.

A bust insurance payout may also be determined as a ratio of a bust insurance bet without using a bust insurance payout table such as payout table 80. For example, in one Blackjack option, the only player hand deemed to be eligible for bust insurance is defined as a player starting hand having a total value of 14. If the player then decides to make a bust insurance bet, he will be required to make the bust insurance bet in the same amount as his initial bet. Then, if the player busts, he will receive the amount of both his initial bet and his bust insurance bet back as his bust insurance payout. The player would thus break even on the current round of play, despite having busted. In another option, a player with a starting hand having a value of 12 could be allowed to place a bust insurance bet that is equal to one-half of his initial bet (similar to the amount of a Blackjack insurance bet). If the player then wins on the bust insurance bet, he will again break even by receiving the amount of both his initial bet and bust insurance bet back as his bust insurance payout. Similar Blackjack options could also be defined for other player hands, and one or more of these options could be offered simultaneously.

Using method 40, a player (if eligible) will have the option of making a bust insurance bet that will provide a bust insurance payout if the player busts upon receiving one additional card, and will otherwise be lost. The player (if the player remains eligible) will then have the option of making another bust insurance bet before drawing another additional card. For example, a player dealt a starting hand having a total value of 15 could make a first bust insurance bet, then draw a first additional card of a 2♣ (which would cause the player to lose the first bust insurance bet), and then make a second bust insurance bet before drawing a second additional card. Thus, a player may be able to make one, two or even more separate bust insurance bets during a single round of play. In another embodiment, a player may have the option of making a bust insurance bet that will provide a bust insurance payout if the player busts upon receiving more than one additional card. For example, a player dealt a starting hand having a total value of 8 may (if eligible) make a bust insurance bet that will provide a bust insurance payout if the player busts upon receiving no more than two additional cards. Since a player will always bust if the player keeps taking additional cards, the player will be allowed to take no more than a predetermined number (e.g., one, two, three) of additional cards to receive a bust insurance payout. In this case, the bust insurance payout ratios may be adjusted in accordance with the player's starting hand and the predetermined number of additional cards that the player is allowed to take.

In another embodiment, making a bust insurance bet gives a player the right to elect to return to his starting hand and to try again if the player's hand does not bust upon taking an agreed upon number of additional cards. For example, a player who was dealt a starting hand having a total value of 15 may take one additional card after placing a bust insurance bet providing bust insurance coverage for taking that one card. If the additional card is a 2♦, the player will lose his bust insurance bet (since the player did not bust), but will then have the right to discard the additional card (i.e., the 2♦) and to return to his original starting hand (i.e., with a total value of 15). The player may then replay his starting hand by, for example, staying, taking an additional card, or making another bust insurance bet and then taking another additional card. The option provided by this embodiment may be referred to as a "Didn't Bust; Try Again" option.

As shown in FIGS. 1A-1D, method 40 for playing a card game may be implemented without specialized apparatus or systems. For example, in the round of play of FIGS. 1A-1D, dealer 12 and player 14 played a game of cards in accordance with method 40 using one or more decks of cards, some coins or tokens for making initial bet 20 and bust insurance bet 28, and table 10 for providing first betting area 22 for placing initial bet 20 and second betting area 30 for placing bust insurance bet 28. Thus, method 40 may be easily implemented in a casino or other gaming venue.

Aspects of the implementation of method 40 may, however, be enhanced using additional apparatus or systems. For example, by providing player tracking card 16 and card reader 18, a casino may track additional information about player 14 which may be used in determining whether player 14 is eligible to make a bust insurance bet. For another example, by providing bust insurance eligibility indicator 32, player 14 may receive notification about his eligibility to make a bust insurance bet. In some embodiments, by automatically controlling eligibility indicator 32 (as described below), dealer 12's workload can be decreased and/or the eligibility criteria may be made more complex than otherwise practical (e.g., it may be difficult for dealer 12 to track whether each player seated at table 10 has lost a certain amount of money in the last hour). Although a casino may have to change its existing facilities to provide these additional apparatus or systems, the benefits of making the changes may outweigh their costs. Below, additional apparatus and systems for enhancing the implementation of method 40 are disclosed. Any or all of these apparatus and systems may be used by a casino.

Figure 4:
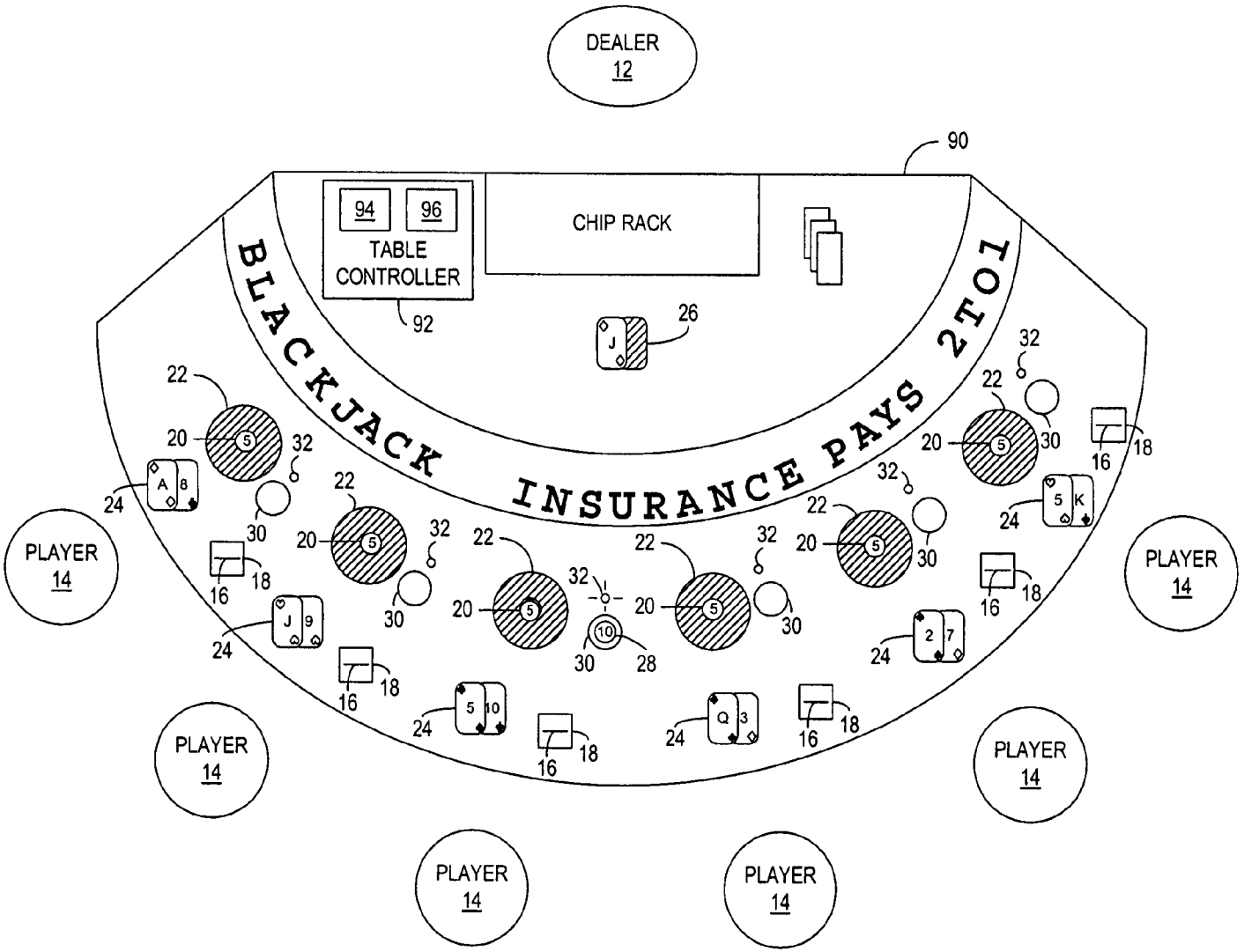
FIG. 4 is an overhead plan view showing a physical Blackjack table, for use in a physical casino, which has been adapted for use in practicing a method for playing a card game in accordance with the method shown in FIGS. 2A-2B.

Referring to FIG. 4, a physical Blackjack table 90, for use in a casino, has been adapted for use in practicing method 40. Surrounding table 90 are dealer 12 and one or more players 14. Although six (6) players 14 are shown, there may be fewer or greater numbers of players 14, and one or more of the player positions surrounding the table may not be occupied at any given time. Table 90 provides a gaming area for each player 14 which may be similar to that provided by table 10 in FIGS. 1A-1D (compare the gaming area for the third player from the left with FIGS. 1A-1D). In particular, for each player 14, table 90 provides a card reader 18 for accepting a player tracking card 16, a first betting area 22 for receiving an initial bet 20, a second betting area 30 for receiving a bust insurance bet 28, and a bust insurance eligibility indicator 32. Table 90 also provides a table controller 92 for controlling operation of table 90.

Figure 5:
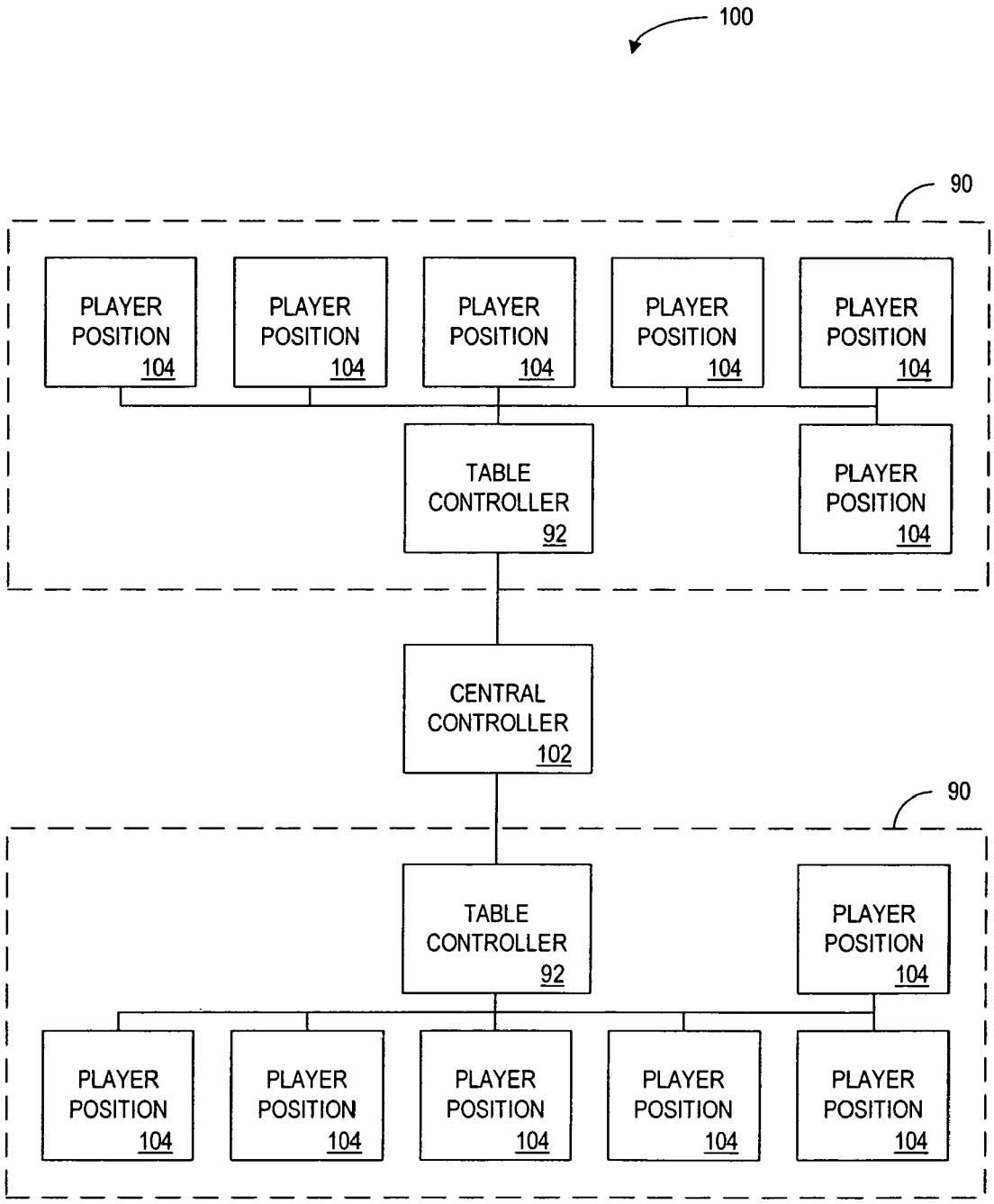
FIG. 5 provides an overview block diagram of an exemplary layout of a plurality of player positions at one or more Blackjack gaming tables, in which each of the player positions is in communication with a table controller, and each of the table controllers is in communication with a central controller via a communication network.

In one embodiment, table controller 92 is implemented using a computer terminal that is accessible to dealer 12. This terminal includes a processor, one or more input devices 94 that can be activated by dealer 12 to provide input information to the processor, and one or more output devices 96 for outputting information to dealer 12. The one or more input devices 94 may include a keyboard, a touch screen interface, a lightpen, a voice-recognition interface, discrete switches, etc. The one or more output devices may include a display screen, LEDs, lamps, an audio circuit and speaker, etc. As shown in FIG. 5, table controller 92 may also communicate with input and output devices at player positions 104, and with a central controller operated by the casino.

Referring to FIG. 5, Blackjack table 90 is one of several gaming devices that are coupled to a communications network 100 which is operated by the casino. Although two Blackjack tables 90 are shown, there may be more than or fewer than two Blackjack tables 90 coupled to communications network 100, and there may be other types of gaming apparatus coupled thereto, such as poker tables, roulette tables, craps tables, slot machines, video poker machines, video Blackjack machines, etc. Network 100 allows information (e.g., player tracking data) to be shared among the various gaming devices in the casino, and allows certain processing functions to be centralized.

Also coupled to communications network 100 is a central controller 102 which communicates with the table controller 92 of each table 90, and with any of the other gaming apparatus coupled to network 100. Each table controller 92, in turn, communicates with each of a plurality of player positions 104 defined by that table 90. Each player position 104 includes one or more input and output devices for one of the players 14 at that table 90. For example, via communications network 100, table controller 92 of each table 90 can read data from, and write data to, the player tracking card 16 of each player 14 at that table 90, can send output commands to the bust insurance eligibility indicator 32 of each player 14 at that table 90, and can engage in bidirectional communications with central controller 102. In one embodiment, table controller 92 can also receive data from one or more devices (e.g., a digital camera) configured to track the play of each player 14. This data may indicate, for example, the player's hand, the player's initial bets, and/or any side bets made by the player. These one or more devices may be mounted or otherwise coupled to table 90 (e.g., a digital camera may be mounted over table 90 to detect the cards in each of the player's hands).

Communications network 100 may transmit information across any of a variety of media, such as across electrical wires or cables, fiber optic lines, telephone wires, a Local Area Network (LAN), a Wide Area Network (WAN), the Internet, radio frequency interfaces, etc. Further, different portions of communications network 100 may employ different media (e.g., table controller 92 may communicate with each local player position 104 via electrical wires, while communicating with central controller 102 via a LAN). In one embodiment, central controller 102 is a casino controller that communicates via network 100 with various gaming devices located within the casino. In another embodiment, central controller 102 is a remote controller which communicates with each table controller 92 via the Internet, telephone wires, etc. In the latter embodiment, central controller 102 may control gaming devices located in multiple locations (e.g., gaming devices in multiple locations operated by one party).

Figure 6:
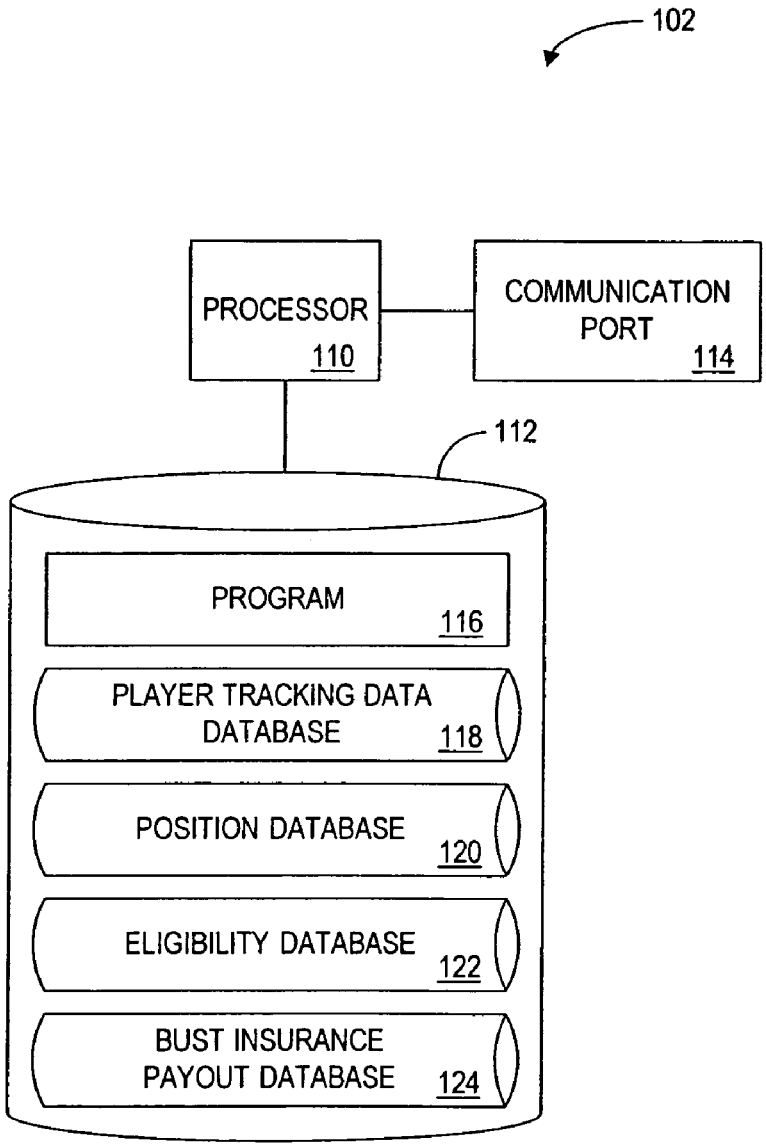
FIG. 6 is a hardware block diagram showing an exemplary embodiment of the central controller shown in FIG. 5, which includes several exemplary databases.

Referring to FIG. 6, in one embodiment, central controller 102 includes a processor 110, a data storage device 112 in communication with processor 110, and one or more communication ports 114 also in communication with processor 110. Processor 110 includes one or more microprocessors, such as one or more Intel PENTIUM® microprocessors. Data storage device 112 includes any of a variety of memory devices, such as random access memory (RAM), read only memory (ROM), floppy disk, hard disk, optical disk or a combination thereof. Although data storage device 112 may be proximate to processor 110, data storage device 112 may also be located remotely from processor 110 and coupled thereto via a remote communication medium (e.g., the Internet). Data storage device 112 stores a program 116 including instructions executed by processor 110, and also stores data structures including a player tracking data database 118, a position database 120, an eligibility database 122, and a bust insurance payout database 124, each accessible by processor 110.

The player tracking data database 118, the position database 120, the eligibility database 122, and the bust insurance payout database 124 are described in detail below and depicted with exemplary entries in the accompanying figures. As will be understood by those skilled in the art, the schematic illustrations and accompanying descriptions of the databases presented herein are exemplary arrangements for stored representations of information. A number of other arrangements may be employed besides those suggested by the tables shown. For example, those skilled in the art will understand that the number and/or content of the databases can be different from those illustrated herein. Similarly, the illustrated entries of the databases represent exemplary information only; those skilled in the art will understand that the number and/or content of the entries can be different from those illustrated herein. Based on the present disclosure many other arrangements of data will be readily understood by those of skill in the art.

Player tracking data database 118 stores information used for tracking players such as, for each player, a player identification number, the player's name and address, credit data, data identifying a financial account owned by the player, data representative of the player's playing history (e.g., amount won, amount lost, etc.), and other player tracking data, as known in the art. The structure and use of position database 120 and eligibility database 122 are described below. Bust insurance payout database 124 stores information representing payouts that a player can win on a bust insurance bet, such as the information illustrated by bust insurance payout table 80 (FIG. 3). In other embodiments, one or more of these databases is not used and/or other databases are present. Communication port 114 includes one or more input/output interface circuits for communicating with each table controller 90 and any other gaming devices.

Referring back to FIG. 4, in one embodiment, dealer 12 makes the determination about whether each player 14 is eligible or ineligible to make a bust insurance bet, and actuates an appropriate input device 94 to cause table controller 92 to transmit a command signal to the bust insurance eligibility indicator 32 for each player 14. For example, in response to observing that a particular player appears to be frustrated after having lost several hands in a row, dealer 12 may actuate an "eligibility switch" to notify that player about his eligibility for bust insurance during the next round of play. As this example shows, a player's eligibility may be determined in whole or in part on the dealer's personal observations of the player's demeanor and/or playing history. In this example, table controller 92 could comprise a switch panel with switches wired to the bust insurance eligibility indicator 32 for each player 14 (and central controller 102 could be optional).

If dealer 12 determines the bust insurance eligibility for each player, dealer 12 is provided with access to the information needed to make this determination. This information may include, for example, any or all of dealer 12's personal observations of the player's demeanor, the player's starting and/or current hand, the dealer upcard, the player's playing history, etc. This information may also include player tracking data for each player who identifies himself (e.g., by inserting his player tracking card 16 into card reader 18). To provide dealer 12 with player tracking data, table controller 92 may read the player tracking data directly from player tracking card 16 and then present (e.g., display) this data to dealer 12 using output device 96. Alternatively, table controller 92 may use the player's identity to download the player tracking data stored in player tracking data database 118 stored on central computer 102, and then present (e.g., display) this data to dealer 12 using output device 96.

In some situations, it may be difficult and/or inefficient for dealer 12 to determine whether each player 14 is eligible to make a bust insurance bet, and/or to control the eligibility indication that is provided to each player 14. For example, in some situations, dealer 12 may not have access to the information needed to determine the eligibility of each player 14 (e.g., dealer 12 may not know that a player was made eligible to make 5 bust insurance bets by losing $500 yesterday). In other situations, the criteria for making the eligibility determinations may be too complex to be easily evaluated by dealer 12, especially in view of the dealer's regular tasks of taking bets, dealing cards, and making payouts. For example, requiring dealer 12 to determine the eligibility of each player 14 to make bust insurance bets may compromise the dealer's ability to keep a sharp lookout for players trying to cheat. In still other situations, dealer 12 may not have enough time during each round of play to determine the eligibility of each player and to provide each eligibility indication. For example, while dealer 12 may have time to perform these functions if the bust insurance option is provided only infrequently (e.g., only if a player lost the last hand to the dealer's Blackjack despite having a "21"), dealer 12 may not have adequate time to perform these functions if each player's eligibility might change one or more times during each round of play. If too much time is lost by requiring the dealer to perform these functions, the pace of play will be slowed and gaming revenues will be lost. To solve these potential problems, the eligibility of each player 14 to make a bust insurance bet may also be determined automatically, using one of the embodiments described below.

In one embodiment, the determination about whether each player 14 is eligible to make a bust insurance bet is performed by central controller 102, which then communicates the results to table controller 92. Table controller 92 then notifies each player 14 of his eligibility via bust insurance eligibility indicator 32 or, alternatively, displays the results on output device 96 to allow dealer 12 to notify each player 14. To make these eligibility determinations, central controller 102 uses one or more of databases 118, 120, 122 and 124, in the manner described in the following paragraphs.

Referring to FIG. 7, position database 120 stores information about each player position 104, including information about player 14 at each player position 104. Each column 130-142 of the illustrated table represents one field of position database 120, and each row 144A-144B represents one record including each field 130-142. Position database 120 may include more than or fewer than the two records illustrated.

The fields of position database 120 include a position identifier field 130 for storing an identifier that uniquely identifies a player position 104, a table identifier field 132 for storing an identifier that uniquely identifies table 90 of that player position 104, a player history field 134 for storing data that indicates the playing history at that player position 104 (e.g., data indicating the total value of the last 10 player hands, and if the player won or lost each hand), a player identifier field 136 for storing an identifier that uniquely identifies the player at that playing position (if known), a win/loss payout history field 138 for storing data that indicates the winnings or losses of the player at that playing position, a dealer upcard field 140 for storing data indicative of the dealer upcard for the current round of play, and a player hand total field 142 for storing data indicative of the total value of the player's current hand. Position database 120 may, alternatively, have fewer than or more than these fields. For example, if table 90 is not provided with card readers 18 for reading player tracking cards 16, or with any other input device for determining the identity of the players, then field 136 is not needed.

In one embodiment, central controller 102 creates a new record such as record 144A or 144B when a new player starts playing at one of player positions 104, and updates this record to track that player's progress. Central controller 102 receives information needed to create and update this new record from table controller 92 via network 100. Table controller 92, in turn, receives this information from one or more sources. For example, dealer 12 may use one or more input devices 94 to enter any information needed by central controller 102 into table controller 92 (e.g., dealer 12 could activate a switch whenever a new player starts playing at a player position 104 to cause central controller 102 to create a new record in position database 120). Dealer 12 could use other input devices, such as a keyboard or touch screen, to enter other data.

Alternatively, other devices can be used to automatically obtain some or all of the information needed by central controller 102, thereby decreasing the burden on dealer 12. For example, when a new player sits down at a player position 104, table controller 92 may receive a signal generated by the card reader 18 at that position 104. This signal indicates the player identifier for that player, as read from tracking card 16 of that player, and also indicates that the player started playing. For another example, table controller 92 may receive a signal from a weight sensor that indicates when a new player sits down at a player position. For still another example, table controller 92 may receive signals from one or more devices (e.g., a digital camera) configured to track the play of each player. This one or more devices may include, for example, a digital video camera which, with pattern recognition hardware and/or software, generates signals that are indicative of each player's hand and the dealer's hand. This one or more devices may also generate signals indicative of initial bets and/or any side bets of each player, and winnings received by each player. After receiving these signals, table controller 92 communicates data needed by central controller 102 via communications network 100.

According to some embodiments of the present invention, table controller 92 and/or central controller 102 may receive determine information about cards and hands based on one or more signals from a device used in dealing cards. For example, a device may be coupled to a card-dispensing shoe for determining rank and/or suit of cards by sensing coded information on the cards. In this way, various types of information that may be useful in determining point totals for a hand of cards, determining whether to provide a bust insurance and/or mortgage option, etc., may be determined electronically, lessening the burden on the dealer 12. In one example, a device automatically determines card values with little or no required human involvement, and the determined values are transmitted to the central controller 102, the table controller 92, and/or the dealer 12.

Central controller 102 evaluates the data stored in position database 120 to determine whether the player at each player position 104 is or is not eligible for bust insurance. In one embodiment, this evaluation includes comparing the data stored in position database 120 with eligibility requirements stored in eligibility database 122.

Referring to FIG. 8, eligibility database 122 is represented by a table that stores various eligibility requirements. A player 14 is eligible to make a bust insurance bet if any of these requirements is met. Each column 146-147 represents one field of eligibility database 122, and each row 148A-148J represents one record that includes each field 146-147. Eligibility database 122 includes an eligibility identifier field 146 storing an identifier that uniquely identifies an eligibility requirement, and an eligibility description field 147 for storing a description of that requirement. Eligibility database 122 may store different types of eligibility requirements. For example, records 148A-148E store eligibility requirements that are specific to the player, while records 148F-148J store eligibility requirements that depend on the dealer upcard and/or player hand. As an example of an eligibility requirement specific to a player, record 148A indicates that a player will be eligible to make a bust insurance bet if the player has lost 10 hands in a row. As an example of an eligibility requirement that depends on the dealer upcard and/or the player's hand, record 148F indicates that a player will be eligible to make a bust insurance bet if the dealer upcard is an ace and the player's hand has a total value of 15. Eligibility database 122 may also store other types of eligibility requirements.

During operation, central controller 102 evaluates the data in position database 120 to determine whether the player at each player position 104 is eligible to make a bust insurance bet. For example, to determine if the players at player position POS-01 at table TAB-15 and at player position POS-05 at table TAB-3 are eligible to make a bust insurance bet based upon the eligibility requirement stored in record 148A of eligibility database 122, central controller 102 compares the data stored in player history field 134 of records 144A and 144B of position database 120 with the eligibility description stored in field 147 of record 148A of eligibility database 122. Based on this comparison, the player at position POS-01, table TAB-15 is determined to be ineligible to make a bust insurance bet since he has not lost 10 hands in a row, but the player at position POS-05, table TAB-3 is determined to be eligible to make such a bet since he has lost the last 10 hands. After evaluating the other eligibility criteria, if none of the other criteria are met for either player, central controller 102 then sends data to table controller 92 to cause table controller 92 to activate the eligibility indicator at position POS-05 of table TAB-3, and that player is notified that he is eligible to place a bust insurance bet. The data also causes table controller 92 to dim the eligibility indicator at POS-01 of table TAB-15 since that player is not eligible to place a bust insurance bet.

In another embodiment, the determination about whether each player 14 is eligible to make a bust insurance bet is performed by table controller 92 (rather than central controller 102). To perform this determination, table controller 92 may, for example, store databases that are similar to those described above as being stored by central controller 102, and may perform functions that are similar to those described above as being performed by central controller 102. After making this determination, table controller 92 notifies each player 14 of his eligibility to make a bust insurance bet using that player's bust insurance eligibility indicator 32 or, alternatively, displays the eligibility results on output device 96 to allow dealer 12 to inform each player 14.

Alternatively, the eligibility determination for each player 14 is made automatically, but dealer 12 can override that determination (e.g., by actuating an appropriate input device 94, such as an "eligibility switch", for that player). For example, while central controller 102 or table controller 92 may have automatically determined that a particular player is not eligible to make a bust insurance bet (e.g., because that player has only lost 7 hands in a row while the predetermined eligibility criteria specify a minimum of 8 lost hands in a row to be eligible for bust insurance), dealer 12 could be allowed to override the automatic determination in order to make the player eligible to make a bust insurance bet based on the dealer's personal observations (e.g., dealer 12 may make the player eligible to make a bust insurance bet after hearing the player threaten to quit playing and leave the casino unless he wins the next hand).

In another embodiment, to become eligible to make a bust insurance bet, a player could be required (e.g., as a condition of being made eligible to make the bust insurance bet) to wager all or a portion of the bust insurance payout (and/or any payout on the underlying game) as an initial bet on a future round of play. For example, a player who places a bust insurance bet of $10 after accepting this condition, and then wins a bust insurance payout of $20, could be required to wager the $20 bust insurance payout as an initial bet on the next round of play. This condition would give the casino a chance to earn back some or all of the payout, and would help to encourage the player to remain at the Blackjack table (since the player would otherwise forfeit the payout).

Figure 9:
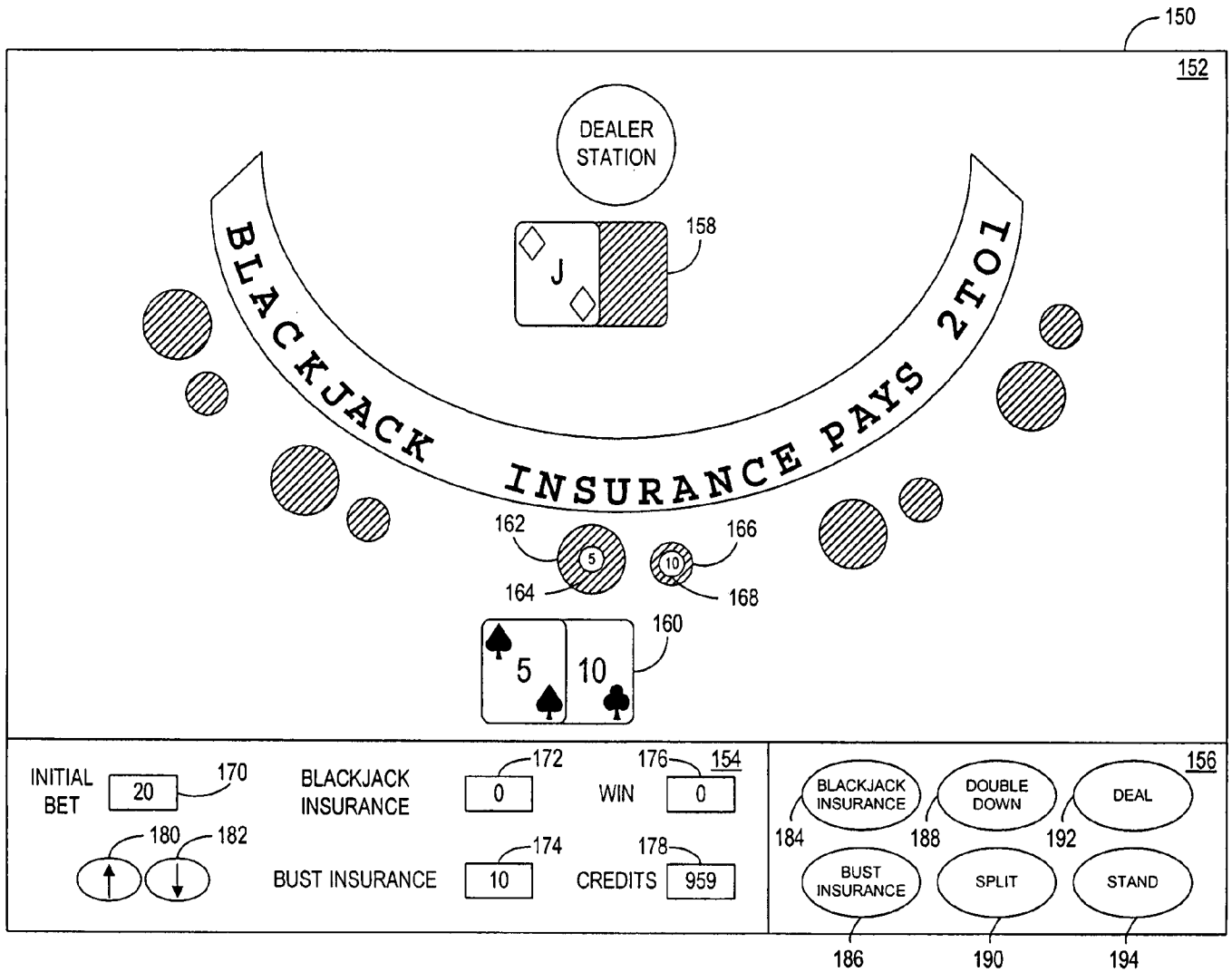
FIG. 9 is a diagram illustrating a virtual Blackjack table, for use by an online or virtual casino, or a video gaming machine, which has been adapted for use in practicing a method for playing a card game according to the method of FIGS. 2A-2B.

Referring to FIG. 9, a virtual Blackjack table 150 is adapted for use in practicing method 40 with an online or virtual casino, or a video gaming machine. Table 150 is implemented using a player terminal including one or more input devices actuatable by a player to provide commands for playing the card game, and one or more output devices for presenting information to the player. The player terminal may include a personal computer, a personal digital assistant ("PDA"), a WebTV® terminal, an electronic gaming device, a handheld gaming device, a wireless gaming device, a cellular telephone, etc. The one or more input devices may include a keyboard, a mouse, a voice-recognition circuit, a touch screen display, etc. The one or more output devices may include a video display such as a CRT, LCD or plasma display, a touch screen, etc., and may also include an audio circuit and speakers to generate sound. In an exemplary online or virtual casino embodiment, the player terminal communicates with a computer server operated by an online or virtual casino via a communications medium such as the Internet. In another embodiment, the player terminal includes a dedicated video gaming apparatus that may or may not be located in a physical casino.

In the exemplary embodiment shown in FIG. 9, the output display screen of virtual Blackjack table 150 is divided into three (3) windows 152, 154 and 156. First window 152 provides a Blackjack table window which appears similar to table 90 (FIG. 4), including graphical indicia representing a dealer hand 158, a player hand 160, a first betting area 162 for showing an indication of the player's initial bet 164, and a second betting area 166 for showing an indication of the player's bust insurance bet 168 (if any). Second window 154 provides a player betting window, including graphical indicia representing the amount of the player's initial bet 170 (e.g., $20), the amount of the player's Blackjack insurance bet 172 (e.g., $0), the amount of the player's bust insurance bet 174 (e.g., $10), the winning payout 176 (e.g., $0), and the amount of player credits 178 (e.g., $959). Second window 154 also includes graphical indicia representing increment and decrement switches 180 and 182 which can be activated by the player (e.g., by clicking on switches 180 and 182 with a mouse, or touching switches 180 and 182 on a touch screen display) to increment or decrement the amount of the player's initial bet (and possibly the amount of the player's other bets). Third window 156 provides a player command window, including graphical indicia representing a Blackjack insurance switch 184 for selecting the Blackjack insurance option, a bust insurance switch 186 for selecting the bust insurance option, a double down switch 188 for selecting the "doubling down" option, a split switch 190 for selecting the "splitting pairs" option, a deal switch 192 for commanding the online casino or video gaming machine to deal a starting hand or an additional card, and a stand switch 194 for instructing the online casino or video gaming machine that the player wishes to stand. By activating switches 184-194, the player can control the play of the game and select options, including the bust insurance option according to method 40.

As noted above, switches 180 and 182 are used for setting (incrementing or decrementing) the amount of the player's initial bet. In some embodiments, the amount of the bust insurance bet is determined automatically by the online or virtual casino, or video gaming apparatus, in response to activation of bust insurance switch 186, based upon the amount of the initial bet (and possibly other parameters such as the player's hand and/or dealer upcard). In other embodiments, however, switches 180 and 182 may also be used for setting (incrementing or decrementing) the amount of the player's bust insurance bet (if activated after an activation of bust insurance switch 186.

In one embodiment, switches 184-190 also act as output devices which provide indications to the player about when the respective options are available to the player. For example, Blackjack insurance switch 184 may be lit if the dealer's starting hand shows an ace upcard (and also, possibly, shows an upcard with a value of 10), and may otherwise be dimmed. Bust insurance switch 186 may be lit if the player is determined to be eligible for bust insurance (as described above), and may otherwise be dim. Double down switch 188 may be lit after the player has been dealt his initial hand, and may otherwise be dim. Split switch 190 may be lit if the player has been dealt an initial hand consisting of a pair of cards having the same rank, and may otherwise be dim. If a player attempts to activate one of these switches when dim, the attempt is ignored. Instead of lighting and dimming switches 184-190, these switches can indicate when the options are available in other ways (e.g., flashing vs. not flashing).

Alternatively, virtual Blackjack table 150 in FIG. 9 may be modified in a number of different ways. For example, the selection, coordination and arrangement of graphical indicia used for displaying the various types of information may be modified. For another example, since the amounts of the initial bet and the bust insurance bet are displayed in window 154, these amounts need not also be displayed in window 152, or vice-versa. For another example, the player terminal could include physical switches or a keyboard to allow the player to enter the amount of a bet or select the various options. Still other modifications may be made to virtual Blackjack table 150, as would be apparent to a person of ordinary skill in the art after reviewing the present specification.

In another embodiment, a second player may place a bust insurance bet on a first player's hand. For example, if the first player has a starting hand with a total value of 12, then the second player is allowed to place a bust insurance bet that the second player will win if the first player then busts upon drawing an additional card.

2. Mortgaging Embodiments

Figure 10:
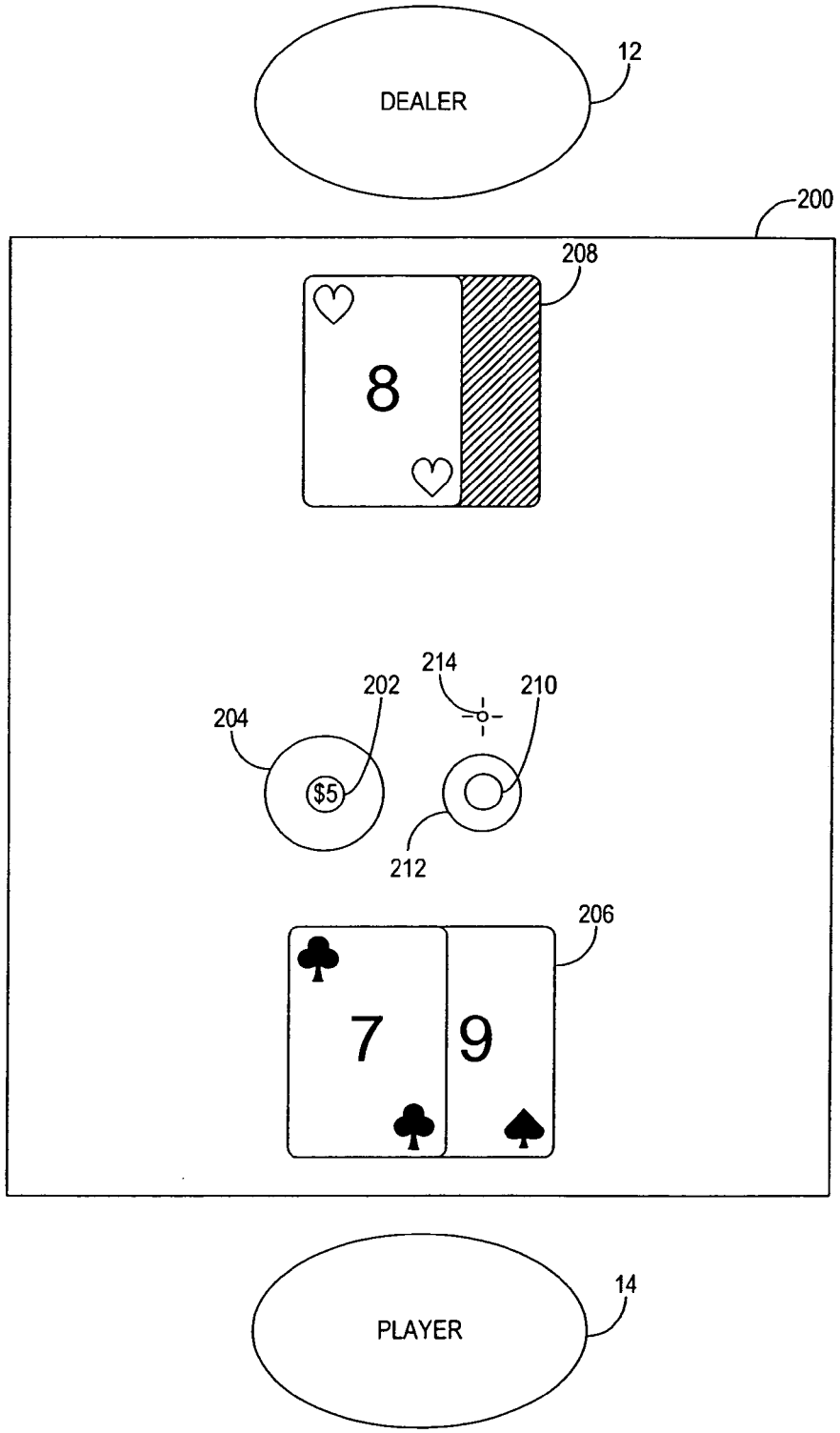
FIG. 10 illustrates another exemplary round of play of Blackjack, in accordance with another embodiment of the present invention, in which a player who made an initial bet and was dealt an unfavorable starting hand has selected an option for protecting his initial bet that involves changing at least one of the conventional rules of Blackjack in either the current round of play or at least one future round of play.

Referring to FIG. 10, an exemplary round of play in accordance with one or more mortgaging embodiments of the present invention is illustrated. Similar to the round of play illustrated in FIGS. 1A-1D, this exemplary round of play represents only one use of the mortgaging option, and this option may also be used with other specific hands of cards. This exemplary round of play may occur using a physical Blackjack table in a physical casino, a virtual table in a virtual or online casino, or virtual gaming machine.

Referring to FIG. 10, this exemplary round of play is being played on a Blackjack table 200 by dealer 12 and player 14. Although only one player is shown, any number of other players may also be present. Before any cards were dealt, player 14 made an initial bet 202 by placing one or more coins or tokens (e.g., a $5 token) on a first betting area 204 of table 200. Dealer 12 then dealt a starting hand consisting of two cards to player 14 and to himself. In this example, dealer 12 dealt player starting hand 206, consisting of a face-up 9♠ and a 7♣ for a total value of 16, to player 14, and a dealer starting hand 208, consisting of a face-up 8♥ and a face-down card, to himself. Thus, in this example, player 14 has been dealt an unfavorable or "bad" starting hand that is likely to bust if he draws an additional card, and is otherwise likely to lose to the dealer. In this situation, player 14 would typically like to "walk away" from the table, but is prevented from doing so by the fact that he has already placed initial bet 202.

After receiving the unfavorable starting hand and before either "hitting" or "standing", player 14 selected a mortgaging option in order to protect initial bet 202. To indicate his selection of the mortgaging option, player 14 placed a marker 210 (e.g., a "lamar") on a second betting area 212 of table 200. In one embodiment, player 14 selected the mortgaging option after observing an indication that he is eligible to select this option by a mortgaging eligibility indicator 214 (e.g., a lamp or LED) controlled in a manner similar to that of bust insurance indicator 32. By selecting this option, player 14 receives an advantage in the current round of play (e.g., a revised rule favoring the player) in exchange for mortgaging a future round of play or the current round of play. Player 14 "mortgages" a round of play by agreeing to play that round in accordance with a revised rule that is unfavorable for the player. Marker 210 can be left on table 200 between the current and future rounds of play, or during the current round of play, to serve as a reminder that the player agreed to the revised rule by selecting this option.

Embodiments of the mortgaging option are described below. In one or more embodiments, referred to as "future hand" embodiments, the mortgage includes an agreement by the player to play at least one future round of play in accordance with a revised rule. In other embodiments, referred to as "current hand" embodiments, the mortgage includes an agreement by the player to play the current round of play in accordance with a revised rule. These "future hand" and "current hand" embodiments may also be combined, such that the mortgage includes an agreement by the player to play both the current round of play as well as at least one future round of play in accordance with a revised rule.

In the "future hand" embodiments, in exchange for receiving an advantage in the current round of play, player 14 mortgages at least one future round of play. To do so, player 14 enters into an agreement with dealer 12 (i.e., the "house") to wager at least a portion of initial bet 202 on the at least one future round of play, and to play the at least one future round of play in accordance with at least one revised rule which is unfavorable to player 14. The advantage received by player 14 in exchange for entering into this agreement may be, for example, the right to terminate the current round of play without losing any of initial bet 202. Thus, player 14 can "protect" his initial bet 202.

The agreement entered into by the player by selecting this "future hand" mortgaging option requires that the player wager at least a portion of initial bet 202 on the at least one future round of play. This wagering term of the agreement effectively "imprisons" initial bet 202, and encourages the player to participate in the at least one future round of play. In one embodiment, the player is required to leave initial bet 202 from the current round of play on table 200, so that all of initial bet 202 will be wagered by the player on the future round of play. In other embodiments, the player is required to leave some other portion (e.g., ¼, ½, ¾, twice, etc.) of initial bet 202 on table 200 as initial bet 202 for the future round of play. The player may also be allowed to wager an additional amount on the future round of play. In still other embodiments, the portion of initial bet 202 which the player is required to wager on the future round of play is a minimum amount (e.g., $1) which is not a set proportion or multiple of initial bet 202.

A player can bet "a portion" of initial bet 202 on a future round of play without being required to wager any of the same physical coins or tokens on the future round of play. For example, a player who made initial bet 202 on the current round of play using a $10 token can take back his $10 token and then place a $5 token as his initial bet for the next round of play in order to meet his burden (under his mortgaging agreement) of placing ½ of his initial bet 202 on the future round of play. Wagering "a portion" of initial bet 202 on the future round of play only requires that player 14 wager some amount (e.g., some coins or tokens) on the future round of play, such that the player cannot simply walk away after the current round of play has been completed.

In one embodiment, the future round of play that will be played in accordance with the revised rule will be the next round of play after the current round. Marker 210 thus serves as a reminder that the next round of play will be played using the revised rule. In this embodiment, the player may be required to leave all or part of initial bet 202 from the current round on table 200 to become all or part of initial bet 202 on the next round of play. Alternatively, the future round of play may occur at a subsequent time, such as the next time that player 14 plays a round of Blackjack at the casino, or at any time before a certain date or before a certain amount of time passes. In this embodiment, the terms of the "mortgage" (e.g., player 14's agreement to wager on a future round of play using a revised rule) may be recorded with the player's tracking data. If the player 14 does not satisfy the mortgaging agreement (e.g., the player does not play another round of Blackjack at the casino by the time agreed to), a penalty can be assessed against the player (e.g., some or all of initial bet 202 can be charged to the player's credit card or other financial account identified by the player's tracking data).

The revised rule that player 14 agrees to abide by during a future round of play may be any of a number of revised rules that are unfavorable to the player. The revised rule may be revised in comparison to the conventional rules of Blackjack, or in comparison to the default rules by which the game will be played in the absence of the mortgage (which may differ in one or more ways from the "conventional" rules). Thus, for example, a revised rule may be revised from the rules defining a particular variation of Blackjack played in a particular casino. A "revised" rule may include a modification of an existing rule (e.g., the player must beat the dealer by 2, instead of 1, to win the future round of play), or may include an "added" rule (e.g., the player will bust during the next round of play if he takes a 7 of any rank), or may include a "deleted" rule (e.g., the player may be made ineligible for the "split" option) during the next round of play.

The revised rule may govern the manner in which the game is played, the game's winner or loser, and/or the payout due to a player based upon a particular outcome of the game. One example of a revised rule unfavorable to a player is that the player will lose on a "push" (under the conventional rules, if a player's final hand has the same total value as the dealer's final hand, the result is declared a "push", and the player's initial bet is returned to the player). Another example of such a revised rule is that a players final hand must beat the dealer's final hand by 2 for the player to win (under the conventional rules, the player's final hand must beat the dealer's final hand by at least 1 to win). In this example, if the player's final hand beat's the dealer's final hand by only 1, the result may be declared a "push" or, alternatively, the player may lose to the dealer. Another example of such a revised rule is that a player may only take a predetermined number (e.g., 1) of additional cards during the future round of play. Another example of such a revised rule is that a player may only count an ace as a predetermined value (e.g., 1 or 11), instead of the value more beneficial to the player.

A player may also agree to play the future round of play in accordance with a revised rule that adversely affects his payout for a winning hand. For example, the player could agree that he will only be paid based upon his initial bet using a 1:1 ratio if he is dealt a Blackjack (instead of the 1.5:1 ratio according to the conventional rules of Blackjack), or that he will only be paid based upon his initial bet using a 0.5:1 ratio if the player's final hand beats the dealer's final hand. Other revised rules which are unfavorable to the player could also be used, and one or more of these revised rules may be used in combination. For example, in exchange for terminating the current round of play without losing his initial bet 202, player 14 could agree to play the next round of play in accordance with revised rules that require him to beat the dealer by 2 while only being allowed to draw one additional card after receiving his starting hand.

In exchange for entering into a mortgage agreement to bet at least a portion of initial bet 202 on a future round of play to be played in accordance with a revised rule unfavorable to the player, the player receives an advantage in the current round of play (e.g., a revised rule that is favorable to the player). As noted above, this advantage may include allowing the player to terminate the current round of play, without losing initial bet 202. In other words, the player may be allowed to "walk away" from the current round of play (but not the future round) after receiving an unfavorable or "bad" starting hand, without losing initial bet 202. This contrasts with the "surrender" option available under the conventional rules of Blackjack, where the player must surrender one-half of his initial bet to terminate the current round of play.

Alternatively, player 14 may receive another type of advantage during the current round of play. For example, the advantage could include making the player eligible to make a bust insurance bet, or increasing the payout for winning on a bust insurance bet. For another example, a player may be given the right to discard a first additional card and then take a second additional card in its place (e.g., a player holding a starting hand having a total value of 16 who then takes a K♥ could discard that card, and then take another additional card instead). For yet another example (i.e., a "bust-proof" embodiment), a player may be given the right to take and discard as many cards as he would like until he takes one additional card that does not cause his hand to bust (e.g., a player with a starting hand having a total value of 16 could draw and discard a J♣, then draw and discard an 8♠, and then draw a 2♦, at which point the advantage ends since the player did not bust). For another example, a player may receive an enhanced payout for the current round of play if he beats the dealer (e.g., a player who beats the dealer without a Blackjack may be paid based upon his initial bet using a 1.5:1 ratio, rather than the 1:1 ratio under conventional rules). Other advantages could be provided to the player, and more than one of these advantages may be provided in combination.

Figure 11:
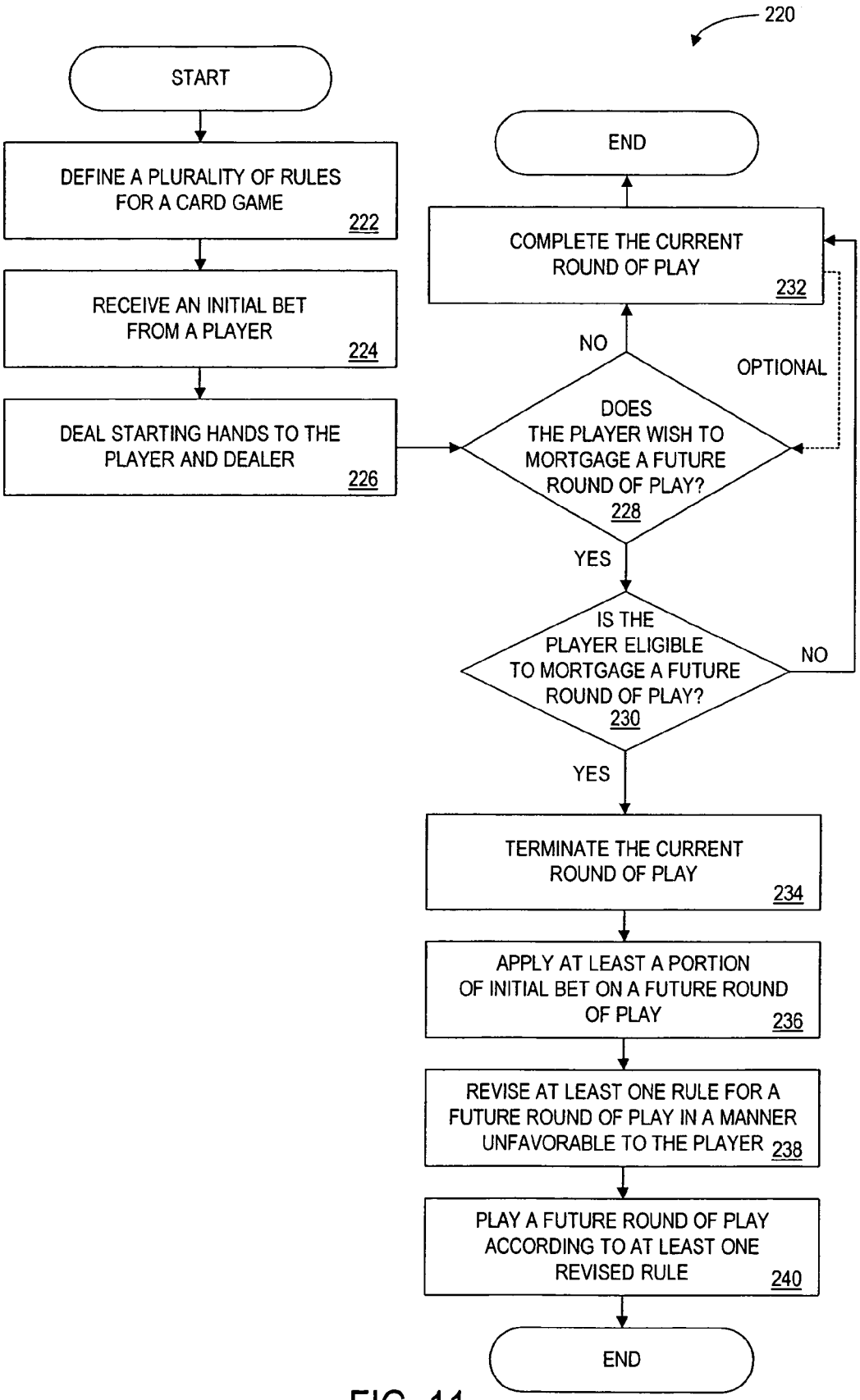
FIG. 11 illustrates an exemplary method for playing a card game in accordance with one embodiment of a "future hand" mortgaging option.

Referring to FIG. 11, an exemplary method 220 for playing a card game in accordance with one embodiment of the "future hand" mortgaging option is shown. At step 222, a plurality of rules for a card game are defined. The rules may be defined, for example, in accordance with the conventional rules of Blackjack. At step 224, an initial bet is received from the player (e.g., player 14 places a $5 token in first betting area 204). At step 226, starting hands are dealt to the player and dealer. For example, player 14 may be dealt a starting hand consisting of a face-up 7♣ and 9♠, and dealer 12 may be dealt a starting hand consisting of a face-up 8♥ and a face-down card. At steps 228 and 230, method 220 determines if the player wishes to mortgage a future (e.g., the next) round of play and, if so, if the player is eligible to mortgage that round of play. For example, player 14 may notify dealer 12 of his wish to mortgage the next round of play by placing marker 210 in second betting area 212, and player 14 may be eligible to mortgage the next round of play whenever player 14 has a starting hand. At step 232, if the player did not select the mortgaging option, or was not eligible to do so, the current round of play is completed. Optionally, during completion of this round, method 220 may return to step 228 to determine if the player later wishes to select the mortgaging option (as indicated by the dashed line from step 232 to step 228). For example, player 14 may be allowed to select the mortgaging option before taking each additional card.

If, however, the player selected the mortgaging option (and was eligible to do so), the player is provided with an advantage during the current round of play. In FIG. 11, this advantage involves terminating the current round of play without causing the player to lose any of the initial bet, at step 234. Alternatively, another advantage is provided, such as a rule change allowing the player to take and discard one additional card, in which case method 220 would then return to step 232 to complete the current round of play using the revised rule that is advantageous for the player. Then, at step 236, at least a portion of the initial bet from the current round of play is applied to a future round of play (e.g., as the initial bet for the next round). For example, the player leaves the $5 token placed in first betting area 204 for the current round of play in first betting area 204 for use during the next round. At step 238, at least one rule is revised for the future round of play in a manner unfavorable to the player. Then, at step 240, the future round of play is played according to the revised rule(s). Thus, in exchange for agreeing to bet at least a portion of the initial bet on a future hand to be played using at least one revised rule, the player was allowed to terminate the current round of play.

In another example of the "future hand" mortgaging embodiment, in exchange for receiving an advantage in the current round of play, a player is required to mortgage more than one future round of play. For example, in exchange for the right to terminate the current round of play without losing initial bet 202, player 14 can agree to bet at least $10 on each of the next two rounds of play, and to play each of those future rounds of play using a revised rule which specifies that the player will lose if the player's final hand and dealer's final hand have the same total value (i.e., a push). Alternatively, the player may agree to different revised rules for the two future hands.

In one embodiment of the present invention, a player who has been dealt a favorable starting hand is provided with an option which essentially is the opposite of the "future hand" mortgaging option. In this embodiment, the player is allowed to enter into an agreement to play at least one future round of play in accordance with a revised rule that is favorable to the player. In exchange for this agreement, the player suffers a disadvantage in the current round of play. For example, a player who has been dealt a good starting hand, such as a 10♠ and a Q♦ for a total value of 20 against a dealer hand showing an upcard of a 7♥, could agree to terminate the current round of play without receiving any winnings in exchange for receiving the opportunity to be paid using an enhanced payout ratio (e.g., 2:1, instead of the conventional 1:1) on the next round of play. This option may be used to increase the payout amount for playing Blackjack.

In the "current hand" mortgaging embodiment, in exchange for receiving an advantage (e.g., a revised rule favorable to the player) in the current round of play, player 14 enters into an agreement with dealer 12 (i.e., the "house") to play the current round of play in accordance with at least one revised rule unfavorable to the player. If this option is selected, the current round of play will then be played in accordance with a first revised rule which is favorable to the player and a second revised rule which is unfavorable to the player. For example, upon receiving the starting hand shown in FIG. 10, player 14 could enter into an agreement with dealer 12 to play the current round of play in accordance with a first revised rule that allows the player to take and to discard one additional card if the player so desires (which is favorable to the player) and a second revised rule that limits the payout ratio that the player can win for beating the dealer to 0.5:1, rather than the conventional 1:1 (which is unfavorable to the player). Other exemplary rules that are either favorable or unfavorable to the player were previously described, and may be used in this current hand mortgaging embodiment.

Figure 12:
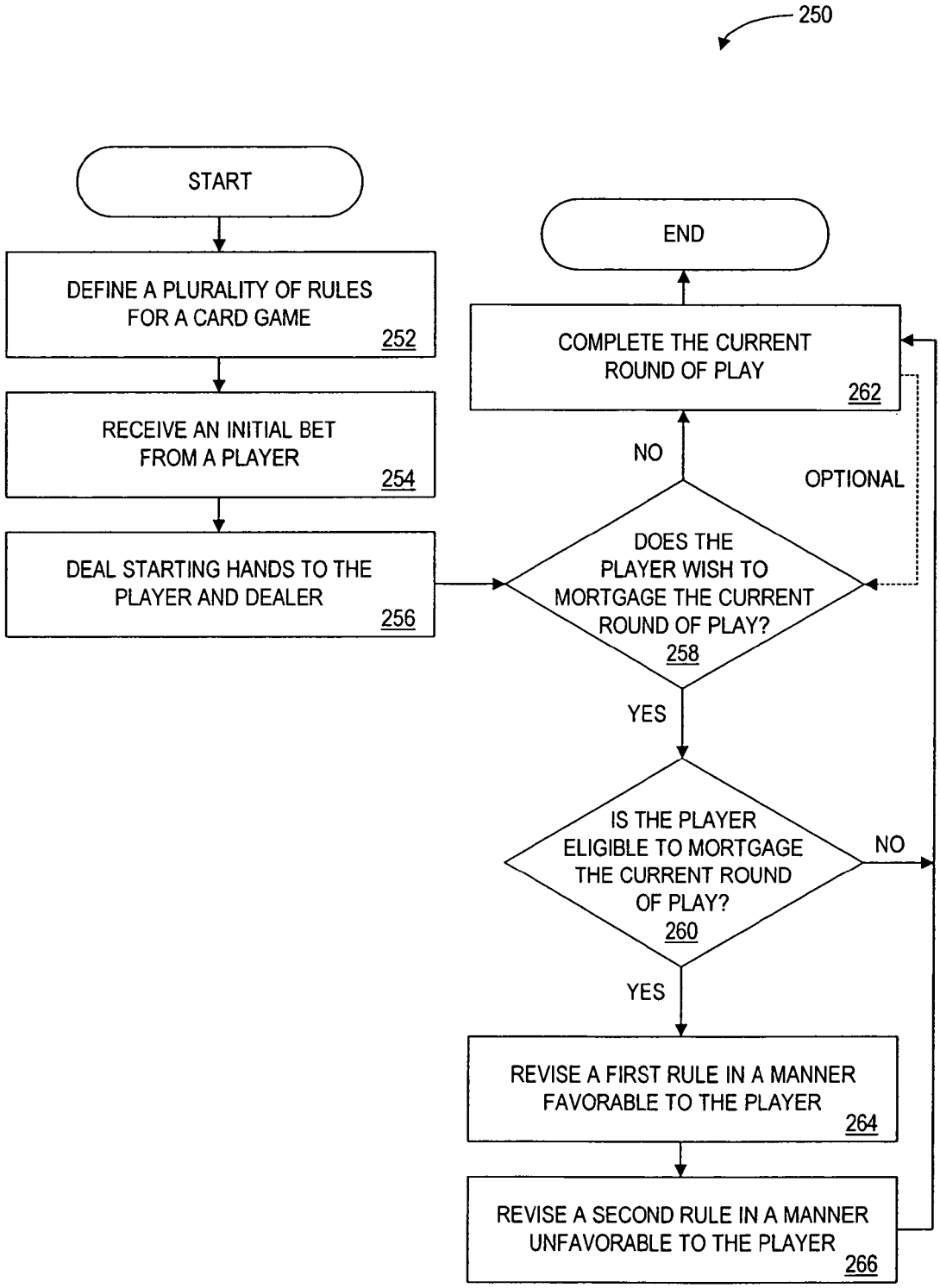
FIG. 12 illustrates an exemplary method for playing a card game in accordance with one embodiment of a "current hand" mortgaging option.

Referring to FIG. 12, an exemplary method 250 for playing a card game in accordance with one embodiment of the "current hand" mortgaging option is shown. At step 252, a plurality of rules for a card game are defined. The rules may be defined, for example, in accordance with the conventional rules of Blackjack. At step 254, an initial bet is received from the player (e.g., player 14 places a $5 token in first betting area 204). At step 256, starting hands are dealt to the player and dealer. For example, player 14 may be dealt a starting hand consisting of a face-up 7♣ and 9♠, and dealer 12 may be dealt a starting hand consisting of a face-up 8♥ and a face-down card. At steps 258 and 260, method 250 determines if the player wishes to mortgage the current round of play and, if so, if the player is eligible to do so. For example, player 14 may notify dealer 12 of his wish to mortgage the current round of play by placing marker 210 in second betting area 212, and player 14 may be eligible to mortgage the current round of play whenever player 14 has a starting hand. At step 262, if the player did not select the mortgaging option, or was not eligible to select that option, the current round of play is completed. Optionally, during completion of the current round of play, method 250 returns to step 258 to determine if the player later wishes to select the mortgaging option (as indicated by the dashed line from step 262 to step 258). For example, player 14 may be allowed to select the mortgaging option before taking each additional card.

If, however, the player selected the mortgaging option (and was eligible to do so), method 250 includes revising at least a first of the rules in a manner which is favorable to the player, at step 264, and then revising at least a second of the rules in a manner which is unfavorable to the player, at step 266. Then, method 250 continues at step 262, where the current round of play is played in accordance with the revised rules. For example, by selecting the "current hand" mortgaging option, the player may have entered into an agreement with dealer 12 which specified that the player could draw and discard one additional card (which is favorable to the player) while also specifying that the player's final hand must beat the dealer's final hand by 2 to beat the dealer (which is unfavorable to the player). Thus, in exchange for revising at least a first rule of the card game in a manner which is favorable to the player, the player agreed to the revision of at least a second rule of the card game in a manner which is unfavorable to the player.

In one embodiment, player 14 is always eligible to select either the "future hand" or the "current hand" mortgaging option. In other embodiments, the player's eligibility to select either mortgaging option depends on one or more criteria. In these embodiments, dealer 12 may inform player 14 about player 14's eligibility to select the mortgaging option. Alternatively, mortgaging eligibility indicator 214 may be lit if player 14 is eligible to select the mortgaging option, and be dimmed otherwise. Player 14 may be eligible to select the mortgaging option when, for example, player 14 has an unfavorable starting hand, such as a starting hand having a total value of 15, or between 14 and 16. Other criteria which may be used to determine whether player 14 is eligible to select the mortgaging option are analogous to the criteria that were described previously for determining whether player 14 is eligible to make a bust insurance bet.

In the above discussion, methods 220 and 250 are each described as being used with Blackjack table 200 (FIG. 10), which is similar to Blackjack table 10 (FIG. 1). Alternatively, methods 220 and 250 may each be used with a Blackjack table which is similar to physical Blackjack table 90 (FIG. 4), and which may communicate with communications network 100 operated by the casino. Any or all of the additional apparatus and systems that were described above as being used to enhance the operation of method 40 may be readily adapted by a person of skill in the art to enhance operation of methods 220 and 250. As yet another alternative, methods 220 and 250 may each be used with a virtual Blackjack table which is similar to virtual Blackjack table 150 (FIG. 9). In this latter embodiment, the virtual Blackjack table may be modified to include a "mortgaging option" switch which the player can actuate to select a mortgaging option. If both the "future hand" and "current hand" mortgaging options are available, then two "mortgaging option" switches could be provided to allow the player to select either one. The "mortgaging option" switch (or switches) may also serve as an output indicator for notifying the player about his eligibility to select the mortgaging option (e.g., by being lit when the mortgaging option is available to the player, and by being dim otherwise).

A winning payout may be provided to a player in different ways. In one embodiment, a dealer physically transfers one or more coins or tokens to a player. For example, in response to a winning bet, the dealer places coins or tokens on the betting area for that bet to provide the player with the proper payout. In another embodiment, a video Blackjack machine uses a coin or token dispensing mechanism to dispense the payout into a bin. In another embodiment, the player receives a credit in an amount of his winning payout. For example, a video Blackjack machine may track the player's credits as the player uses the machine, and allow the player to "cash out" by dispensing the proper amount of coins or tokens when the player actuates a "cash out" switch. In another example, a winning payout is credited to a financial or other account of the player. For example, in an online or virtual casino, the player may establish an account from which his bets are debited, and payouts are credited. The player can then receive payments from that player account by electronic transfer to a credit, debit or checking account, or by being a sent a check or other financial instrument for the proper amount.

It will be understood that principles of the various embodiments described above may be implemented and/or modified for use with various types and variations of game playing. For example, as described above, some embodiments of the present invention provide for mortgaging a round of play of games based on chance, such as various slot machine games or card games (e.g., poker; Blackjack).

Figure 13:
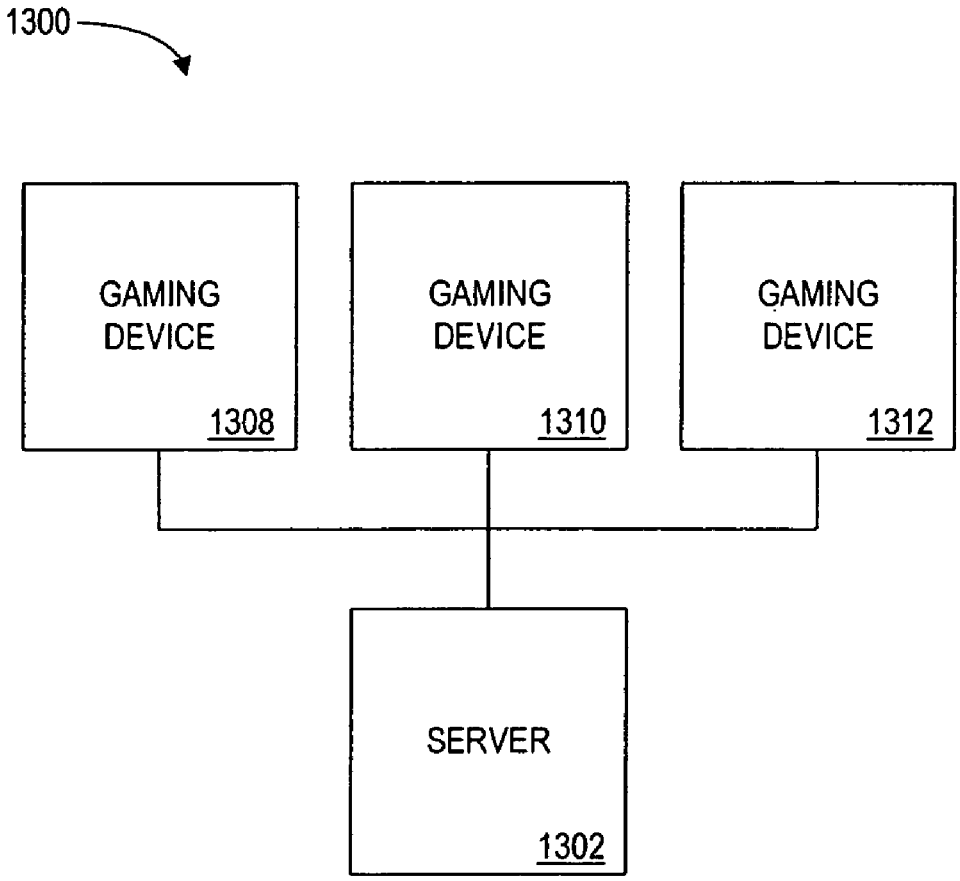
FIG. 13 is a block diagram of an exemplary system of one or more embodiments of the present invention.

Referring now to FIG. 13, a system 1300 according to one or more embodiments of the present invention includes server 1302 that is in communication with gaming devices 1308, 1310 and 1312. Each of the gaming devices may comprise one or more computing devices, such as those based on the Intel® Pentium® processor, adapted to communicate with the server 1302, and/or may comprise a personal computer; a portable type of computer, such as a laptop computer, a palmtop computer, a wearable computer, or a hand-held computer; and/or a Personal Digital Assistant (PDA). Other equivalent devices capable of performing the methods specified herein are well known in the art.

Any number of gaming devices may be in communication with the server 1302. The number of each depicted in FIG. 13 is solely for purposes of illustration.

The server 1302 may communicate with the gaming devices directly or via a network, including, without limitation, the Internet, wireless network protocol, local area network or a combination thereof; through a Web site maintained by the server 1302 on a remote server; or over an on-line data network including, without limitation, commercial on-line service providers and bulletin board systems. The server 1302 may communicate with the gaming devices indirectly. In some embodiments, the devices may communicate with the server 1302 over RF, cable TV, satellite links and the like.

Those skilled in the art will understand that devices in communication with each other need not be continually transmitting to each other. On the contrary, such devices need only transmit to each other as necessary, and may actually refrain from exchanging data most of the time. For example, a device in communication with another device via the Internet may not transmit data to the other device for weeks at a time.

The server 1302 may function as a "Web server" that generates Web pages (documents on the Web that typically include an HTML file and associated graphics and script files) that may be accessed via the Web and allows communication with the server 1302 in a manner known in the art.

FIG. 13 depicts a system in accordance with one or more embodiments of the present invention. Other arrangements of devices to perform various methods specified herein will be readily appreciated by those of skill in the art.

The server 1302 may be implemented as a system controller, a dedicated hardware circuit, an appropriately programmed general-purpose computer, or any other appropriate device including, without limitation, electronic, mechanical or electromechanical devices. Casino controller 102 (FIG. 6) illustrates an embodiment of the server 1302.

The server 1302 may comprise a processor, such as one or more Intel® Pentium® microprocessors. The processor may be in communication with a data storage device, which may comprise magnetic memory, optical memory, semiconductor memory or any combination thereof. The data storage device may include, for example, Random Access Memory (RAM), Read-Only Memory (ROM), a compact disc and/or a hard disk. The processor and the storage device may each be, for example: (i) located entirely within a single computer or computing device; or (ii) connected to each other by a remote communication medium including, without limitation, a serial port cable, a telephone line, a network connection or a radio frequency transceiver. In some embodiments, the server 1302 may comprise one or more computers that are connected to a remote server computer for maintaining databases.

The data storage device typically stores a program for controlling the processor. The processor performs instructions of the program, and thereby operates in accordance with the present invention, and particularly in accordance with the methods described in detail herein. The program may be stored in a compressed, uncompiled and/or encrypted format, as well as in a variety of other forms known in the art. The program furthermore may include program elements that may be necessary, including, without limitation, an operating system, a database management system and "device drivers" for allowing the processor to interface with one or more peripheral devices. Appropriate program elements are well known to those skilled in the art, and need not be described in detail herein.

According to some embodiments of the present invention, the instructions of the program may be read into a main memory from another computer-readable medium, such as into RAM from a hard drive, floppy disk, rewriteable medium (e.g., CD-RW), or ROM (e.g., CD-ROM). Execution of sequences of the instructions in the program causes the processor to perform process steps described herein. In alternative embodiments, hard-wired circuitry may be used in place of, or in combination with, software instructions for implementation of one or more processes of the present invention, as would be understood by those of skill in the art. Thus, embodiments of the present invention are not limited to hardware, software or any specific combination of hardware and software. The storage device may also store various databases, such as a player database (e.g., player tracking data database 118), as appropriate for the provided functionality of the system.

Figure 14:
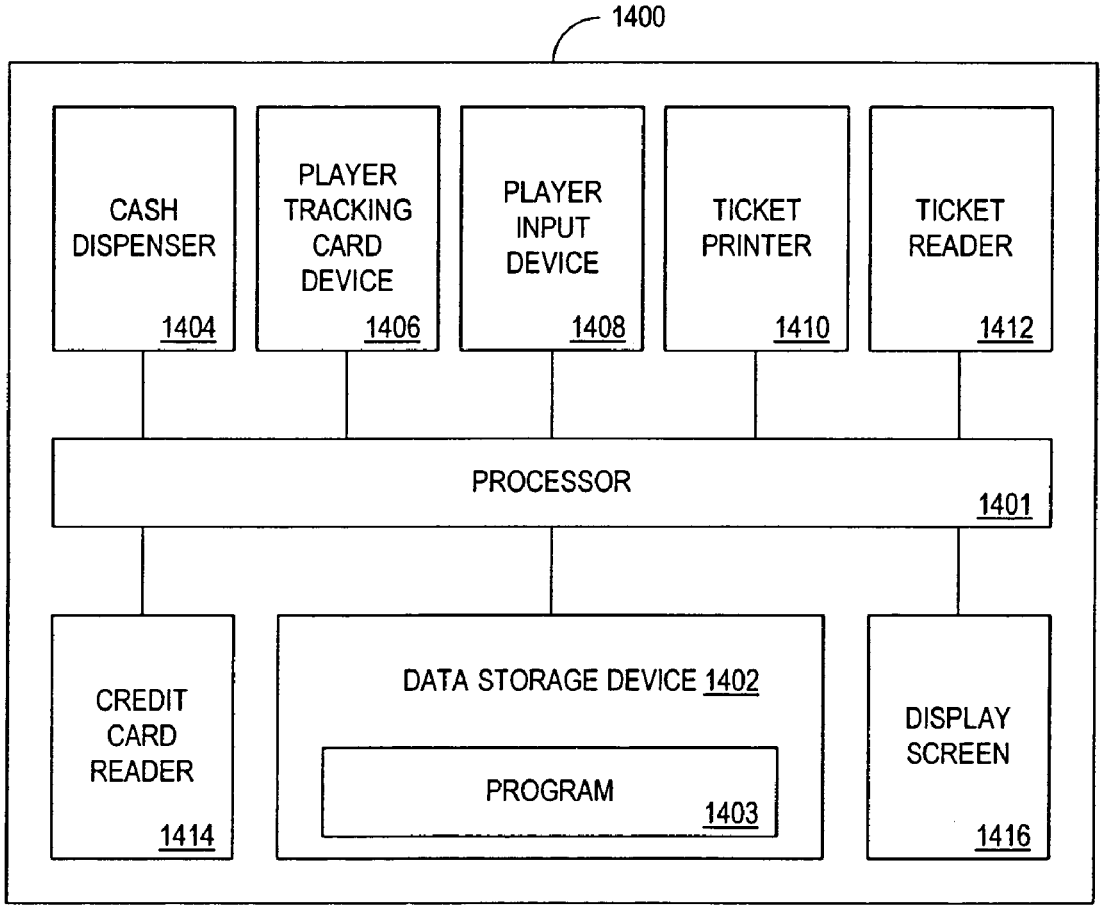
FIG. 14 is a block diagram of an exemplary gaming device according to one or more embodiments of the present invention.

FIG. 14 illustrates one or more embodiments 1400 of a gaming device 1308. Well-known examples of gaming devices include, without limitation, video poker machines, video blackjack machines, mechanical slot machines, video slot machines, video keno machines, video bingo machines, pachinko machines, and video lottery terminals. Other well-known examples of gaming devices include, without limitation: table controllers, such as the table controller 92 (FIG. 5); game tables, such as virtual Blackjack table 150 (FIG. 9); and player terminals, such as those described in implementing virtual Blackjack table 150 (FIG. 9). The gaming device may comprise a handheld and/or wireless gaming device. For example, in one embodiment a gaming device may comprise a wireless handheld device such as the WifiCasino GS™ offered by Diamond I Technologies of Baton Rouge, La. The gaming device may be implemented as a dedicated hardware circuit, an appropriately programmed general-purpose computer, or any other appropriate device including, without limitation, electronic, mechanical or electromechanical devices. Accordingly, the gaming device need not include the various exemplary components depicted in FIG. 14.

The gaming device 1400 of the illustrated embodiment comprises a processor 1401, such as one or more Intel® Pentium® microprocessors. The processor 1401 is in communication with a data storage device 1402. The data storage device 1402 comprises magnetic memory, optical memory, semiconductor memory or any combination thereof. The data storage device 1402 may include, for example, Random Access Memory (RAM), Read-Only Memory (ROM), a compact disc and/or a hard disk. The processor 1401 and the storage device 1402 may each be, for example: (i) located entirely within a single computer or computing device; or (ii) connected to each other by a remote communication medium, including, without limitation, a serial port cable, a telephone line, a network connection or a radio frequency transceiver. In some embodiments, the gaming device may comprise one or more computers that are connected to a remote server computer for maintaining databases.

The data storage device 1402 stores a program 1403 for controlling the processor 1401. The processor 1401 performs instructions of the program 1403, and thereby operates in accordance with the present invention, and particularly in accordance with the methods described in detail herein. The program 1403 may be stored in a compressed, uncompiled and/or encrypted format, as well as in a variety of other forms known in the art. The program 1403 furthermore includes program elements that may be necessary, including, without limitation, an operating system, a database management system and "device drivers" for allowing the processor 1401 to interface with one or more peripheral devices. Appropriate program elements are well known to those skilled in the art, and need not be described in detail herein.

According to an embodiment of the present invention, the instructions of the program 1403 may be read into a main memory from another computer-readable medium, such as into RAM from a hard drive, floppy disk, rewriteable medium (e.g., CD-RW), or ROM (e.g., CD-ROM). Execution of sequences of the instructions in program 1403 causes processor 1401 to perform process steps described herein. In alternative embodiments, hard-wired circuitry may be used in place of, or in combination with, software instructions for implementation of the processes of the present invention, as would be understood by those of skill in the art. Thus, embodiments of the present invention are not limited to hardware, software or any specific combination of hardware and software. The storage device 1403 may also store various databases, such as a payout database, a database of mortgaging options, or a player database, as practicable for the desired functionality of the gaming device.

The processor 1401 may also be in communication with a cash dispenser 1404, which dispenses coins and/or bills to players that have requested to have funds be dispensed. In another example, the cash dispenser 1404 may dispense bills and/or tokens without a request by a player to have funds be dispensed (e.g., may dispense automatically in response to a signal from the processor 1401).

The processor 1401 may also be in communication with a player tracking card device 1406, which performs functions related to player tracking cards, such as reading player tracking cards and communicating information read from such cards to the processor 1401. Typically, information read from such cards includes unique player identifiers, such as a sequence of digits or a sequence of alphanumeric characters.

The processor 1401 may also be in communication with a player input device 1408, which receives input from the player. Input device 1408 may comprise a variety of devices, including, without limitation, one or more buttons, touch screens, handles, keypads, pointer devices (e.g., a mouse, a trackball), microphones or any combination of the above.

The processor 1401 may also be in communication with a printer 1410, which may be commanded to print onto a substrate, such as paper or other material. Printing may be via ink jet, laser printing or other methodology for registering indicia on a substrate. Alternatively, the substrate may be registered with indicia by deforming the substrate in a variety of ways known in the art, including, without limitation, punching holes in the substrate and raising and/or lowering portions of the substrate relative to other portions. The printer 1410 may be used for printing, e.g., receipts, coupons, cashless gaming receipts or tickets.

The processor 1401 may also be in communication with a ticket reader 1412, which is capable of reading, for example, receipts, coupons, cashless gaming receipts and/or tickets, and particularly indicia registered on any such substrates. The ticket reader 1412 may use optical sensing of printed indicia, for example, and optical character recognition to read indicia from a ticket inserted in the ticket reader 1412.

The processor 1401 may also be in communication with a credit card reader 1414. Such devices are known in the art, and generally allow a card such as a credit card or debit card to be inserted therewithin. The card may include a magnetic stripe or other form of data storage, which the credit card reader 1414 is capable of sensing and interpreting. Typically, the credit card reader allows a credit card transaction to be processed by communication with a credit card clearinghouse in a manner known in the art.

The processor 1401 may also be in communication with a display screen 1416, which displays images in a manner known in the art. Typical display screens include, without limitation, liquid crystal displays, plasma displays and video display monitors.

Some embodiments of the present invention allow for a gaming device and/or controller to offer at least one mortgaging option in which a player agrees to play at least one round of play of a game in accordance with at least one revised rule (whether favorable or unfavorable to the player). Exemplary method 220, described above, is but one example of various embodiments in which a player is able to mortgage at least one future round of play of a card game. Those of ordinary skill in the art will recognize that principles of such embodiments may be implemented and/or modified for use with many types and variations of game playing.

Figure 15:
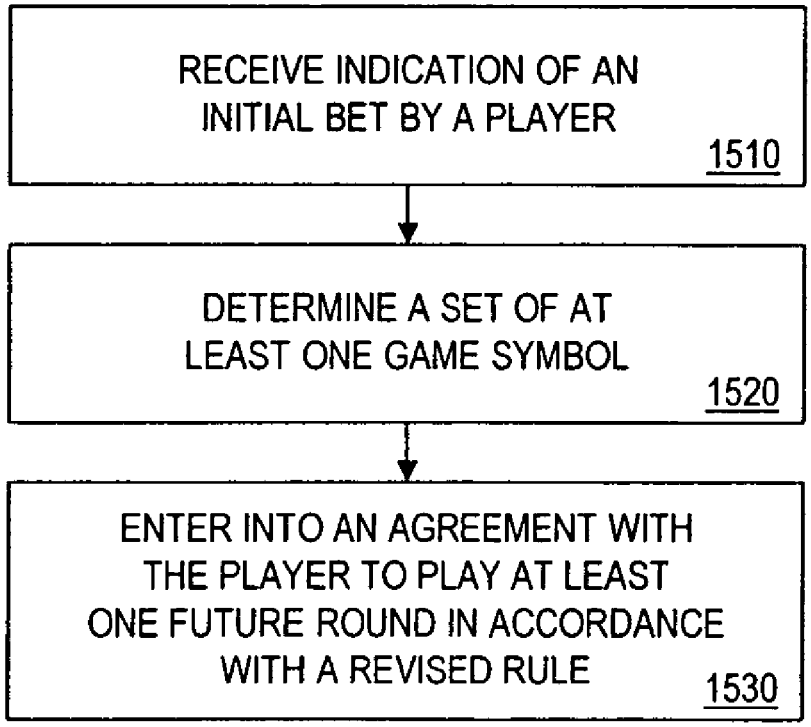
FIG. 15 is a flow chart representing an exemplary process in accordance with one or more embodiments of the present invention.

Referring to FIG. 15, an exemplary method 1500 is shown that may be performed by a gaming device and/or a controller (e.g., casino controller) for playing a game in accordance with one or more embodiments of the present invention. At step 1510, an indication of an initial bet by a player for a current round of play of a game is received (e.g., a player places a wager at a gaming device).

At step 1520, a set of game indicia is determined. The set of game indicia includes at least one game indicium or game symbol (e.g., representation of a card; reel symbol). For example, a gaming device may determine a starting hand for a player in a poker game. Optionally, an indication of the set of game indicia is displayed to the player. For example, the player may initiate a spin (e.g., by a handle pull) of at least one reel of a slot machine, and the slot machine may determine and display at least one reel symbol to the player (e.g., at a payline).

In some embodiments, determining the set of game indicia may include receiving an indication of the set of game indicia (e.g., a gaming device may receive an indication of a hand of cards from a casino controller). As will be understood by those of ordinary skill in the art, in one or more embodiments, determining the set of game indicia may include generating at least one random number (e.g., using a random number generator) and/or determining the set of game indicia based on a payout table.

In some embodiments of the present invention, the set of game indicia is an initial set of game indicia: the first-determined set of two or more determined sets of game indicia (e.g., the first set determined in a round of play; a starting hand of cards in a Blackjack game). In other embodiments, the set of game indicia determined may not be the first-determined set of game indicia of a round of play (e.g., a hand in Blackjack after one additional card is drawn but before another additional card is drawn), or may be the only set determined during the round of play (e.g., a set of reel symbols may be determined substantially simultaneously in response to a handle pull).

At step 1530, after determining the set of game indicia and before determining an outcome of the current round of play, an agreement is entered into with the player, in which the player agrees to play at least one future round of play of the game in accordance with at least one revised rule. For example, an agreement is made after a starting hand of cards is dealt to a player, but before determining a final hand of cards. In another example, an agreement is made after a first reel symbol is displayed to a player (e.g., at a payline), but before all of the reel symbols are displayed or otherwise revealed. A player could thus enter an agreement after a first reel symbol is set, but before remaining symbols are determined and/or revealed (e.g., before other reels stop spinning; before other reels are spun).

As described variously herein, the revised rule may correspond to at least one advantage to the player and/or at least one disadvantage to the player. In some embodiments, the revised rule relates to a benefit, such as an enhanced payout, or is a revised rule that is otherwise favorable to the player. In some embodiments, the revised rule relates to a disadvantage that penalizes the player, such as a decreased payout, or a revised rule that is otherwise unfavorable to the player. Many types of advantages, disadvantages, penalties, benefits, and revised rules are described herein, and others will be apparent to those having ordinary skill in the art.

In some embodiments, a revised rule or other change in play may not be characterized easily as being favorable or unfavorable. For example, a revised rule may require that a card (or set of cards) dealt to a player in a card game is changed to a different card (or set of cards). A favorable card (e.g., an Ace) or hand of cards (e.g., a winning hand) may thus be changed to another favorable card or hand (e.g., Ace-high straight), or may be changed to a less favorable card or hand (e.g., a non-winning hand). Similarly, an unfavorable hand may be changed to a different unfavorable hand or to a more favorable hand. The effect of some revised rules on play may thus be indeterminable by the player at the time the agreement is made.

In some embodiments, the player may continue play of the current round in accordance with at least one disadvantage and/or at least one advantage (e.g., in accordance with a benefit, penalty, and/or revised rule). Note that "continuing play" of a current round of some games may in fact include terminating the current round, for example, under some advantage (e.g., without the player losing some or all of the initial bet) and/or under some disadvantage (e.g., without allowing the player to draw any additional cards).

According to some embodiments of the present invention, the agreement to play includes an agreement to bet on at least one future round of play. For example, as described above, a gaming device may apply some or all of the initial bet to a future round of play.

Some embodiments of the present invention allow for a gaming device and/or a controller to offer at least one mortgaging option in which a player can agree to play the current round of play of a game in accordance with at least one disadvantage to the player (e.g., penalty; revised rule that is unfavorable to the player), in exchange for being able to play in accordance with at least one advantage (e.g., benefit; revised rule that is favorable to the player) during the current round of play. Method 250, described above, is but one example of various embodiments in which a player may mortgage a current round of play of a card game. Those of ordinary skill in the art will recognize that principles of such embodiments may be implemented and/or modified for use with many types and variations of game playing.

Figure 16:
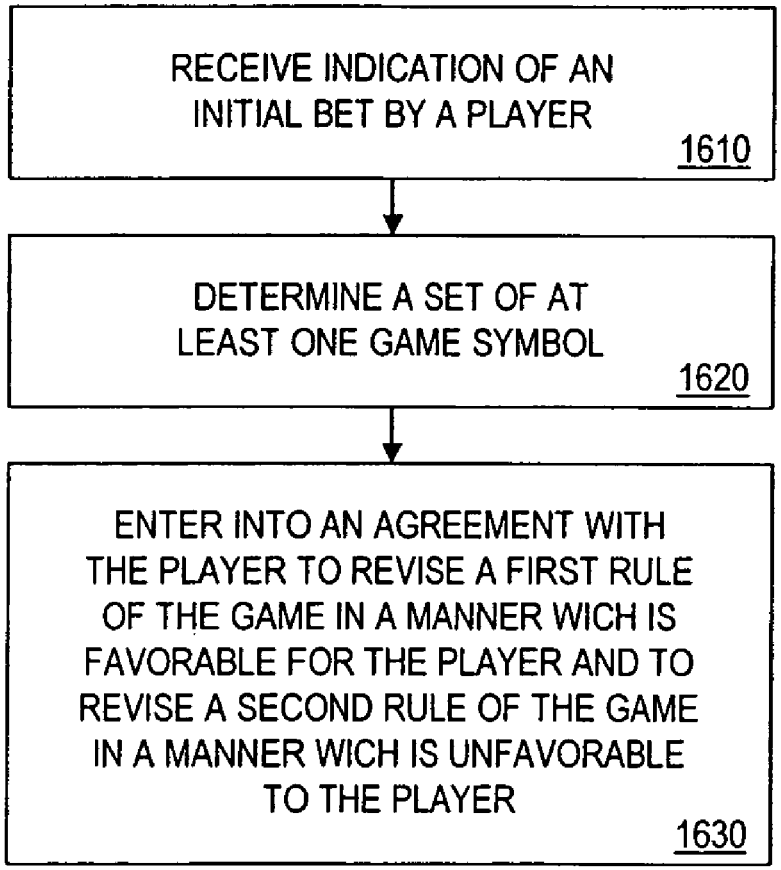
FIG. 16 is a flow chart representing an exemplary process in accordance with one or more embodiments of the present invention.

Referring to FIG. 16, an exemplary method 1600 is shown that may be performed by a gaming device and/or a controller (e.g., casino controller) for playing a game in accordance with one or more embodiments of the present invention. At step 1610, an indication of an initial bet by a player for a current round of play of a game is received (e.g., a player places a wager at a gaming device). At step 1620, a set of game indicia is determined. At step 1630, after determining the set of game indicia and before determining an outcome of the current round of play, an agreement is entered into with the player to revise at least a first rule of the game in a manner which is favorable for the player in exchange for revising at least a second rule of the game in a manner which is unfavorable for the player.

As described above, a mortgaging option may include an agreement by the player to play both the current round of play as well as at least one future round of play in accordance with a revised rule. Accordingly, in some embodiments, any advantage and/or disadvantage that the player agrees to for the at least one future round of play may also govern play during the current round. For example, a player may agree to play both the current round and at least one future round of play in accordance with the advantage that any payout will be enhanced by an additional two coins.

Figure 17:
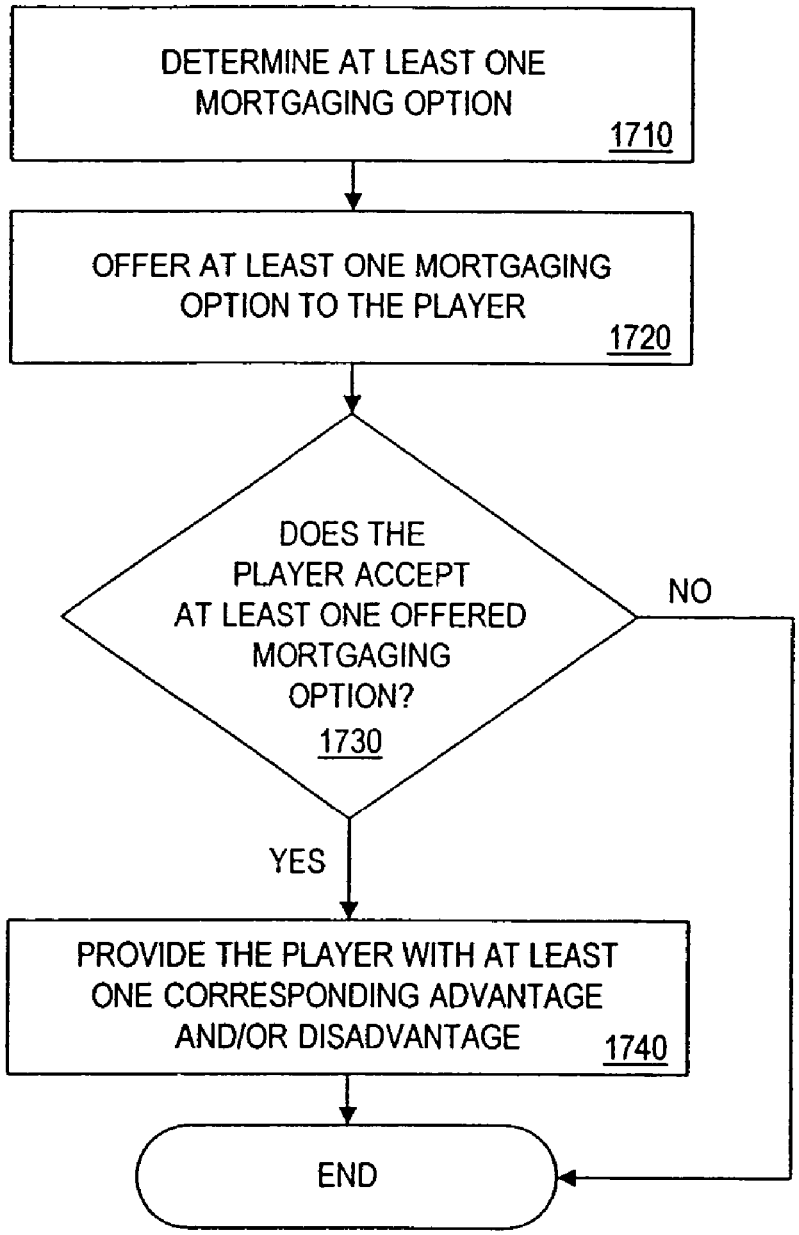
FIG. 17 is a flow chart representing an exemplary process in accordance with one or more embodiments of the present invention.

Referring to FIG. 17, an exemplary method 1700 is shown that may be performed by a gaming device and/or a controller (e.g., casino controller) for offering a mortgaging option in accordance with one or more embodiments of the present invention. At step 1710, at least one mortgaging option for at least one round of play (e.g., future round; current round) is determined. As described variously herein, according to some embodiments each mortgaging option is associated with at least one disadvantage to the player in at least one round of play, and may also be associated with at least one advantage to the player. For example, a mortgaging option may include an agreement by a player to play at least one round of a game in accordance with a revised rule that is unfavorable to the player. In some embodiments, a gaming device, for example, selects one or more mortgaging options to offer from a set of available mortgaging options. In one example, a gaming device may determine one or more mortgaging options to offer a player based on eligibility criteria, as described herein, and/or based on player preferences (e.g., stored in player tracking data database 118). In another example, a casino may determine one or more mortgaging options that it wants to offer for a particular game (or games), and may configure gaming devices and/or instruct casino personnel to offer the options. In some embodiments, mortgaging options may be determined after (or in response to) a request by the player for a mortgage (e.g., by pressing a button on a slot machine; by asking a dealer for a mortgage).

At step 1720, the one or more mortgaging options are offered to a player. For example, a gaming device may communicate a set of options via a display screen and/or via a speaker to a player playing the gaming device. In another example, as discussed above with respect to a Blackjack game, tokens, buttons, and/or indicators may be made available to players (e.g., at a table; at a gaming device) that indicate the availability of at least one mortgaging option. In yet another example, a table or gaming device may be designed with text indicating the availability of a mortgaging option (e.g., "ENHANCED PAYOUT with Mortgaged Spin"). In some embodiments, a mortgaging option may be offered to a player after (or in response to) a request by the player for a mortgage.

At step 1730, it is determined whether the player accepts at least one mortgaging option of the offered mortgaging options. In some embodiments, an indication that the player accepts a mortgaging option is received. For example, a player may indicate acceptance of a mortgaging option by selecting a button at a gaming device that corresponds to the desired option(s), or by touching a touch screen at a location associated with the desired option(s). A mortgaging option may be accepted by a player before or after a wager is made by the player, and may be accepted before or after any game indicia (e.g., cards; reel symbols) are determined. For example, in a reeled slot machine game, a player may indicate acceptance of a mortgaging option before spinning any reels.

At 1740, if the player has accepted one or more mortgaging options, the player is provided with at least one corresponding advantage and/or disadvantage during at least one round of play, and the process ends. In some embodiments, the player plays at least one round of play in accordance with a revised rule. The revised rule may be unfavorable to the player (e.g., a penalty), favorable to the player (e.g., a benefit), or its potential effect may be either favorable or unfavorable. As described herein, a mortgaging option may be applied to a current round, a future round, or both.

In some embodiments, as depicted in FIG. 17, the exemplary process ends if the player does not accept an option. For example, the player may continue playing under whatever conditions were present at the time the mortgaging option was offered. According to some other embodiments, if the player does not accept a mortgaging option, the gaming device and/or controller may determine and offer other mortgaging options to the player (e.g., based on the options that were refused).

In some embodiments of the present invention, the steps of determining, offering, and receiving an indication of acceptance of one or more mortgaging options may be combined, subdivided, and/or modified such that a player may accept one or more terms of a mortgaging option separately from one or more other terms. In one exemplary process, a gaming device asks a player whether he prefers to mortgage the current round, one or more future rounds, or both. Based on the response, the gaming device then may determine one or more advantages to offer the player. The player then selects one or more offered advantages. Based on the selected advantages, the gaming device determines and offers one or more disadvantages for the appropriate round(s). Those of ordinary skill in the art will recognize that other combinations, modifications, and sequences of steps may be provided in accordance with various embodiments of the present invention.

According to various embodiments of the present invention, one or more mortgaging options may be determined, offered, and/or accepted: (i) before and/or after starting a round of play; (ii) before and/or after an initial bet is made; (iii) before and/or after any game indicia are determined; or (iv) before and/or after any game indicia are displayed or otherwise communicated to the player.

An exemplary round of play in accordance with one or more mortgaging embodiments of the present invention may be described with respect to a poker game. This exemplary round of play may occur using a physical poker table in a physical casino, a virtual table in a virtual or online casino, or a virtual gaming machine (e.g., video poker machine). According to the exemplary round of play, before any cards were dealt, a player made an initial bet by pressing a "MAX BET" button of a video poker machine. The video poker machine then determined a starting hand consisting of five cards, and displayed the starting hand to the player on a display screen. In this example, the player was dealt a starting hand consisting of 2♥, 4♠ 7♣, 5♦ and 10♦. Thus, in this example, the player has been dealt an unfavorable or "bad" hand that is unlikely to provide a satisfactory payout if he draws any additional cards. In this situation, the player would typically like to "walk away," but is prevented from doing so by the fact that he has already placed an initial bet.

After receiving the starting hand and before drawing any additional cards or completing the current round, the player accepted an offer for a mortgaging option. To indicate his selection of the mortgaging option, the player pressed a button labeled "PROTECT ME!" at the video poker machine.

By selecting this option, the player received an advantage in the current round of play in exchange for mortgaging at least one round of play of the poker game. In this example, the player received an advantage of protecting a portion of the initial bet (e.g., two coins of an initial three-coin wager are available for use in a future round of play), in exchange for mortgaging a subset of winning outcomes in the current and two future rounds (e.g., a pair of Jacks will not result in a winning payout). Various other exemplary advantages and disadvantages are described herein, and others will be known to those of ordinary skill in the art.

Various embodiments of the present invention provide for playing a slot machine game, such as a slot machine game employing virtual and/or mechanical reels. An exemplary round of play in accordance with one or more mortgaging embodiments of the present invention may be described with respect to a slot machine game. It will be understood by those of ordinary skill in the art that a round of play of many types of slot machine games may include play of at least one bonus game. A mortgaging option may thus be applicable to "standard" play and/or play of a bonus game. This exemplary round of play may occur in various ways, such as by using a slot machine in a physical casino, using a wireless gaming device, using a handheld or portable gaming device, or using a virtual slot machine in a virtual or online casino (e.g., using a personal computer).

According to the exemplary round of play, a player at a video slot machine made an initial bet by pressing a "MAX BET" button of the video slot machine. Optionally, the player then pressed a "SPIN" button that spun one or more reels. The video slot machine spun three virtual reels and displayed a set of three reel symbols at a payline on a display screen. In this example, the result of the handle pull was PLUM-ORANGE-BELL. Thus, in this example, the player has received a typically non-winning payout, and would likely prefer not to have made the wager.

In this exemplary round, however, either before or after receiving the unfavorable result, the player accepted a mortgaging option in order to protect the initial bet. To indicate his selection of the mortgaging option, the player pressed a "SPIN GUARD" button of the video slot machine. By selecting this option, the player received an advantage in the current round of play of the slot machine game. Specifically, in the example, the player will be allowed to spin up to two of the three reels again, until the player achieves a winning outcome (e.g., a combination of reel symbols corresponding to a non-zero payout). In exchange for this advantage in the current round, the player mortgaged the next ten rounds of play. Specifically, in this example, the player will have any payouts achieved during the next ten rounds decreased by one unit (e.g., one coin).

In another exemplary round of play, the player accepted a mortgaging option after two of three reel symbols were communicated to the player, but before all of the reel symbols were known to the player. For example, after entering the initial bet and hitting the "SPIN" button, a PLUM symbol and an ORANGE symbol were displayed on two of the reels. While the resulting reel symbol on the third reel was still not known to the player (e.g., while the third reel was still spinning; while the third reel symbol was still obscured), the player accepted a mortgaging option which allowed him to change the ORANGE symbol to a PLUM symbol. In some embodiments, a player may have a respective opportunity to accept a mortgaging option following the revealing of each of a plurality of game symbols. According to some embodiments, a player may have an opportunity to accept a mortgaging option following the revealing of a predetermined number of game symbols (e.g., after two cards of five cards have been dealt).

In still another exemplary round of play, the player accepted a mortgaging option after the slot machine revealed a representation of a multiplier, but before any resulting reel symbols were revealed. For example, after entering the initial bet, a "2X" was displayed on a display screen of the slot machine, indicating that the payout corresponding to a final reel outcome would be doubled. In this exemplary round, the player accepted a mortgaging option which allowed him to have any forthcoming ORANGE symbols changed to a CHERRY symbol. After the mortgaging option was accepted, the reels were spun and play continued.

In yet another exemplary round of play, a player is in a bonus game of a slot machine game. In the bonus game, the player is allowed to open up to ten trapdoors. Some of the trapdoors open to reveal a prize. However, if the player opens three incorrect doors (e.g., non-prize doors), then the bonus game ends. In this exemplary round, the player has opened four doors, two of which are incorrect doors. Afraid of ending the bonus game by selecting a third incorrect door, the player pressed a "HINTS!" button of the slot machine. In response to the player's request, the player was presented with two mortgaging options: (i) Two prize doors revealed in exchange for a disadvantage in a future round of play of the slot machine game (and play of the bonus game can continue with four more potential selections); or (ii) Two prize doors revealed in exchange for terminating the bonus game. The player was happy to select the first option, believing that he would not have been able to find two prize doors before finding an incorrect door and thus ending the game.

Some advantages that may be provided to a player in at least one round of play of a game include, without limitation:

(i) Adding one or more game symbols. For example, a jackpot symbol, a bonus symbol, or any other symbol may be added to one or more reels in a slot machine game. In another example, a wild card may be added to a deck of cards. In some embodiments, a number of one or more particular cards or one or more categories of cards (e.g., hearts) may be increased in a card game (e.g., made available for dealing to a player). For example, the number of Jacks, or the number of diamonds, may be increased (e.g., two Jacks of clubs will be available for play; twenty diamond cards will be available for play). In another example, one or more decks may be added. One benefit of using multiple decks, for example, is that a flush is more likely to occur. In addition, special card combinations, like five-of-a-kind, become possible.

(ii) Enhancing one or more payouts. For example, a predetermined amount (e.g., two coins) may be added to increase a player's payout in one or more rounds of play. In another example, a payout may be multiplied by a predetermined multiplier to increase a player's payout. In yet another example, the player may be paid as if more credits had been wagered than the player actually wagered (e.g., player wagered two coins but will be paid as if he had wagered three coins). In some embodiments, the payouts for particular outcomes may be enhanced. For example, the payout for CHERRY-CHERRY-<ANY>, or for a pair of Jacks or better, may be increased (e.g., from three coins to four coins). In some embodiments, a payout is enhanced if it is greater than a predetermined amount, less than a predetermined amount, and/or equal to a predetermined amount. In some embodiments, a payout may be increased for a second set of game indicia that the player is likely to achieve given a first set of game indicia. For example, if a player has four cards to a flush, then the payout for flushes may be increased.

(iii) Increasing one or more probabilities. For example, the probability of achieving a particular set of game indicia or combination of game symbols (e.g., set of reel symbols; hand of cards) may be increased. In another example, a probability of getting into a bonus round may be increased. In some embodiments, the probability of drawing a card or category of cards that would help the player may be increased (e.g., a probability of drawing a heart may be increased if the player is going for a heart flush).

(iv) Increasing the number of outcomes that are paying outcomes (e.g., have payouts greater than zero).

(v) Giving the player extra paylines (or extra hands). For example, if a wager in a slot machine game of one coin generally gives the player one payline, second and third paylines may be provided as an advantage. The extra paylines may result in a winning outcome for the player. In another example, the player may be provided with one or more extra hands of cards to play in a card game (e.g., triple-play video poker becomes quadruple-play video poker).

(vi) Guaranteeing at least a minimum payout. For example, the player may be guaranteed to achieve a set of game indicia (e.g., hand of cards) corresponding to at least a one-coin payout. In another example, the player might be guaranteed a one-coin payout regardless of the outcome of the round of play.

(vii) Guaranteeing at least one game symbol. For example, the player may start a round with at least one game symbol already set (e.g., a jackpot symbol on one reel is set on the payline in a slot machine game, and the remaining reels are spun during play; an Ace is guaranteed in a starting hand of a card game). In another example, the player may be guaranteed to receive at least one particular game symbol during play of the game (e.g., an Ace is guaranteed in a draw poker game (in a starting hand and/or after discarding)). In another example, the player may be guaranteed to achieve a particular set of game symbols (e.g., royal straight flush; BAR-BAR-BAR), which may be a winning set of game symbols.

(viii) Re-spinning or moving one or more reels. For example, after an initial spin, a player may be permitted to re-spin at least one reel in a slot machine game in order to try to achieve a higher-paying result. In another example, a player may be allowed to have one or more reels moved by one or more stop positions (e.g., a reel is "nudged" by one stop so that the player achieves a winning combination of reel symbols).

(ix) Changing one or more game symbols. For example, in a card game, one or more of the cards could be changed to a different card, which may result in a winning result for the player. In another example, one or more reel symbols at a payline may be altered in a slot machine game. In some embodiments, the player may select what the new symbol will be (e.g., a PLUM), or may pick the category of symbol (e.g., a fruit symbol; a diamond).

(x) Replaying or supplementing a bonus game. A player may be able to replay some or all of a bonus game of a slot machine. For example, a player may be allowed to re-select one or more "fish" in a fishing-themed bonus game. In another example, a player may be given one or more additional opportunities in a bonus game. For example, if the player is typically only allowed to select up to three "graves" in a graveyard-themed bonus game, as an advantage in a round of play the player may be allowed to select one additional "grave" before the bonus game ends.

(xi) Providing hints or strategies. Some hints or strategies that a player may be given include, without limitation: how to make a choice in a bonus game, how to answer a question being presented in a bonus round, which cards to hold (or draw) in a poker game, or which strategy to pursue in a Blackjack game.

(xii) Enhancing comp points. A player may be given extra comps or may be given comps at an increased rate (e.g., double comps for this round of play).

(xiii) Allowing a player to draw extra cards. As described herein, a player may be allowed to draw more cards than usual. For example, a player may be allowed to draw one or more extra cards in a poker game even if no cards are discarded (e.g., allowing the player to make the best five-card hand out any cards received). In some embodiments, a player may be allowed to review a card before accepting or rejecting it, and may be able then to draw one or more additional cards. For example, the player may be allowed to discard and draw one card at a time, instead of having to decide at once all of the cards to discard in a poker game. With this benefit, a player is less likely, for example, to throw away a ten and then draw a new ten and wish the first ten had not been discarded.

(xiv) Allowing a player to retrieve one or more cards previously discarded. For example, the player may be able to return a previously-discarded card to a hand in a video poker game. In some embodiments, one or more discarded may be reinserted randomly into the deck, making them available to be dealt to a player.

(xv) Allowing the player to play a round in two or more different ways. As described in U.S. patent application Ser. No. 10/298,621, "Method and Apparatus for Facilitating Play of a Gaming Device," a player may be provided an opportunity to play an initial set of game symbols according to two or more strategies. For example, a player may be able to play an initial hand in a card game (e.g., poker; Blackjack) to two final outcomes according to two respective play strategies, such as by drawing two cards to the initial hand according to a first strategy, and by not drawing any cards to the initial hand according to a second strategy.

(xvi) Increasing a duration of a session-based game for the player. For example, in some embodiments a player may pay a flat rate (e.g., $10) in advance for a gaming session comprising a predetermined length of time and/or a predetermined number of game plays. Accordingly, in some embodiments, an advantage that may be provided to a player may comprise an increased duration of such a session (e.g., additional game plays and/or an increased length of time).

Other advantages, benefits, and revised rules that are favorable to the player will be apparent to those having ordinary skill in the art.

Some disadvantages, revised rules, or penalties that may be provided to a player in at least one round of play of a game include, without limitation:

(i) Reducing one or more payouts. In one example, a player has to give up a predetermined number of coins for any payout that is greater than or equal to a predetermined amount. For example, a player has to give up two coins in any payout greater than twenty coins. In another example, a video poker machine now pays only on Queens or better, rather than on Jacks or better.

(ii) Reducing the duration of a bonus game. For example, the number of opportunities to achieve a bonus amount (e.g., by selecting a "grave") may be reduced.

(iii) Reducing one or more probabilities (iv) Allowing player to draw fewer cards. For example, in a poker game, limiting a player to drawing four cards maximum rather than five, as is usual.

(v) Eliminating one or more game symbols. For example, the player may have agreed to play a game of video poker in which only two Jacks are available in the deck.

(vi) Player agrees to play at an increased rate of play. For example, the player agrees to make one handle pull every fifteen seconds. In another example, the player agrees to wager at least a minimum amount during a predetermined time period (e.g., ten coins every five minutes). In some embodiments, a player's credit balance may be deducted based on the rate agreed to (e.g., the credit balance is reduced by at least one coin every fifteen seconds), whether the player himself initiates play (e.g., by pulling a handle of a slot machine) or not.

(vii) Player agrees to play for at least a certain amount of time. For example, the player agrees to play for at least a predetermined amount of time (e.g., one hour), or at least until a specific time (e.g., 9:00 p.m.).

(viii) Player agrees to play during a particular period of time. For example, the player agrees to play at least one round during a particular day, week, month, or year. In another example, the player agrees to play at least one round every day for a week. In this way, a casino may commit a player to returning to the casino.

(ix) Player agrees to increase his wager size for at least one round. For example, the player agrees to make a wager that is not less than a predetermined minimum wager amount for at least one round.

(x) Player agrees to play at least a minimum number of rounds (xi) Player agrees to a condition on when he will cash out. For example, the player agrees not to cash out for a predetermined period of time (e.g., one hour). In some embodiments, the player need not necessarily play during any or all of the amount of time. In another example, the player agrees not to cash out before a specific time (e.g., 2 p.m.). In another example, the player agrees to cash out during a predetermined period of time (e.g., between 2 p.m. and 3 p.m.).

(xii) Reducing comp points. For example, the player may earn comps at a reduced rate during play, or may have an amount of earned comp points reduced.

(xiii) Forfeiting eligibility for a bonus game. For example, even if a player achieves an outcome that would otherwise have qualified him for a bonus game, the player is not allowed to participate in the bonus game. In another example, the player is prevented from achieving an outcome that would qualify him for the bonus game.

Other disadvantages, penalties, and revised rules that are unfavorable to the player will be apparent to those having ordinary skill in the art.

As described herein, a disadvantage may be a revision of a conventional rule in a manner that is unfavorable to the player. It will be understood by those of ordinary skill in the art that a disadvantage associated with a mortgaging option may also be the removal of any of the conditions described as an advantage herein. For example, a player playing under a revised rule that is favorable to the player (e.g., an enhanced payout) may accept a mortgaging option in which the disadvantage is that play returns to the conventional (or "unrevised") rule (e.g., a standard payout). Similarly, it will be understood by those of ordinary skill in the art that an advantage associated with a mortgaging option may also be the removal of any of the conditions described as a disadvantage herein.

In addition, it will be recognized by those of ordinary skill in the art that some of the advantages and disadvantages described herein will suggest their respective opposite. In other words, that an enhanced payout may be provided as an advantage under one mortgaging option will suggest that a decreased payout may be imposed as a disadvantage under another mortgaging option.

Under some mortgaging options described herein, the player agrees to some aspect of future performance (e.g., betting at least a predetermined amount on a future round; playing at least a certain number of future rounds). Various embodiments of the present invention provide for ensuring that a player is liable for meeting any such future obligation. According to some embodiments, a player must commit a predetermined amount of currency (e.g., by inserting credit into a gaming device) that is kept until the player completes all rounds of play in which mortgage conditions are in effect. In other embodiments, if a player does not complete all rounds of play under the mortgage conditions agreed to a charge or other penalty is applied to the player's room bill, credit card account, or other account. In some embodiments, a third party may vouch for the player by providing a credit card number, room number, etc. The other person is then charged a penalty if the player does not fulfill the terms of the mortgaging option. In some embodiments, a third party may fulfill any obligation of the player (e.g., another person may play any rounds that the player does not).

According to some embodiments of the present invention, a player playing a first game may agree under a mortgaging option to play a second game (e.g., a different game) in accordance with an advantage and/or disadvantage. For example, a player playing a Blackjack game may accept a mortgaging option under which the player receives an enhanced payout in the current round of the Blackjack game in exchange for agreeing to play at least one future round of a video poker game in accordance with a revised rule that is unfavorable to the player.

According to one or more embodiments, a player playing at a first gaming device may agree to play at least one future round of a game at a second gaming device. For example, a player playing at one slot machine may enter into an agreement in which the player agrees to play at a different slot machine for at least one future round. In another example, a player playing a slot machine game at a personal computer via the Internet may enter into an agreement to play at least one future round at a slot machine at a casino in accordance with a revised rule that is favorable to the player. In this way, a casino may encourage an on-line player to visit the casino.

In another example, a player playing at a video poker machine enters into an agreement to get an enhanced payout during play of at least one round at the video poker machine, in exchange for agreeing to play at least one round at a different slot machine in accordance with a revised rule that is unfavorable to the player (e.g., a decreased probability of winning a jackpot).

It is to be understood that the embodiments shown and described herein are merely illustrative of the principles of this invention and that various modifications may be implemented by those skilled in the art without departing from the scope and spirit of the invention. For example, the invention may also be used with other hands of cards than the exemplary hands of cards described herein. Also, different eligibility criteria may be used than the eligibility criteria described herein for making a player eligible to make a bust insurance bet or to select a mortgaging option. Further, other rules may be revised, or rules may be revised in other ways, than as described herein. Still further, hardware implementations using different hardware components may be used other than those described herein. Also, other databases or data structures may be used than those described herein. Further, the steps of the methods described herein may be performed in different combinations and orders. While other modifications will become evident to those of ordinary skill in the art, the invention is intended to extend to those modifications that nevertheless fall within the scope of the appended claims.

We claim:

1. A method of operating a gaming system, said method comprising:

(a) causing at least one processor to execute a plurality of instructions stored in at least one memory device to operate with at least one input device to receive a wager on a round of a game from a player;

(b) after receiving said wager for the round of the game, causing the at least one processor to execute the plurality of instructions stored in the at least one memory device to determine an intermediate outcome including at least one game indicium for the round of the game, wherein the round of the game is played in accordance with a first rule of the game;

(c) causing the at least one processor to execute the plurality of instructions stored in the at least one memory device to operate with at least one display device to display the determined intermediate outcome including the at least one game indicium for the round of the game;

(d) after displaying the at least one game indicium and before displaying a final outcome of the round of the game, causing the at least one processor to execute the plurality of instructions stored in the at least one memory device to operate with the at least one display device to display to the player an offer to enter into an agreement to play at least one subsequent round of the game in accordance with a second different rule of the game instead of the first rule;

(e) causing the at least one processor to execute the plurality of instructions stored in the at least one memory device to operate with the at least one display device to display the final outcome of the round of the game;

(f) causing the at least one processor to execute the plurality of instructions stored in the at least one memory device to perform an evaluation of the final outcome based on the first rule of the game; and (g) causing the at least one processor to execute the plurality of instructions stored in the at least one memory device to operate with the at least one display device display to the player any award based on a result of said evaluation.

2. The method of claim 1, in which the game is a slot machine game.

3. The method of claim 1, in which the game is a card game.

4. The method of claim 1 in which the game is a blackjack game.

5. The method of claim 1, in which the game is a poker game.

6. The method of claim 1, further comprising: causing the at least one processor to execute the plurality of instructions stored in the at least one memory device to provide the player with a disadvantage during the round of the game.

7. The method of claim 6, which includes causing the at least one processor to execute the plurality of instructions stored in the at least one memory device to cause the second different rule to be favorable to the player.

8. The method of claim 1, further comprising causing the at least one processor to execute the plurality of instructions stored in the at least one memory device to cause the second different rule to be a disadvantage for the player with respect to the first rule of the game.

9. The method of claim 8, further comprising: causing the at least one processor execute the plurality of instructions stored in the at least one memory device to provide the player with an advantage during the round of the game.

10. The method of claim 1, which comprises: causing the at least one processor to execute the plurality of instructions stored in the at least one memory device to operate with the at least one input device to enable the player to enter into the agreement after causing the at least one processor to execute the plurality of instructions stored in the at least one memory device to determines a first indicium and before causing the at least one processor to execute the plurality of instructions stored in the at least one memory device to determines a second indicium.

11. The method of claim 1, in which the second different rule corresponds to a reduced chance of winning in the at least one subsequent round of the game.

12. The method of claim 1, further comprising: causing the at least one processor execute the plurality of instructions stored in the at least one memory device to provide the player with an advantage in the round of the game.

13. The method of claim 12, which comprises: causing the at least one processor execute the plurality of instructions stored in the at least one memory device to facilitate play of the round of the game in accordance with a third different rule that is favorable to the player.

14. The method of claim 12, which comprises: causing the at least one processor execute the plurality of instructions stored in the at least one memory device to terminate the round without causing the player to lose all of an initial bet.

15. The method of claim 12, which comprises: causing the at least one processor execute the plurality of instructions stored in the at least one memory device to provide the player with an increased chance of winning during the round of the game.

16. The method of claim 1, wherein: the round of the game is part of a gaming session purchased by the player, the gaming session comprising multiple rounds of play; and which includes causing the at least one processor to execute the plurality of instructions stored in the at least one memory device to add the at least one subsequent round to the gaming session by increasing a duration of the gaming session.

17. A method of operating a gaming system, said method comprising:

(a) causing at least one processor to execute a plurality of instructions stored in at least one memory device to operate with at least one input device to receive a wager on a round of a game from a player;

(b) after receiving said wager for the round of the game, causing the at least one processor to execute the plurality of instructions stored in the at least one memory device to determine an intermediate outcome including a set of at least one game symbol for the round of the game, wherein the round of the game is played in accordance with a first rule;

(c) causing the at least one processor to execute the plurality of instructions stored in the at least one memory device to operate with at least one display device to display the intermediate outcome including the set of at least one game symbol for the round of the game;

(d) causing the at least one processor to execute the plurality of instructions stored in the at least one memory device to determine a plurality of mortgaging options;

(e) after displaying the set of at least one game symbol for the round of the game and before displaying a final outcome for the round of the game, causing the at least one processor to execute the plurality of instructions stored in the at least one memory device to operate with the at least one display device to display an indication of the plurality of different mortgaging options to the player;

(f) causing the at least one processor to execute the plurality of instructions stored in the at least one memory device to receive an indication of acceptance by the player of one of said mortgaging options from the plurality of different mortgaging options, wherein the accepted mortgaging option is associated with an agreement by the player to play at least one subsequent round of the game in accordance with a second different rule instead of the first rule;

(g) causing the at least one processor to execute the plurality of instructions stored in the at least one memory device to operate with the at least one display device to display the final outcome of the round of the game;

(h) causing the at least one processor to execute the plurality of instructions stored in the at least one memory device to perform an evaluation of the final outcome based on the first rule of the game; and (i) causing the at least one processor to execute the plurality of instructions stored in the at least one memory device to operate with the at least one display device to display to the player any award based on a result of said evaluation.

18. The method of claim 17, in which the at least one display device includes a touch screen.

19. The method of claim 17, which comprises: causing the at least one processor to receive the indication of acceptance from a gaming device.

20. The method of claim 17, which comprises: causing the at least one processor to execute the plurality of instructions stored in the at least one memory device to operate with the at least one input device to receive the indication of acceptance.

21. The method of claim 20, in which the at least one input device includes a touch screen.

* * * * *

UNITED STATES PATENT AND TRADEMARK OFFICE

CERTIFICATE OF CORRECTION

PATENT NO. : 7,942,731 B2
APPLICATION NO. : 11/243398
DATED : May 17, 2011
INVENTOR(S) : Jay S. Walker et al.

It is certified that error appears in the above-identified patent and that said Letters Patent is hereby corrected as shown below:

IN THE CLAIMS:

In Claim 1, column 49, line 50, after "the at least one display device," add --to--.

In Claim 9, column 50, line 7, between "processor" and "execute," add --to--.

In Claim 10, column 50, line 16, replace "determines" with --determine--.

In Claim 10, column 10, line 18, replace "determines" with --determine--.

In Claim 12, column 50, line 25, between "processor" and "execute," add --to--.

In Claim 13, column 50, line 30, between "processor" and "execute," add --to--.

In Claim 14, column 50, line 35, between "processor" and "execute," add --to--.

In Claim 15, column 50, line 39, between "processor" and "execute," add --to--.

Signed and Sealed this
Ninth Day of August, 2011

David J. Kappos

David J. Kappos
*Director of the United States Patent and Trademark Office*